US009416959B2

(12) United States Patent
Spinner

(10) Patent No.: US 9,416,959 B2
(45) Date of Patent: Aug. 16, 2016

(54) ILLUMINATED GOLF

(71) Applicant: Donald Spinner, North Syracuse, NY (US)

(72) Inventor: Donald Spinner, North Syracuse, NY (US)

(73) Assignee: Donald Spinner, Syracuse, NY (US)

( * ) Notice: Subject to any disclaimer, the term of this patent is extended or adjusted under 35 U.S.C. 154(b) by 252 days.

(21) Appl. No.: 13/838,891

(22) Filed: Mar. 15, 2013

(65) Prior Publication Data

US 2013/0314906 A1 Nov. 28, 2013

Related U.S. Application Data

(60) Provisional application No. 61/648,385, filed on May 17, 2012.

(51) Int. Cl.

| | |
|---|---|
| ***F21V 33/00*** | (2006.01) |
| ***A63B 57/00*** | (2015.01) |
| ***A63B 69/36*** | (2006.01) |
| ***A63B 37/00*** | (2006.01) |
| ***A63B 43/06*** | (2006.01) |

(52) U.S. Cl.

CPC ..... *F21V 33/008* (2013.01); *A63B 37/0003* (2013.01); *A63B 43/06* (2013.01); *A63B 57/00* (2013.01); *A63B 57/357* (2015.10); *A63B 57/40* (2015.10); *A63B 69/3632* (2013.01); *A63B 2207/02* (2013.01); *A63B 2225/093* (2013.01)

(58) Field of Classification Search

CPC ..... F21V 33/008; A63B 2207/02; A63B 57/0056; A63B 69/3632; A63B 43/06; A63B 37/0003; A63B 57/00; A63B 2225/0093

See application file for complete search history.

(56) References Cited

U.S. PATENT DOCUMENTS

| | | | |
|---|---|---|---|
| 586,373 | A | 7/1897 | Walker |
| 2,248,053 | A | 7/1941 | Bales |
| 2,696,985 | A | 12/1954 | Hogeberg |
| 2,825,569 | A | 3/1958 | Alvarez |
| 2,836,253 | A | 5/1958 | Lovell |
| 2,907,890 | A | 10/1959 | Rexon |
| 2,951,704 | A | 9/1960 | Neiler |
| 3,020,049 | A | 2/1962 | McNeill |
| 3,136,117 | A | 6/1964 | Speiser |
| 3,191,939 | A | 6/1965 | Hooper |
| 3,194,563 | A | 7/1965 | Mackniesh |
| 3,300,218 | A | 1/1967 | Speiser |
| 3,325,169 | A | 6/1967 | Mackniesh |
| 3,366,387 | A | 1/1968 | Koener |
| 3,469,905 | A | 9/1969 | Cornell et al. |
| 3,513,707 | A | 5/1970 | Russell et al. |
| 3,528,733 | A | 9/1970 | Russell et al. |
| 3,655,202 | A | 4/1972 | Gautraud et al. |
| 3,666,271 | A | 5/1972 | Honnef |
| 3,685,909 | A | 8/1972 | Schwatz |

(Continued)

FOREIGN PATENT DOCUMENTS

DE WO 2012032037 A1 * 3/2012 ..... A63B 69/36

*Primary Examiner* — Anne Hines

(74) *Attorney, Agent, or Firm* — Heslin Rothenberg Farley & Mesiti P.C.; George S. Blasiak, Esq.

(57) ABSTRACT

There is set forth herein one or more feature for providing illuminated golf. The one or more feature can comprise e.g., a golf cup apparatus having a light source bank, a golf flag apparatus having a light source bank, a wearable apparatus having a light source bank, an illumination providing golf ball and an apparatus for charging a golf ball having a light source bank.

29 Claims, 33 Drawing Sheets

(56) References Cited

U.S. PATENT DOCUMENTS 3,743,296 A 7/1973 Branz
3,801,108 A 4/1974 Murray
3,820,130 A 6/1974 Cornelison, Jr. et al.
3,820,795 A 6/1974 Taylor
3,917,264 A 11/1975 Davidson et al.
3,917,279 A 11/1975 Barber
4,049,949 A 9/1977 Fitzsimons
4,063,259 A 12/1977 Lynch et al.
4,114,887 A 9/1978 DelRaso
4,131,280 A 12/1978 Poortman
4,146,230 A 3/1979 Foster
4,150,825 A 4/1979 Wilson
4,158,853 A 6/1979 Sullivan et al.
4,168,115 A 9/1979 Russell et al.
4,177,994 A 12/1979 Lindquist
4,195,920 A 4/1980 Russell et al.
4,247,112 A 1/1981 Del Raso
4,251,077 A 2/1981 Pelz et al.
4,341,384 A 7/1982 Thackrey
4,342,455 A 8/1982 Miyamae
4,342,456 A 8/1982 Miyamae
4,437,672 A 3/1984 Armantrout et al.
4,456,257 A 6/1984 Perkins
4,572,512 A 2/1986 Tegart
4,630,829 A 12/1986 White
4,693,479 A 9/1987 McGwire
4,819,942 A 4/1989 Lee et al.
4,825,971 A 5/1989 Bernstein
4,927,015 A * 5/1990 Jones ..... 206/315.9
4,975,770 A 12/1990 Troxell
4,991,851 A 2/1991 Melesio
5,024,441 A 6/1991 Rousseau
5,029,868 A 7/1991 Cloud
5,029,870 A 7/1991 Concepcion et al.
5,038,103 A 8/1991 Scarzello et al.
5,082,282 A 1/1992 Hernberg
5,146,557 A 9/1992 Yamrom et al.
5,160,839 A 11/1992 Nishiyama et al.
5,169,150 A 12/1992 Tindale
5,169,151 A 12/1992 Conley
5,181,721 A 1/1993 Halliburton
5,207,429 A 5/1993 Walmsley et al.
5,226,660 A 7/1993 Curchod
5,230,512 A 7/1993 Tattershall
5,255,920 A 10/1993 Mangeri
5,265,875 A 11/1993 Fitzgerald
5,277,428 A 1/1994 Goodwin et al.
5,288,080 A 2/1994 Tice
5,306,011 A 4/1994 Perry
5,338,037 A 8/1994 Toyohara
5,370,387 A 12/1994 Baker
5,374,063 A 12/1994 Ogden
5,437,457 A 8/1995 Curchod
5,445,373 A 8/1995 Franks
5,467,991 A * 11/1995 White et al. ..... 473/220
5,467,992 A 11/1995 Harkness
5,472,205 A 12/1995 Bouton
5,527,036 A 6/1996 Hutchings et al.
5,527,041 A 6/1996 Terry, III et al.
5,626,526 A 5/1997 Pao et al.
5,662,534 A 9/1997 Kroll et al.
5,665,006 A 9/1997 Pellegrini
5,673,812 A 10/1997 Nelson
5,676,603 A 10/1997 Miller
5,692,964 A 12/1997 Smith et al.
5,692,966 A 12/1997 Wash
5,707,296 A 1/1998 Hodgson et al.
5,707,302 A 1/1998 Leon et al.
5,709,610 A 1/1998 Ognjanovic
5,759,110 A 6/1998 Seibel et al.
5,777,244 A 7/1998 Kumagai et al.
5,798,833 A 8/1998 Onuki et al.
5,803,823 A 9/1998 Gobush et al.
5,839,969 A 11/1998 Klouda
5,860,648 A 1/1999 Petermeier et al.
5,879,239 A 3/1999 Macroglou
5,897,441 A 4/1999 Apthorp
5,919,098 A 7/1999 Salmon
5,919,099 A 7/1999 Woods
5,924,934 A 7/1999 Hamilton
5,926,780 A 7/1999 Fox et al.
5,954,592 A 9/1999 Laffer et al.
5,963,013 A 10/1999 Watson et al.
5,993,333 A 11/1999 Heckaman
6,007,436 A 12/1999 Mark
6,036,608 A 3/2000 Morris
6,093,923 A 7/2000 Vock et al.
6,095,928 A 8/2000 Goszyk
6,122,340 A * 9/2000 Darley et al. ..... 377/24.2
6,139,442 A 10/2000 Wilson
6,149,532 A 11/2000 Kim
6,283,610 B1 9/2001 Alajajian
6,302,802 B1 10/2001 Pao
6,371,864 B1 4/2002 Norwood
6,398,662 B1 6/2002 Cox
6,409,609 B1 6/2002 Brezic
6,458,040 B1 10/2002 Veazie, III
6,478,688 B1 11/2002 Fukui
6,482,099 B1 11/2002 Schaum
6,494,455 B1 12/2002 Headrick
6,533,674 B1 3/2003 Gobush
6,569,028 B1 5/2003 Nichols
6,575,597 B1 6/2003 Cramer et al.
6,579,190 B2 6/2003 Yamamoto
6,602,146 B1 8/2003 Pirre
6,612,937 B1 9/2003 Whelan
6,616,543 B1 9/2003 Gobush et al.
6,663,496 B2 12/2003 Cameron et al.
6,672,972 B1 1/2004 Stone
6,699,137 B2 3/2004 Szymanski
6,722,998 B1 4/2004 Mille
6,758,760 B1 7/2004 Kellogg et al.
6,773,356 B2 8/2004 Odom
6,821,211 B2 11/2004 Otten et al.
6,871,414 B2 3/2005 Burney et al.
6,887,162 B2 5/2005 Lindsay
6,902,493 B1 6/2005 Rhodes et al.
6,921,340 B2 7/2005 Dickie
6,939,245 B1 9/2005 Mullarkey
7,036,449 B2 5/2006 Sutter
7,063,747 B2 6/2006 Lastowka
7,066,827 B2 6/2006 Stringer
7,119,838 B2 10/2006 Zanzucchi et al.
7,132,084 B1 11/2006 Roumpos
7,134,966 B1 11/2006 Tice
7,172,366 B1 2/2007 Bishop, Jr.
7,179,856 B2 2/2007 Park et al.
7,213,985 B1 5/2007 Chen
7,291,072 B2 11/2007 Bissonnette et al.
7,297,069 B2 11/2007 Donovan et al.
7,324,663 B2 1/2008 Kiraly
7,384,172 B1 6/2008 Desfosses
7,408,145 B2 8/2008 Holland
7,462,108 B2 12/2008 O'Mahony
7,540,500 B2 6/2009 Kiraly
7,551,766 B2 6/2009 Harris et al.
7,607,999 B2 10/2009 Green
7,648,429 B2 1/2010 Nagasawa
7,662,047 B2 2/2010 Ueshima et al.
7,670,231 B1 3/2010 Greene
7,713,061 B1 5/2010 Albertini
7,714,888 B2 5/2010 Zanzuccchi et al.
7,727,079 B1 6/2010 Kuhlman, Jr.
7,744,480 B2 6/2010 Gobush
7,758,441 B2 7/2010 Rochford et al.
7,766,759 B2 8/2010 Henwood et al.
7,771,776 B2 8/2010 Furze et al.
7,785,215 B2 8/2010 Kohnen, II
7,803,059 B2 9/2010 Zhang
7,808,655 B2 10/2010 Weiss et al.
7,867,102 B2 1/2011 Wallace
7,993,209 B2 8/2011 Kawai
8,008,641 B2 8/2011 Harris et al.
8,052,543 B2 11/2011 Choi

(56) References Cited

U.S. PATENT DOCUMENTS 8,073,234 B2 12/2011 Harris et al.
8,137,210 B2 3/2012 Gobush
8,152,587 B1 4/2012 Brown
8,157,709 B2 4/2012 Wilkinson et al.
8,226,789 B1 7/2012 Glaser
8,291,852 B1 10/2012 Cameron et al.
8,316,506 B1 11/2012 Spalj
8,401,818 B2 3/2013 Sato et al.
8,403,517 B1 3/2013 Cox et al.
8,465,377 B1 6/2013 Kamnikar et al.
8,475,289 B2 7/2013 Bissonnette et al.
8,499,465 B2 8/2013 Kuta
2001/0012389 A1 8/2001 Welchman et al.
2001/0027136 A1 10/2001 Chris
2001/0041622 A1 11/2001 Taylor
2001/0041624 A1 11/2001 Macrglou
2002/0004430 A1 1/2002 Sugimoto
2002/0094877 A1 7/2002 Newby
2002/0103035 A1 8/2002 Lindsay
2002/0115540 A1 8/2002 Kim
2002/0134153 A1 9/2002 Grenlund
2002/0134925 A1 9/2002 Grenlund
2002/0154498 A1 10/2002 Cramer et al.
2002/0173367 A1 11/2002 Gobush et al.
2003/0008731 A1 1/2003 Anderson et al.
2003/0036436 A1 2/2003 Casanova, Jr. et al.
2003/0090660 A1 5/2003 Welchman et al.
2003/0130054 A1 7/2003 Bissonnette et al.
2003/0203762 A1 10/2003 Ross
2003/0221377 A1 12/2003 Crawford et al.
2004/0005934 A1 1/2004 Battaglia
2004/0008520 A1 1/2004 Huang
2004/0036210 A1 2/2004 Oister et al.
2004/0132555 A1 7/2004 Forrest
2004/0137997 A1 7/2004 Rohrer
2004/0147341 A1 7/2004 Huang
2004/0171432 A1 9/2004 Van Zyl et al.
2004/0204256 A1 10/2004 Francisco
2004/0220001 A1 11/2004 Oister et al.
2004/0247170 A1 12/2004 Furze et al.
2004/0258274 A1 12/2004 Brundage et al.
2005/0009617 A1 1/2005 Grossmeyer et al.
2005/0026710 A1 2/2005 Pao
2005/0029431 A1 2/2005 Saegusa
2005/0031416 A1 2/2005 Bishop, Jr.
2005/0054456 A1 3/2005 Gobush
2005/0086844 A1 4/2005 Niester
2005/0090323 A1 4/2005 Kellogg
2005/0096157 A1 5/2005 Huang
2005/0153784 A1 7/2005 Burgin
2005/0159231 A1 7/2005 Gobush
2005/0159237 A1 7/2005 Lu
2005/0200837 A1 9/2005 Mydlack et al.
2005/0202890 A1 9/2005 Otten et al.
2005/0202891 A1 9/2005 Otten et al.
2005/0202892 A1 9/2005 Otten et al.
2005/0202893 A1 9/2005 Otten et al.
2005/0202894 A1 9/2005 Finney et al.
2005/0233817 A1 10/2005 Wiseman
2005/0247892 A1 11/2005 Davis
2005/0268705 A1 12/2005 Gobush
2005/0272514 A1 12/2005 Bissonnette et al.
2006/0012790 A1 1/2006 Furze et al.
2006/0127183 A1 6/2006 Bishop, Jr.
2006/0153427 A1 7/2006 Zanzucchi et al.
2006/0179917 A1 8/2006 Pringle
2006/0185550 A1 8/2006 Zanzucchi et al.
2006/0261938 A1 11/2006 Lai et al.
2006/0270483 A1 11/2006 O'Mahony
2006/0281584 A1 12/2006 Ramsay
2006/0287121 A1 12/2006 Cameron et al.
2007/0060410 A1 3/2007 Gobush
2007/0109421 A1 5/2007 Zanzucchi et al.
2007/0111822 A1 5/2007 Nagasawa
2007/0159807 A1 7/2007 Pereira
2007/0167248 A1 7/2007 Fler et al.
2007/0173349 A1 7/2007 Eng et al.
2007/0196800 A1 8/2007 Douthit et al.
2007/0215499 A1 9/2007 Andre et al.
2007/0251534 A1 11/2007 Raybum
2008/0056621 A1 3/2008 Green
2008/0061236 A1 3/2008 Meredith et al.
2008/0096241 A1 4/2008 Lin et al.
2008/0108454 A1 5/2008 Kohnen
2008/0137062 A1 6/2008 Holton et al.
2008/0153614 A1 6/2008 Marshall
2008/0167136 A1 7/2008 Henwood et al.
2009/0017929 A1 1/2009 Zhang
2009/0040746 A1 2/2009 Shefet et al.
2009/0131203 A1 5/2009 Hebert et al.
2009/0181784 A1 7/2009 Wilson et al.
2009/0197691 A1* 8/2009 Mullen ..... 473/176
2009/0201767 A1 8/2009 Caldwell
2009/0206759 A1 8/2009 Wang et al.
2009/0215548 A1 8/2009 Broering
2009/0233726 A1 9/2009 Thornes
2009/0235593 A1 9/2009 Carroll
2009/0236911 A1 9/2009 Carroll
2009/0305817 A1 12/2009 Cameron
2009/0325722 A1 12/2009 Mier et al.
2010/0001998 A1 1/2010 Mandella et al.
2010/0004068 A1 1/2010 Adame
2010/0076528 A1 3/2010 Zeller
2010/0151957 A1 6/2010 Hohla et al.
2010/0160057 A1 6/2010 Willett
2010/0210377 A1 8/2010 Lock
2010/0248852 A1 9/2010 Lee
2010/0267460 A1 10/2010 Kuhlman, Jr. et al.
2011/0098924 A1 4/2011 Balardeta et al.
2011/0192857 A1 8/2011 Rothbaum et al.
2011/0250981 A1 10/2011 Choi
2011/0279769 A1 11/2011 Rhee et al.
2011/0299729 A1 12/2011 Dawe et al.
2012/0024730 A1 2/2012 Pittman
2012/0040768 A1 2/2012 Allen et al.
2012/0046118 A1 2/2012 Nam
2012/0061049 A1 3/2012 Micucci et al.
2012/0094782 A1 4/2012 Beach et al.
2012/0170058 A1 7/2012 Suk et al.
2012/0174419 A1 7/2012 Kuta
2012/0244969 A1 9/2012 Binder
2012/0270671 A1 10/2012 Ko et al.
2013/0057849 A1 3/2013 Yeh
2013/0113961 A1 5/2013 Ishii et al.
2013/0143684 A1 6/2013 Painter
2013/0210534 A1* 8/2013 Suchanek ..... 473/150

* cited by examiner

ILLUMINATED GOLF

CROSS REFERENCE TO RELATED APPLICATIONS

This application claims the benefit of U.S. Provisional Application No. 61/648,385 filed May 17, 2012 entitled, "Illuminated Golf." The above application is incorporated herein by reference in its entirety.

FIELD OF THE INVENTION

The present invention relates in general to entertainment activities and more particularly to golf.

BACKGROUND OF THE INVENTION

Golf holes are typically characterized by a teeing area and a golf green. A golf green can include a golf cup. Golf cups are typically dug out of soil with a template hole digger and supported by a golf cup apparatus. Golf cup apparatus are typically made of plastic or other rigid material and can include a center aperture for a support of a golf flag. Golf cups can be partially delimited by a golf cup apparatus a surrounding soil in which the golf cup apparatus is supported. A golf flag is typically supported in a center aperture of a golf cup apparatus before a player reaches a green and taken out while a player commences putting. After a player has holed out the golf flag is typically replaced within the center aperture. In a miniature golf course a golf teeing area can be disposed on a golf green. A golf green of a miniature golf course can comprise synthetic material. A golf cup of a miniature golf course can be defined under a rigid platform often formed of plywood or other rigid material. A golf cup apparatus can be disposed under such rigid platform to partially define a cup. Miniature golf course golf greens are sometimes form over concrete. In such embodiments, concrete can be poured about a golf cup apparatus to define a golf cup.

Miniature golf courses are commonly illuminated using a plurality of free standing post mounted spotlights. Some attempts have been made to illuminate non-miniature golf courses including so called "par 3" golf courses as well as regular length and near regular length golf courses. Such attempts have generally included use of free standing post mounted spotlights.

SUMMARY OF THE INVENTION

There is set forth herein one or more feature for providing illuminated golf. The one or more feature can comprise e.g., a golf cup apparatus having a light source bank, a golf flag apparatus having a light source bank, a wearable apparatus having a light source bank, an illumination providing golf ball and an apparatus for charging a golf ball having a light source bank.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

There is set forth herein one or more feature for providing illuminated golf. The one or more feature can comprise e.g., a golf cup apparatus having a light source bank, a golf flag apparatus having a light source bank, a wearable apparatus having a light source bank, an illumination providing golf ball, an illumination providing apparatus for illuminating a golf club, and an apparatus for charging a golf ball having a light source bank.

Various views illustrating features for providing illuminated golf are set forth herein. While the features can operate in combination they can also be provided separately. In one embodiment a system for providing illuminated golf can have only one of the illumination features set forth herein.

Figure 1:
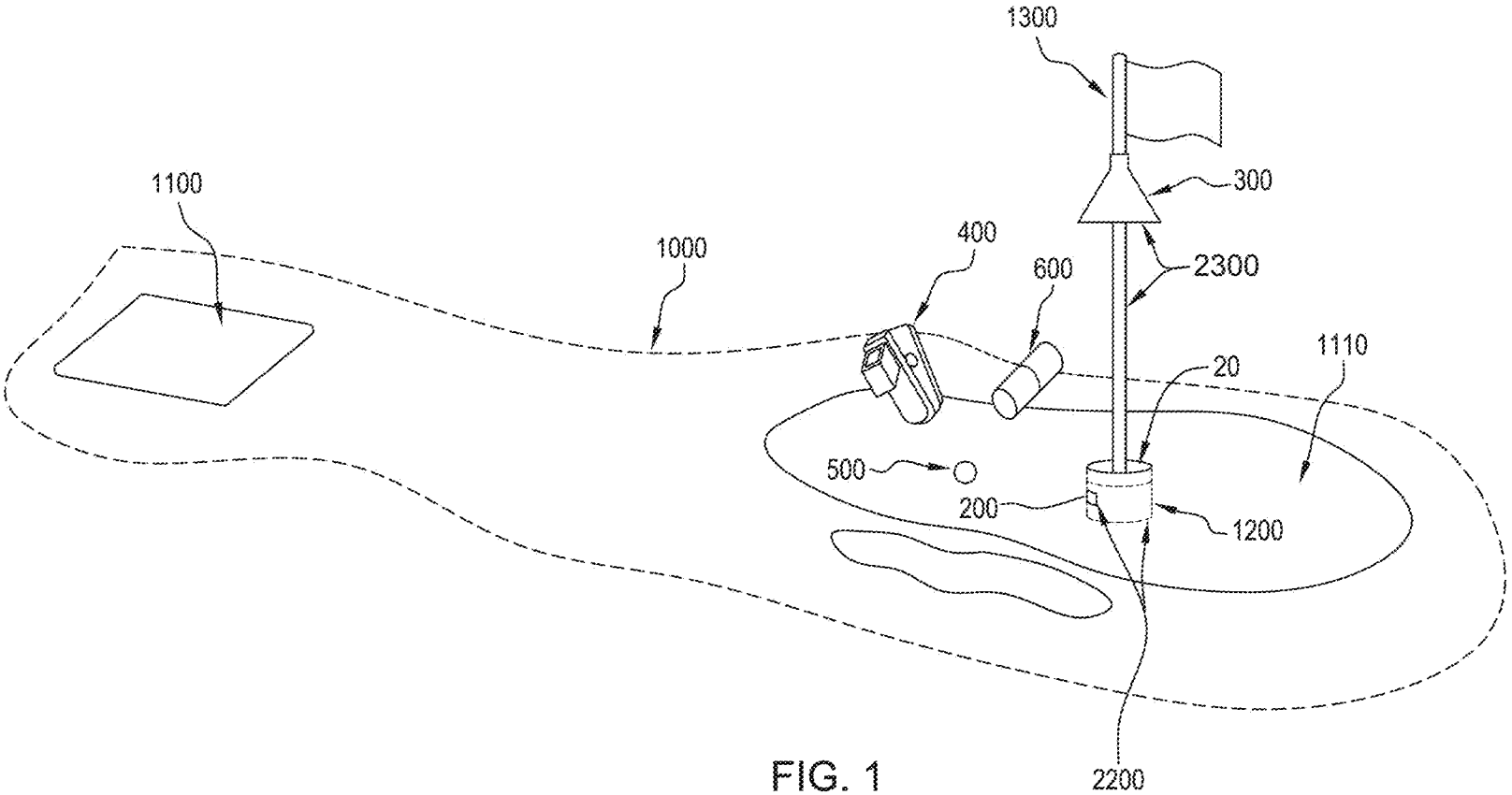
FIG. 1 is a perspective view of an illuminated golf hole.

Referring to FIG. 1 there is shown an illuminated golf hole 1000. Golf hole 1000 can comprise a teeing area 1100, a golf green 1110 having a golf cup 20 partially defined by a golf cup apparatus 1200 and a golf flag apparatus 1300 supported by the golf cup apparatus 1200.

In one embodiment as will be set forth herein, there can be provided a golf cup apparatus 200 that can be associated with golf cup apparatus 1200 to define a larger golf cup apparatus 2200. Golf cup apparatus 200 can include a light source bank 710 comprising one or more light source. A golf cup apparatus 200 can be fixedly associated to a golf cup apparatus 1200 or removeably associated with a golf cup apparatus 1200.

In one embodiment, there can be provided one or more golf flag apparatus 300. A golf flag apparatus 300 can be associated to a golf flag apparatus 1300 to define a larger golf flag apparatus 2300. A golf flag apparatus 300 can include a light source bank 710 comprising one or more light source, the golf flag apparatus 300 being supported on a golf flag apparatus 1300. In one embodiment, golf flag apparatus 300 can include a specialized feature in the form of a shield 320 for support of one or more light source of the light source bank 710. In one embodiment a golf flag apparatus 300 can comprise and define a golf flag stand.

In one embodiment, a feature for providing illuminated golf can comprise a wearable illumination providing apparatus 400 supporting a light source bank. A wearable illumination providing apparatus 400 in one embodiment can comprise a shoe worn apparatus having a light source bank including a light source with a central emission vector directing light generally forwardly of a golfer. A wearable illumination providing apparatus can be alternatively termed a golfer associated apparatus 400.

In one embodiment a feature for providing illuminated golf can comprise a light emitting golf ball 500. A light emitting golf ball 500 can include one or more of one or more light source bank 710 and luminescent material.

In one embodiment a feature for providing illuminated golf can comprise an illumination providing apparatus 550 (FIGS. 25A, 25B) adapted to be disposed on a golf club 1550.

In one embodiment, a feature for providing illuminated golf can comprise a golf ball associated illumination providing apparatus which can be provided by a golf ball charger 600 which can charge photoluminescent material of a golf ball.

In one embodiment a feature for providing illuminated golf can comprise a mobile device 100 of a golfer, e.g., a smart phone appropriately configured. As they can be utilizing in the providing of illuminated golf, apparatus 100, 200, 300, 400, 500, 550, 600 set forth herein can be regarded as illumination providing apparatus.

While features are set forth herein as relating to golf, the features can also be utilized outside of a golf environment. The environment can be a sports environment or a non-sports environment.

Figure 2:
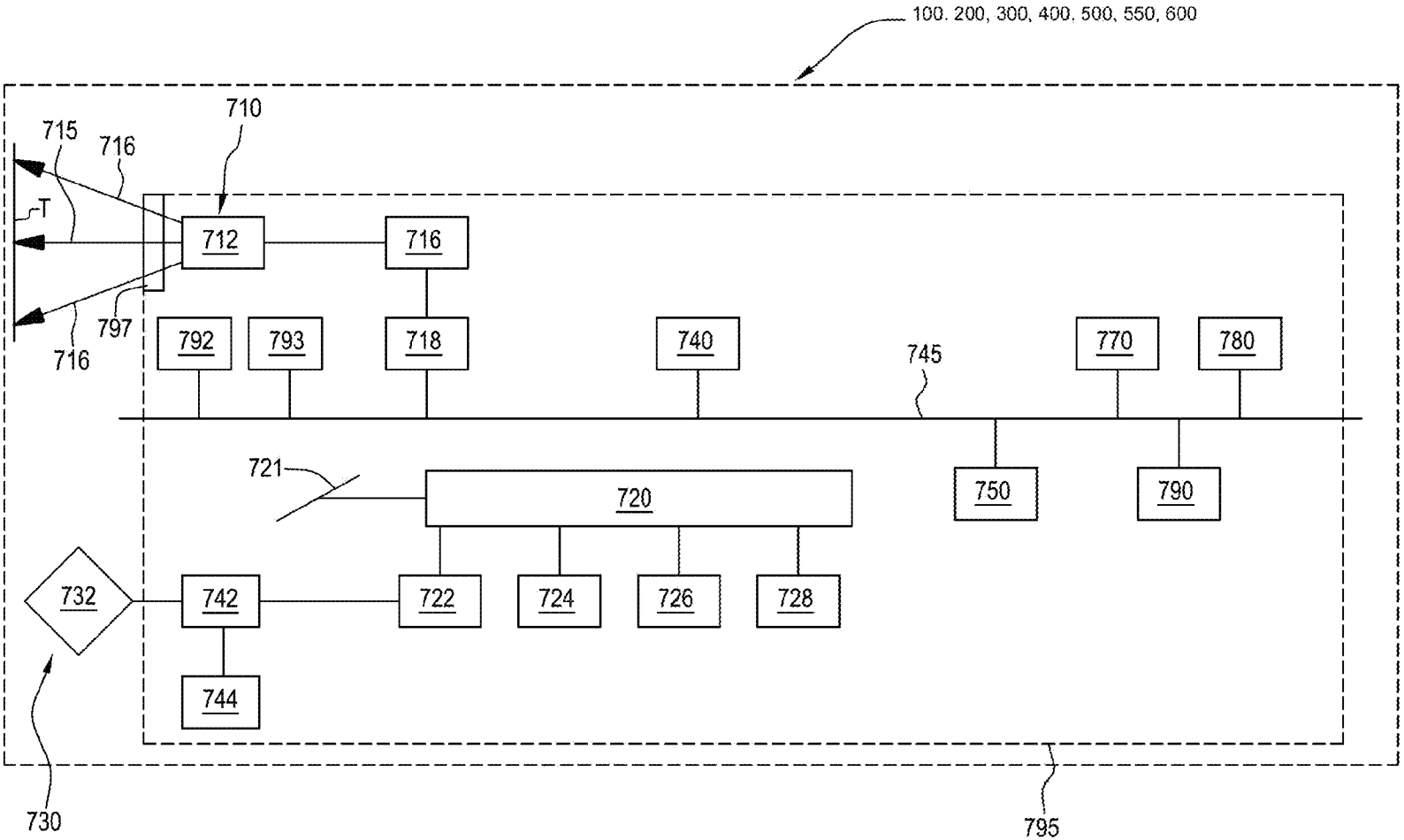
FIG. 2 is a block diagram of an illumination providing apparatus for use in providing illuminated golf.

A block diagram illustrating an illumination providing apparatus 100, 200, 300, 400, 500, 550, 600 is shown in FIG. 2. Illumination providing apparatus 100, 200, 300, 400, 500, 550, 600 can include a light source bank 710 having one or more light source being coupled to a regulator 716. Regulator 716 in turn can be coupled to a power grid 721 which in turn can be coupled a power supply 720. Power supply 720 can be coupled to one or more power source including a rechargeable battery 722, a non-rechargeable battery 724 and an AC/DC transformer 726 and a serial interface 728 (e.g., USB). Rechargeable battery 722 can be coupled to a recharging circuit 742 which can be coupled to a solar panel bank 730 comprising one or more solar panel 732. Recharging circuit 742 can also or alternatively be coupled to a transformer recharging interface 744. The various circuit components of illumination providing apparatus 100, 200, 300, 400, 500, 550, 600 can be coupled to power supply 720 via power grid 721. Illumination providing apparatus 100, 200, 300, 400, 500, 550, 600 can thusly be provided to be self-recharging e.g., with of one or more solar panel.

Illumination providing apparatus 100, 200, 300, 400, 500, 550, 600 can also include a CPU 740 a memory 750 including e.g., a random access memory and a read only memory in communication with CPU 740 via system bus 745. Illumination providing apparatus 100, 200, 300, 400, 500, 550, 600 can also include a first wireless communication interface 770 and a second wireless communication interface 780. Wireless communication interface 770 can support wireless communication over a cellular radio network. Wireless communication interface 780 can be a short range wireless communication interface, e.g., can be a Bluetooth communication interface. Apparatus 100, 200, 300, 400, 500, 550, 600 in one embodiment can support Short Message Service (SMS) communication utilizing wireless communication interface 770. Apparatus 100, 200, 300, 400, 500, 550, 600 can be operative to output a present location of apparatus. Apparatus 100, 200, 300, 400, 500, 550, 600 can include a location determining device e.g., GPS 790 capable of determining location based on location indicating signals received from orbiting satellites. Apparatus 100, 200, 300, 400, 500, 550, 600 can also be capable of receiving location indicating signals indicating a location of apparatus 100, 200, 300, 400, 500, 550, 600 from a network resource of a ground based network in which apparatus 100, 200, 300, 400, 500, 550, 600 participates that determines location of apparatus 100, 200, 300, 400, 500, 550, 600 utilizing triangulation methodologies. Apparatus 100, 200, 300, 400, 500, 550, 600 can be operative to output data indicating its location using one or more a GPS determined location indicating signal and a location indicating signal from a ground based network in which apparatus 100, 200, 300, 400, 500, 550, 600 participates.

Light source bank 710 can be controlled with use of control signals communicated from CPU 740 to regulator 716 via interface 718 connected to system bus 745. Light source bank 710 can comprise one or more light source 712, as set forth in various of the views. A light source 712 can have a cone angle defined by outer boundary light rays 716. A cone angle at a light source 712 can be, e.g., 30 degrees, 45 degrees, 60 degrees. A light source, e.g., light source 712 can have a central emission vector 715 directed centrally with respect to outer boundary light rays 716 defining an illumination cone angle of light source 712. Outer boundary light rays 716 which can define a cone angle of light source 712, can be light rays that delimit points on a target plane, T, at which luminous intensity is half a maximum value, wherein the target plane, T, is normal to central emission vector 715. Light emitted by light source 712 can be emitted symmetrically about central emission vector 715 to define an illumination cone. A light source e.g., light source 712 can have a primary emission vector extending in a direction at which a maximum luminous intensity is defined on target plane, T. CPU based circuitry provided in the various embodiments can be replaced by non-CPU based circuitry, e.g., analog signal processing circuitry. In any embodiment herein a primary emission vector of a light source, e.g., light source 712 can be co-located with a central emission vector 715 of the light source. Likewise a primary emission vector can be co-located with a central emission vector 715 of a light source 712.

In a further aspect of the circuit diagram of FIG. 2 there is shown dashed border indicating a circuit housing 795. Circuit housing 795 can be provided in a single part or multiple parts. Various physical form factors of circuit housing 795 are shown throughout the views. A circuit housing 795 of apparatus 100, 200, 300, 400, 500, 550, 600 can entirely or partially comprise structural members that provide function in addition to housing circuit components. In the view of FIG. 2 apparatus 100, 200, 300, 400, 500, 550, 600 has a single component disposed externally of circuit housing 795, namely solar panel 732. Disposed on circuit housing 795 can be a window 797. In one embodiment window 797 can be a light transmissive window e.g., provided by glass or polycarbonate material. Window 797 can also be provided by an open air window devoid of any material. Illumination providing apparatus 100, 200, 300, 400, 500, 550, 600 can also include a keyboard 792 having one or more key and a display 793, each of which can be accessible from and can define an exterior of circuit housing 795. In one embodiment, display 793 can comprise a touch screen display having virtual keys for input of manually input control. In one embodiment a key of illumination providing apparatus 100, 200, 300, 400, 500, 550, 600 can comprise a key for manually energizing and de-energizing light source bank 710. A keyboard key 792 can be termed a button.

Various embodiments of a cup associated apparatus 200, a flag associated apparatus 300 a golfer associated illumination apparatus 400 and a golf ball associated apparatus 500 are set forth in greater detail herein.

Figure 3:
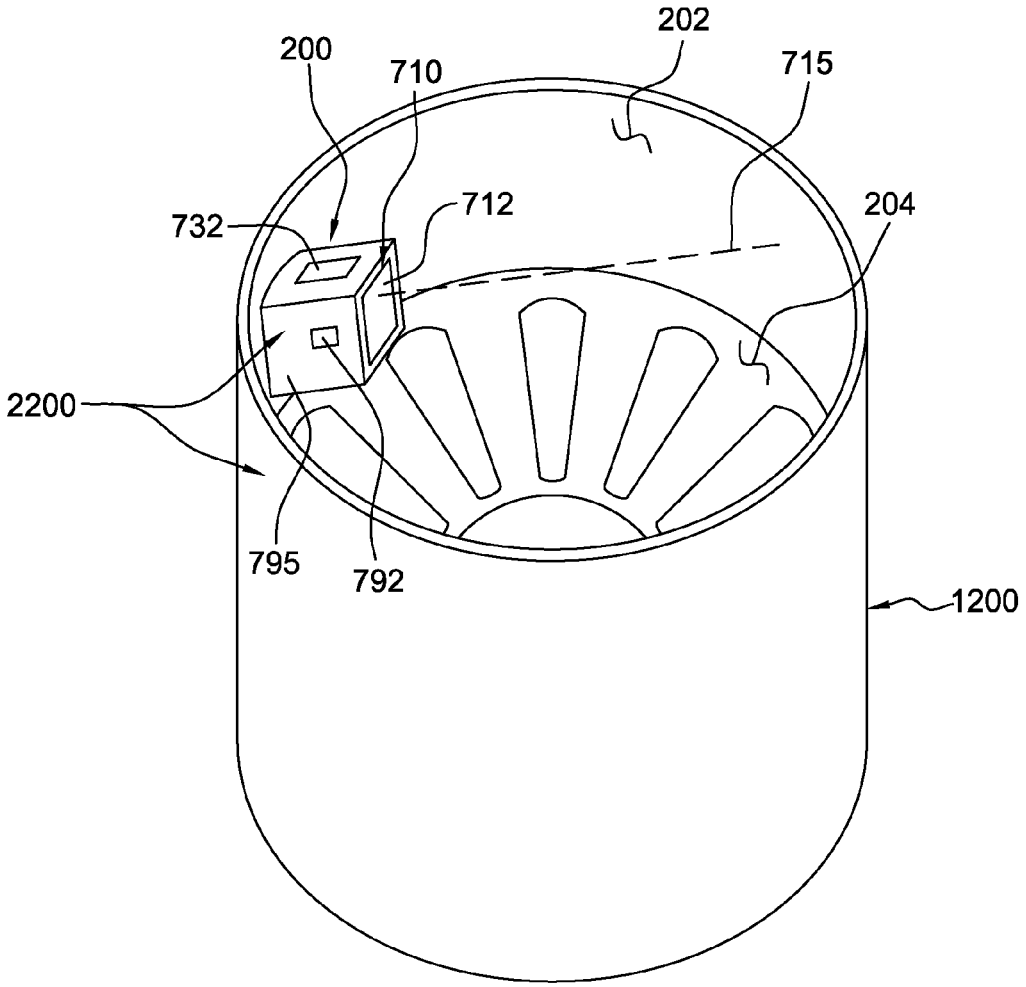
FIG. 3 is a perspective view of a cup associated illumination apparatus.

In FIG. 3 there is shown an exploded view of an exemplary golf cup apparatus 200 in greater detail. Golf cup apparatus 200 in the embodiment of FIG. 3 can include a light source 712 of light source bank 710. Golf cup apparatus 200 can be supported on golf cup apparatus 1200 for illuminating golf cup apparatus 1200 and areas external to cup 20 (FIG. 1). With golf cup apparatus 200 supported on golf cup apparatus 1200 there can be defined a larger golf cup apparatus 2200. In one embodiment a central emission vector 715 of light source 712 can be directed toward an interior wall 202 of golf cup apparatus 1200. In such manner the light source 712 illuminates golf cup apparatus 1200. However direct illumination of a central emission vector 715 toward an eye of player can be avoided. In development of golf cup apparatus 200 it was observed that where central emission vector 715 is directed not to a wall 202 but upwardly and outwardly from golf cup apparatus 1200 such illumination can be distracting and irritating to a player. By directing central emission vector light 715 from light source 712 to an interior wall 202, light is reflected and diffused from wall 202 for presentment of a softly but well illuminated golf cup apparatus 1200. In the embodiment shown in FIG. 3 central emission vector 715 of light source 712 is directed an upward angle relative to a horizontal plane. The upward angle can in one embodiment be more than 10 degrees. The upward angle can in one embodiment be more than 20 degrees. The upward angle can in one embodiment be more than 30 degrees. The upward angle can in one embodiment be more than 40 degrees. The upward angle can in one embodiment be more than 50 degrees. The upward angle can in one embodiment be more than 60 degrees. The upward angle can in one embodiment be more than 70 degrees.

In one embodiment, golf cup apparatus 200 can be irremovably attached to golf cup apparatus 1200. In one embodiment, golf cup apparatus 200 can be removably replaced on golf cup apparatus 1200.

There is set forth herein in one embodiment a golf cup apparatus 2200 comprising an inner peripheral wall 202, a light source bank 710 that illuminates the inner peripheral wall and a central aperture 207 for accommodating a golf flag pole 312 so that the golf flag pole 312 can be removeably held within the central aperture 207. There is set forth herein in one embodiment a golf cup apparatus 2200 wherein the light source bank 710 has a central emission vector 715 that is directed to the inner peripheral wall 202. There is also set forth herein a golf cup apparatus wherein the golf cup apparatus 2200 includes an associated solar panel 732.

In FIG. 3 there is shown an exploded view of a golf cup apparatus 2200 in greater detail. Cup apparatus 2200 in the embodiment of FIG. 3 can include a light source 712 of light source bank 710 mounted on cup apparatus 2200 for illuminating golf cup apparatus 2200. In one embodiment a central emission vector 715 of light source 712 is directed toward an interior wall 202 of cup apparatus 2200. In such manner the light source 712 illuminates cup apparatus 2200. However direct illumination toward an eye of player is avoided. In development of apparatus 200 it was observed that where central emission vector 715 is directed not to a wall 202 but upwardly and outwardly from cup apparatus 2200 such illumination can be distracting and irritating to a player. By directing light from light source 712 to an interior wall 202, light is reflected and diffused from wall 202 for presentment of a softly but well illuminated golf cup apparatus 2200. In the embodiment shown in FIG. 3 central emission vector 715 of light source 712 is directed an upward angle relative to a horizontal plane. The upward angle can in one embodiment be more than 10 degrees. The upward angle can in one embodiment be more than 20 degrees. The upward angle can in one embodiment be more than 30 degrees. The upward angle can in one embodiment be more than 40 degrees. The upward angle can in one embodiment be more than 50 degrees. The upward angle can in one embodiment be more than 60 degrees. The upward angle can in one embodiment be more than 70 degrees. There is set forth herein in one embodiment a golf cup apparatus 2200 comprising an inner peripheral wall 202, a light source bank 710 that illuminates the inner peripheral wall 210 and a central aperture 207 for accommodating a golf flag pole 312 so that the golf flag pole 312 can be removeably held within the central aperture 207. There is set forth herein in one embodiment a golf cup apparatus 2200 wherein the light source bank 710 has a central emission vector 715 that is directed to the inner peripheral wall 202. There is also set forth herein a golf cup apparatus 200 wherein the golf cup apparatus 200 includes an associated solar panel 732. Golf cup apparatus 200 can include a key 792, e.g., a key for energizing and de-energizing light source bank 710.

Figure 4:
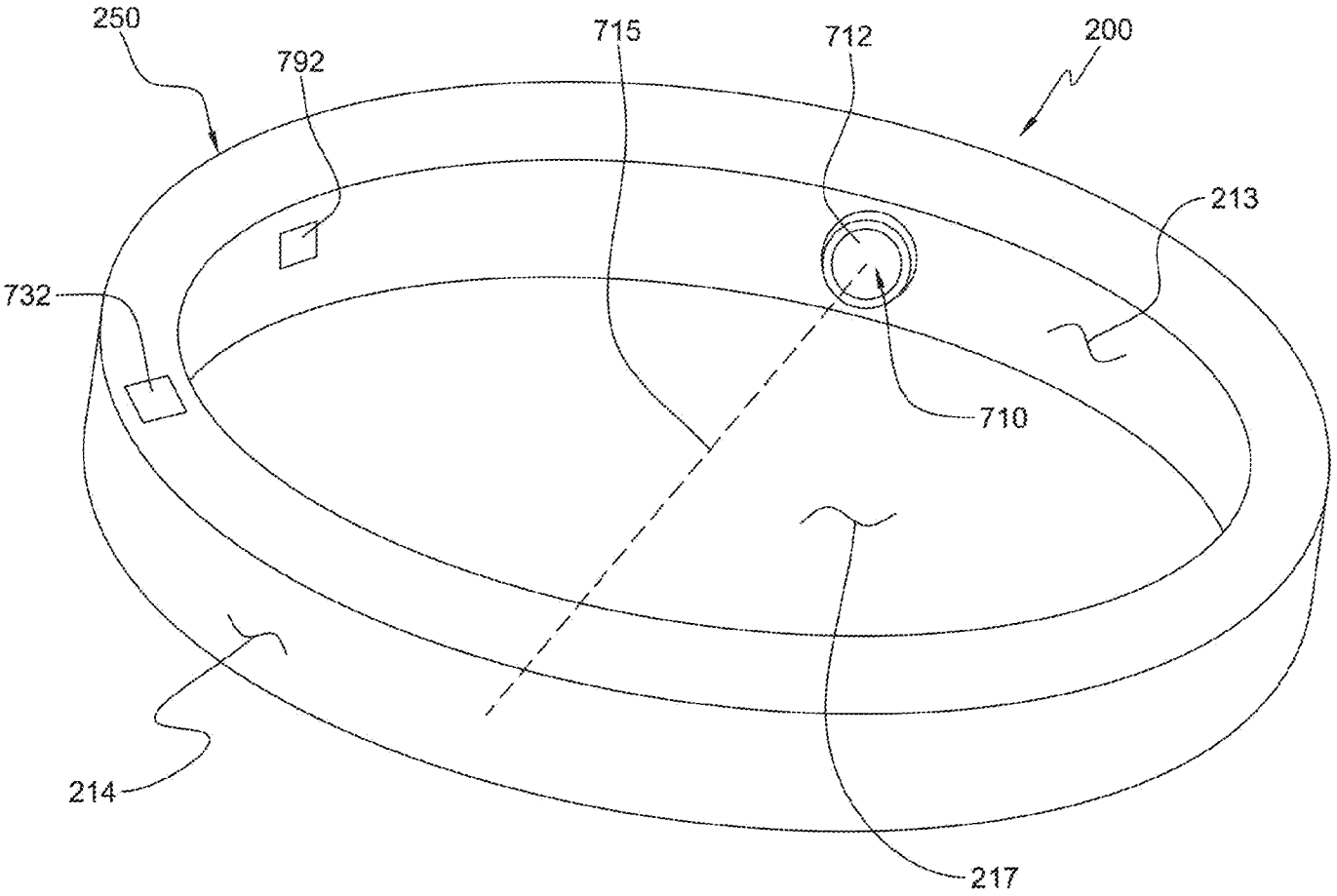
FIG. 4 is a perspective view of a golf cup apparatus.
Figure 5:
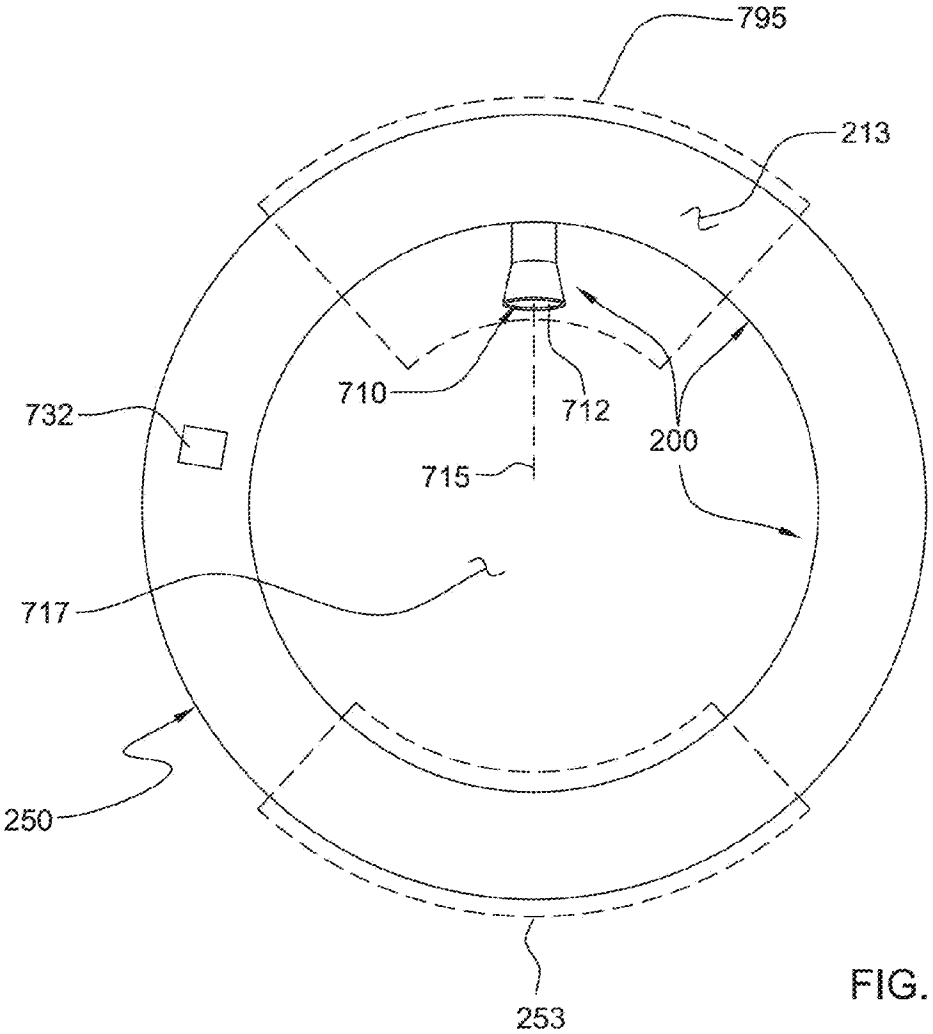
FIG. 5 is a top perspective view of a golf cup apparatus.

Another embodiment of golf cup apparatus 200 is described with reference to FIGS. 4-8. Golf cup apparatus 200 can comprise a ring shaped assembly 250 which can comprise circuit housing 795 that houses circuitry of golf cup apparatus 200. Golf cup apparatus 200 as shown in FIG. 4 can include an assembly 250 supporting light source bank 710. In one embodiment, assembly 250 can be ring shaped, e.g., 360 degree closed perimeter ring shaped, or less than 360 degrees open perimeter ring shaped. For example as shown in FIG. 5, a portion 253 can be removed so that a vertically extending plane extending through central emission vector 715 crosses a ring defined by assembly 250 only in one location. Assembly 250 can have disposed therein a solar panel 732 and a key 792 e.g., a key for energizing and de-energizing a light source bank 710. As indicated by cutout section 253 that may be removed, ring shaped assembly 250 can be a C shaped assembly. With ring shaped assembly 250 being open perimeter in shape, golf cup apparatus 200 can be installed and removed relative to a golf cup apparatus 1200 without removal of a golf flag pole 312. In the embodiment of FIGS. 4-8, golf cup apparatus 20 can be adapted to be removably fittable into an existing golf cup apparatus 1200 of a golf cup 20. Thus referring to FIGS. 6 and 7, golf cup apparatus 200 can be provided in a form without golf cup apparatus 1200, which may be pre-installed on a golf course.

Referring back to FIG. 3 in one embodiment, golf cup apparatus 200 supporting light source bank 710 can be fixedly adhered to golf cup apparatus 1200 including structural members defining golf cup wall 202 and golf cup bottom 204.

However, in the embodiment of FIGS. 4-8, golf cup apparatus 200 can be devoid of golf cup wall 202 and wall bottom 204 and instead is made to be removably fittable into an external structural member, namely golf cup apparatus 1200 defining golf cup wall 202 and golf cup bottom 204. In the embodiment of FIGS. 4-8, golf cup apparatus 200 can be provided in a form so as to be removably fittable into golf cup apparatus 1200 defining an external structural member including golf cup wall 202 and golf cup bottom 204. Golf cup apparatus 1200 can be provided by a source provider other than a source provider providing golf cup apparatus 2200 as shown in FIGS. 4-8.

In one particular embodiment described with reference to FIG. 7, a single source provider can provide both golf cup apparatus 200 removably fittable into a golf cup apparatus 1200 defining wall 202 and bottom 204. In one particular embodiment described with reference to FIG. 7, different source providers can providers can provide golf cup apparatus 200 removably fittable into a golf cup apparatus 1200 defining wall 202 and bottom 204.

Referring now to further details of a ring shaped golf cup apparatus 200, light source bank 710 can be mounted at an interior wall 213 of ring shaped assembly 250. Light source bank 710 can be mounted in such a manner that central emission vector 715 extends to an elevation above a top elevation of ring shaped assembly 250 at a radial location of ring shaped assembly 250 opposite light source bank 710 as best seen in FIG. 7. In such manner a central emission vector 715 of light source bank 710 can be directed to wall 202 of golf cup apparatus 1200. Where ring shaped assembly 250 is devoid of material opposite a location of light source bank 710 the assembly 250 will have defined an infinitely low top elevation at a radial location opposite the light source bank 710 and accordingly central emission vector 715 will be directed to wall 202 and will extend to an elevation above a top elevation of ring shaped assembly 250 at a radial location of ring shaped assembly 250 opposite light source bank 710.

Figure 6:
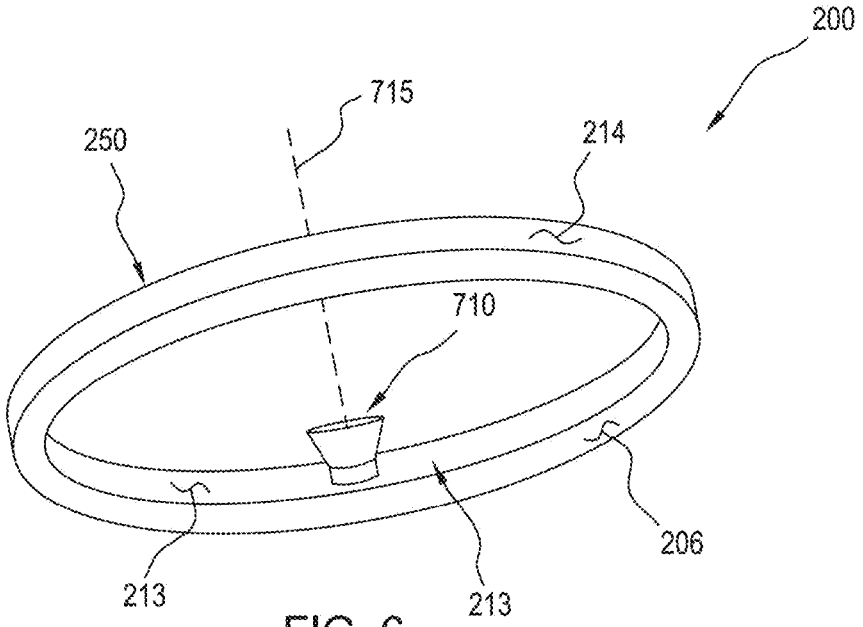
FIG. 6 is a top perspective view of a golf cup apparatus.

In the embodiment shown in FIG. 6 golf cup apparatus 200 can be configured so that central emission vector 715 of a light source 712 of light source bank 710 is directed at an upward angle relative to a horizontal plane when golf cup apparatus 200 is installed in golf cup apparatus 1200. For achieving such functionality, ring shaped assembly 250 can be generally ring shaped and it can include a horizontally extending planar bottom 206, and/or outer peripheral wall 214 that conforms to a shape of an interior wall 202 of a golf cup apparatus 1200 that partially defines golf cup 20. Alternative featurizations can be employed for achieving the functionality. The upward angle can in one embodiment be more than 10 degrees relative to a horizontal plane. The upward angle can in one embodiment be more than 20 degrees. The upward angle can in one embodiment be more than 30 degrees. The upward angle can in one embodiment be more than 40 degrees. The upward angle can in one embodiment be more than 50 degrees. The upward angle can in one embodiment be more than 60 degrees. The upward angle can in one embodiment be more than 70 degrees. Ring shaped assembly 250 can include interior wall 213 supporting light source bank 710. FIG. 7 shows a ring shaped golf cup apparatus 200 in a state supported within a golf cup apparatus 1200 defining golf cup wall 202 and golf cup bottom 204. Ring shaped assembly 250 can include an outer diameter corresponding to, but slightly smaller than an inner diameter eliminating by golf cup interior wall 202. Referring to further aspects of FIG. 7, line 208 and line 209 illustrate top and bottom elevation of ring shaped assembly 250, can serve as a housing for housing circuit components as described in connection with FIG. 2 and accordingly ring shaped assembly 250 is labeled in duplicate with the reference numeral 795. Referring still to FIG. 7, a structural member defining golf cup wall 202 can have a known diameter namely, the standard golf cup diameter 4.25 inches or a radius of 2.125 inches. So as to be fittable within a member defining golf cup wall 202, golf cup apparatus 2200, as shown in FIGS. 4-8 can be provided to have a diameter and radius corresponding to that of a golf cup wall, but slightly less than a golf cup wall. Accordingly, in one embodiment, ring shaped assembly 250 can define an outer radius of between about 2.0 inches and less than 2.125 inches. In one embodiment the assembly 250 can define an outer radius of less than 2.125 inches. There is set forth herein an apparatus 200 having an outer peripheral wall 214 including a shape corresponding to an inner wall 202 of a golf cup 20.

In another aspect as shown in FIG. 6, outer wall 214 of ring shaped assembly 250 can be shaped in a manner in order to facilitate a guiding of golf cup apparatus 200 within inner wall 202 of golf cup apparatus 1200. In one embodiment, golf cup apparatus 200 can be shaped to facilitate a fitting of golf cup apparatus 200 within a golf cup apparatus 1200 defining wall 202 and bottom 204 so that apparatus 200 can be fitted in a position wherein it rests generally horizontally within golf cup apparatus 2200 within a structural member defining wall 202 and bottom 204.

Figure 7:
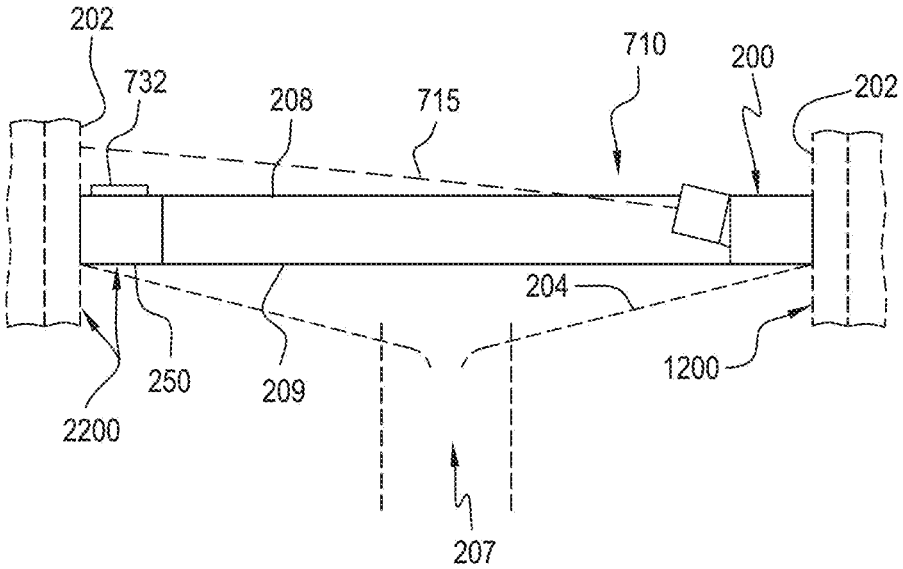
FIG. 7 is a cross sectional side elevation installation view of a cup associated illumination apparatus installed in a golf cup apparatus structural member defining a cup wall and bottom.

In another aspect, ring shaped assembly 250 can support solar panel 732 as shown in FIG. 7. Importantly, ring shaped assembly 250 is devoid of a structural member at a center of ring shaped assembly 250. In other words, ring shaped assembly 250 having a curved outer wall can define a center void 217. Accordingly, the fitting of golf cup apparatus 2200 into a structural member defining wall 202 does not interfere with the insertion and removal of a golf pole 312 within center void 217 during the course of playing golf.

Figure 8:
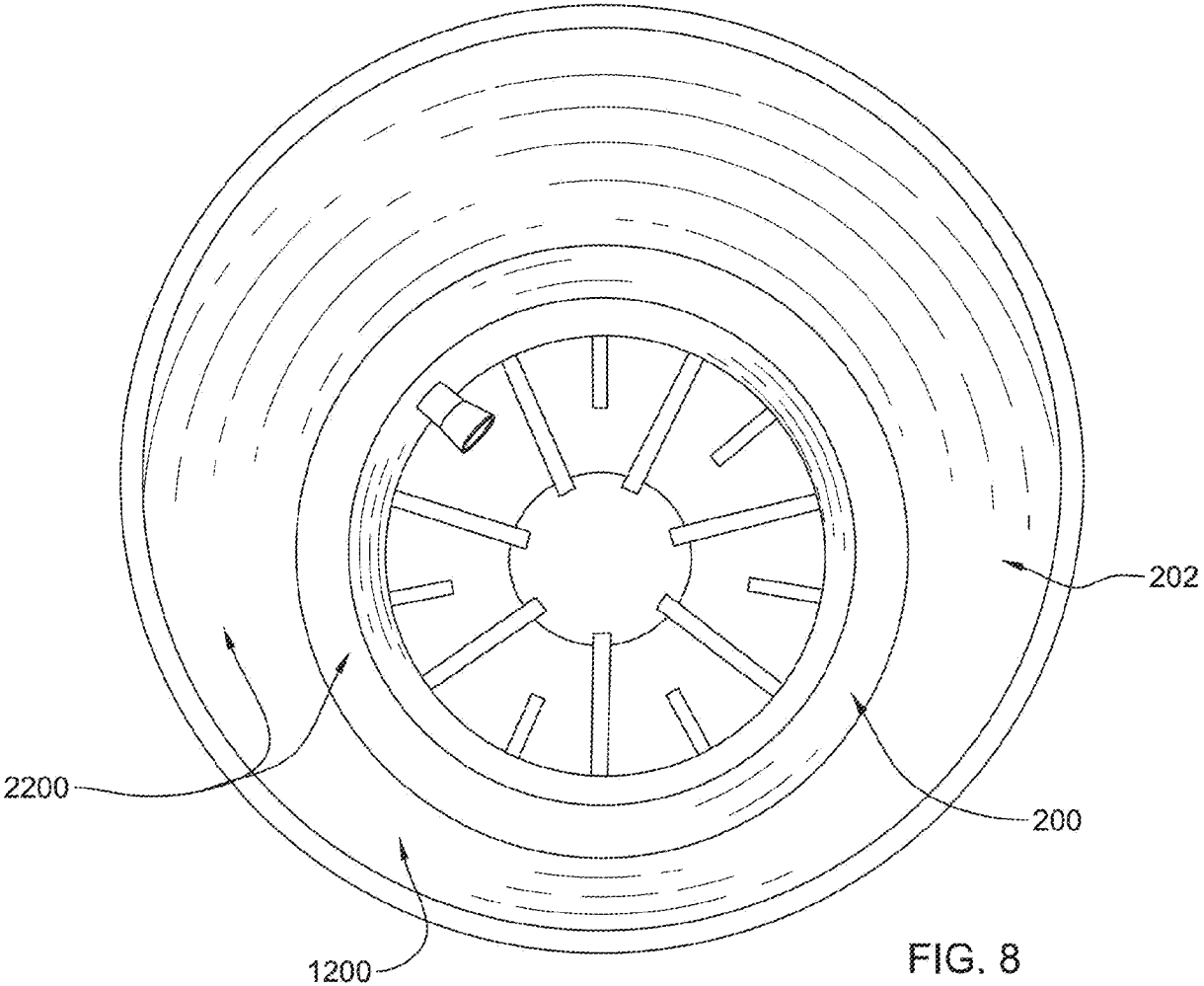
FIG. 8 is a top perspective installation view showing a cup associated illumination apparatus installed in a structural member having a cup wall and bottom.

FIG. 4 shows a respective view of a removable golf cup apparatus 2200 having a ring shaped assembly 250. FIG. 5 is a top perspective view of a removable golf cup apparatus 2200 having a ring shaped assembly 250 and a light source bank 710, including the central emission vector 715. FIG. 6 is a bottom perspective view of a golf cup apparatus 2200 having a ring shaped assembly 250. FIG. 7 is a side cross sectional view of a golf cup apparatus 2200 shown disposed within a structural member defining a golf cup wall 202 and bottom 204 and an orientation of apparatus 200 within such structural member so that central emission vector 715 extends to an elevation above an elevation of ring shaped assembly 250 at a position opposite a position at which light source bank 710 is positioned so that wall 202 can be illuminated. FIG. 8 is a top perspective view of a ring shaped golf cup apparatus shown disposed in a structural member defining golf cup wall 202 and golf cup bottom 204.

In the embodiment of FIGS. 4-8, ring shaped golf cup apparatus 2200, having ring shaped assembly 250 is shown as an apparatus having a 360 degree i.e., full circle ring shaped assembly 250. However, in it should be highlighted that ring shaped assembly 250 need not extend 360 degrees. In another embodiment, ring shaped base extends 270 degrees. In another embodiment ring shaped base extends 180 degrees. In another embodiment, ring shaped base extends 120 degrees. In another embodiment, ring shaped base extends 90 degrees. Advantages described herein attributable to ring shaped assembly 250 being ring shaped can be yielded without extending a periphery of ring shaped assembly 250 a full 360 degrees.

There is set forth herein an apparatus having an outer peripheral wall 214 including a shape corresponding to a shape of a golf cup apparatus 1200, and a light source bank 710 supported by the assembly 250 for illuminating an inner peripheral wall 202 of the golf cup apparatus 1200. There is also set forth herein an apparatus, wherein the light source bank 710 is supported by the assembly 250. There is also set forth an apparatus, wherein the assembly 250 defines a void 217 to allow entry and removal of a golf flag pole 312. There is also set forth an apparatus 202, wherein the apparatus 202 is adapted to be replaceably removable from a golf cup apparatus 1200. There is also set forth herein an apparatus wherein the light source bank 710 has a central emission vector 715 arranged in a manner so that when the golf cup apparatus 200 is disposed in an apparatus 1200 having a golf cup wall 202 a central emission vector of light source of light source bank 710 is directed to a wall 202 of the golf cup apparatus 1200.

There is also set forth herein a method for illuminating an area about a golf cup 20, the method comprising providing an apparatus having an assembly 250 that supports a light source bank 710; and disposing the apparatus 200 in a golf cup apparatus 1200 in a manner that light emitted from the light source bank 710 is directed toward an interior wall 202 of the golf cup apparatus 1200. There is also set forth herein a method, wherein the providing includes providing an assembly 250 having an outer peripheral wall 214 that corresponds to a shape of an interior wall 202 of a golf cup apparatus 1200, and wherein the disposing includes locating the outer peripheral wall 214 on an interior wall 202 of the golf cup apparatus 1200.

Figure 9:
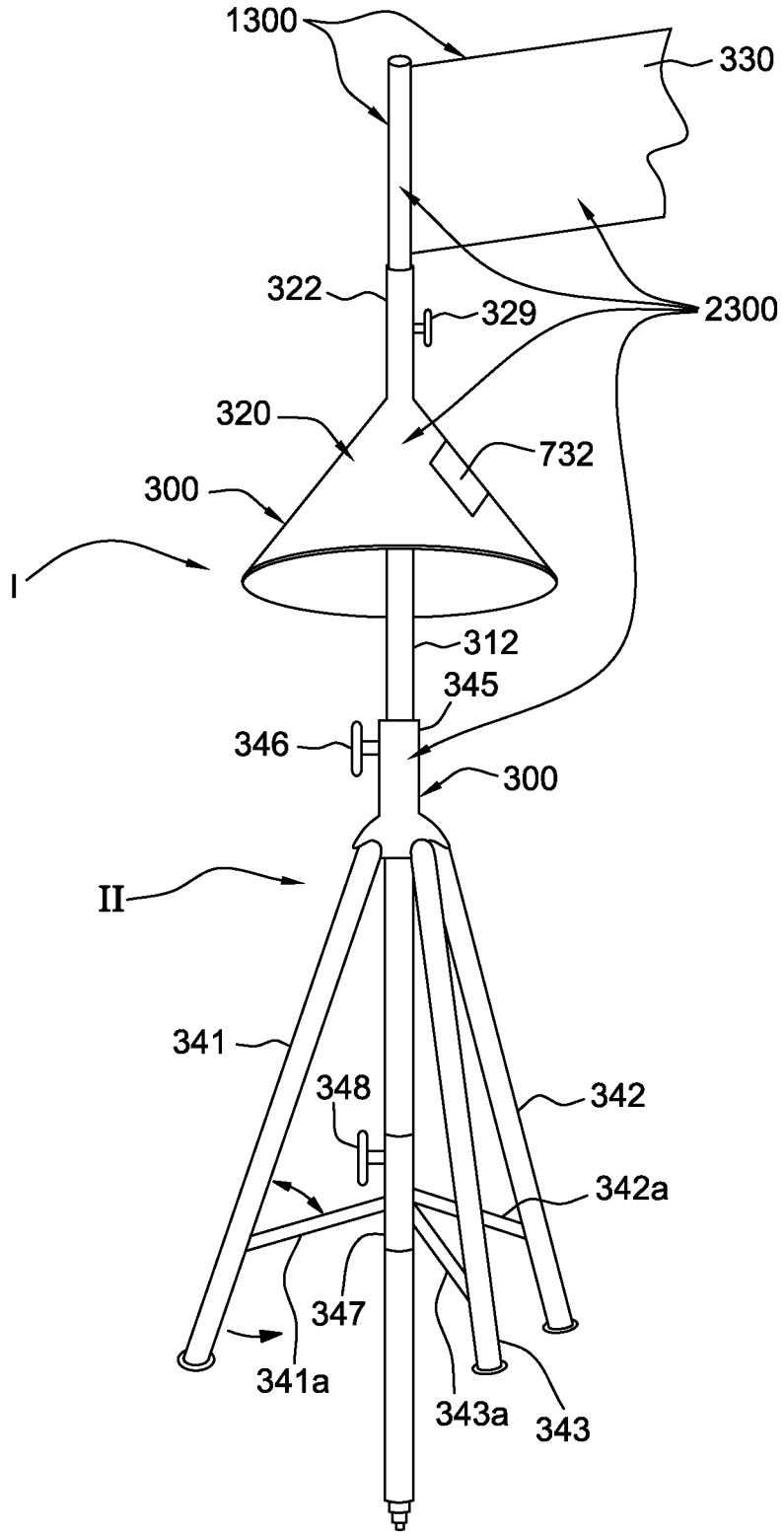
FIG. 9 is a schematic view of a golf flag apparatus having a plurality of illumination providing apparatus including a shield assembly and a stand.

In FIG. 9 there is shown a view of illumination providing apparatus in the form of a golf flag apparatus 300. In the embodiment of FIG. 9 there is shown an upper golf flag apparatus 300 having shield 320 and lower golf flag apparatus 300 having a leg 341 for standing of a golf flag pole 312. There is also shown a golf flag apparatus 1300 comprising a golf flag pole 312 and a flag 330. With one or more of apparatus 300 at location I having shield 320 and apparatus 300 at location II having leg 341 associated to golf flag apparatus 1300 there can be defined a larger golf flag apparatus 2300 having the combination of golf flag apparatus 1300 and one of more of apparatus 300 having shield 320 and apparatus 300 having leg 341.

As shown in FIG. 9, a golf flag apparatus 2300 can include a flag pole 312, a golf flag apparatus 300 having shield 320 and a flag 330. In one embodiment set forth herein a golf flag apparatus 300 can comprise just a shield 320 including light source bank 710 and associated circuitry. In another embodiment, a golf flag apparatus 2300 can comprise a combination of a pole 312, a flag apparatus 300 having shield 320 and apparatus 300 having leg 341, the shield 320 including light source bank 710 and associated circuitry. Shield 320 can be provided in a form without light source bank 710. A first embodiment of a golf flag apparatus 300 adapted to stand a golf flag pole 312 is shown in FIG. 9.

Figure 10:
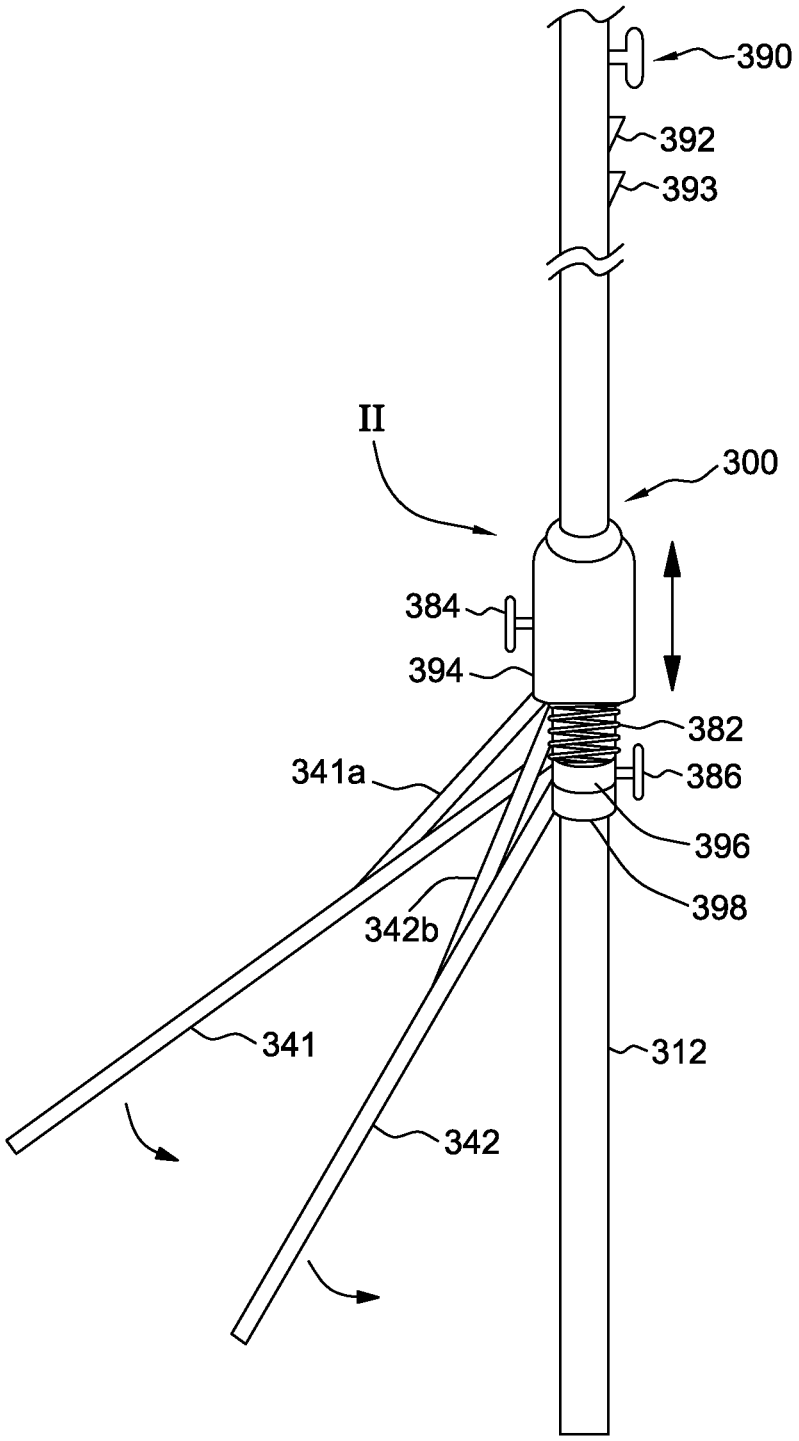
FIG. 10 is a perspective view of flag associated illumination provided by a stand.

Another embodiment of a golf flag apparatus 300 defining a stand and being adapted to stand a golf flag pole 312 is shown in FIG. 10, location II.

Figure 11:
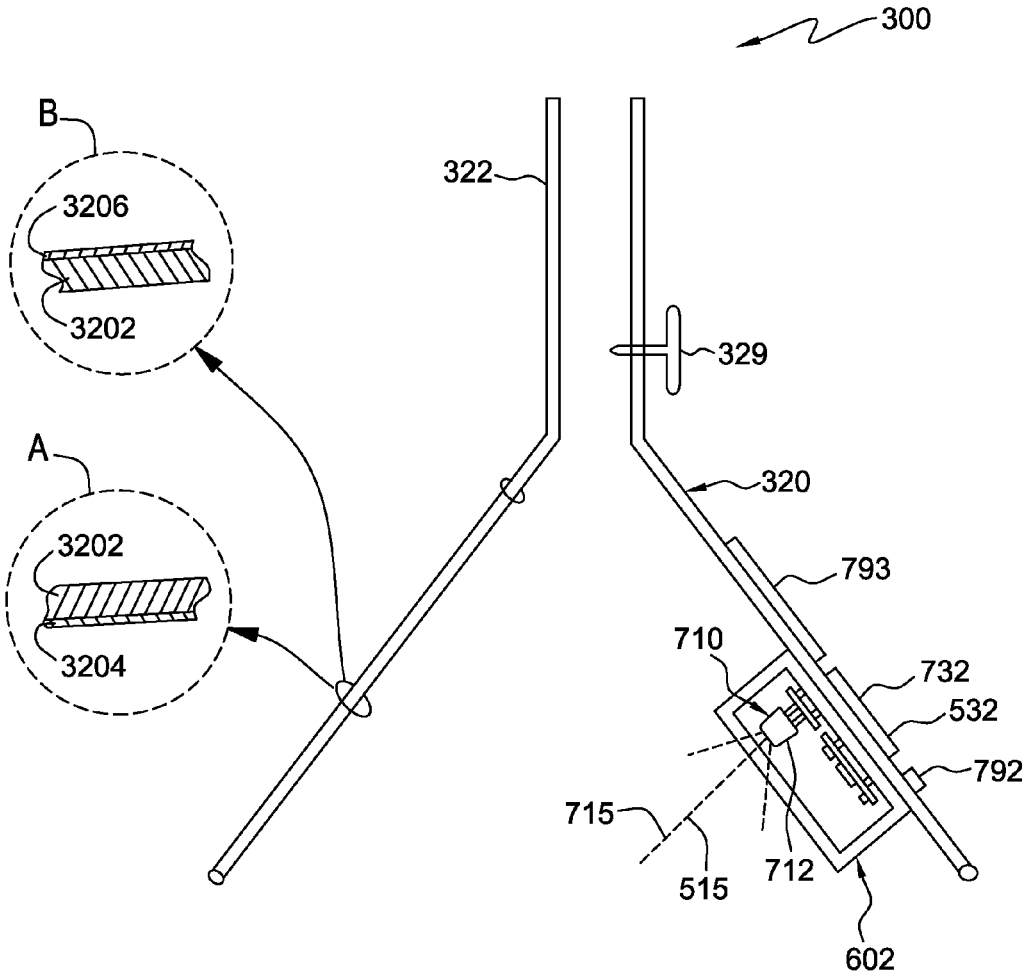
FIG. 11 is a cross sectional side schematic view of a golf flag shield.

Referring to FIG. 11, a specific embodiment of golf flag apparatus 300 having shield 320 is described. Referring to the embodiment of FIG. 11, shield 320 can comprise one or more light source 712 providing light source bank 710 (FIG. 2). Light source 712 can be disposed on shield 320 and can be supported by shield 320. Shield 320 can also include solar panel 732 mounted at an exterior of shield 320. An interior of shield 320 can be made light reflective for increasing an amount of light energy reflected from shield 320 onto a golf hole 1000. Light emitted by light source bank 710 can be directed toward a ground, but in another aspect can be directed in all directions. Shield 320 can include a key 792 for energizing and de-energizing light source bank 710 making an interior surface of shield 320 reflective can increase an amount of light directed to an area being traversed by a player. For making an interior of shield 320 reflective, shield 320 can be molded of a reflective injection molding material. In such embodiment, shield 320 can be of single layer construction. In another embodiment, shield 320 can be of multilayer construction with a first layer being molded from a mold and a second reflective one or more layer layered thereon. e.g., by depositing, spraying dipping or brush coating. In one embodiment, as described with reference to exploded cross sectional view A of FIG. 11 a first body portion 3202 of shield 320 can be opaque and a reflective layer 3204 disposed internally to portion 3202 can formed on an interior surface of the first body portion 3202. In one embodiment as described in connection with the exploded cross sectional view B of FIG. 11, a first body portion 3202 of shield 320 can be light transmissive and an externally disposed layer 3206 surface of shield 320 can be metalized (subject to a silvering process) to define an interiorly directed mirror. In such embodiment, shield 320 can be formed of a light transmissive injection molding material or else can be glass formed in a generally conical, e.g., conical or frustroconical form and then the exterior surface subject to silvering to provide a shield 320 having a light reflective interior. Referring further to the embodiment of FIG. 11, cross sectional view of a cross section of shield 320 is shown. According to blowup A, shield 320 can include a first body layer 3202 and a second interiorly disposed body layer 3204. Second layer 3204 can include e.g., metallic paint or another coating to increase the reflectivity of an inner surface of shield 320. In the blow up alternative embodiment shown in blown up area B of FIG. 11, shield 320 can include first body layer 3202 comprising e.g., glass or polymeric material and second outer layer 3206 disposed externally relative to layer 3202. Outer layer 3206 can include a mirror coating provided by a silvering process so that the interior of shield 320 defines a mirrored interior.

In another aspect shown in the embodiment of FIG. 11, shield 320 can include one or more wall 330 defining an interior 332 and an exterior 334 of shield 320. In one embodiment as set forth with reference to FIGS. 11 and 13 and 14 herein, a shield 320 can be generally conical in shape with a narrowing perimeter from bottom to top. In another embodiment the shield 320 can be generally pyramidal with a narrowing perimeter from bottom to top. There is also set forth herein an apparatus wherein the shield 320 defines a narrowing perimeter from bottom to top. As shown in FIG. 11, shield 320 can have disposed thereon a display 793. In one embodiment, shield 320 can be configured so that display 793 displays a yardage of a golfer to a golf green 1100. For example, a mobile device 100 provided by a smart phone carried by a golfer can comprise a GPS based golf yardage calculation application that calculates a yardage to a golf green. The mobile device 100 can be operative to transmit determined yardage to illumination providing apparatus 300 having shield 320 to display the determined yardage on display 793.

In one embodiment shield 320 can be adapted to prevent precipitation from entering an interior of shield 320. In such manner circuit components of golf flag apparatus 300 are protected from being damaged from precipitation. For example sleeve 322 as shown in FIG. 11 can be adapted to snugly fit about a pole 312. As shield 320 can be aligned directly over a cup apparatus 1200 when pole 312 is held on golf cup apparatus 1200, shield 320 can also restrict precipitation from reaching circuitry of golf cup apparatus 200 thereby aiding the proper functioning of golf flag apparatus 300 having shield 320 as well as golf cup apparatus 200. Shield 320 can be conical or frustroconical in shape as shown in one embodiment can be provided by a commercially available off the shelf lamp shade.

Figure 12:
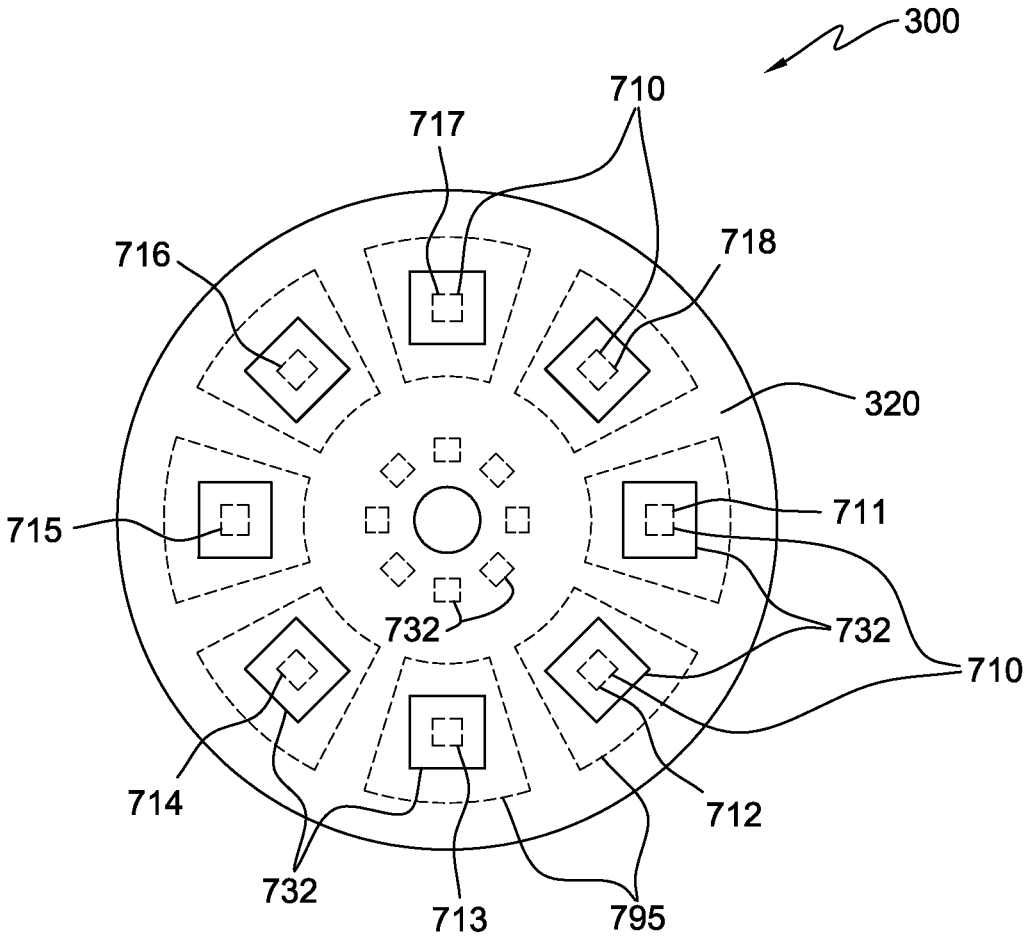
FIG. 12 is a top schematic view of golf flag apparatus shield.
Figure 13:
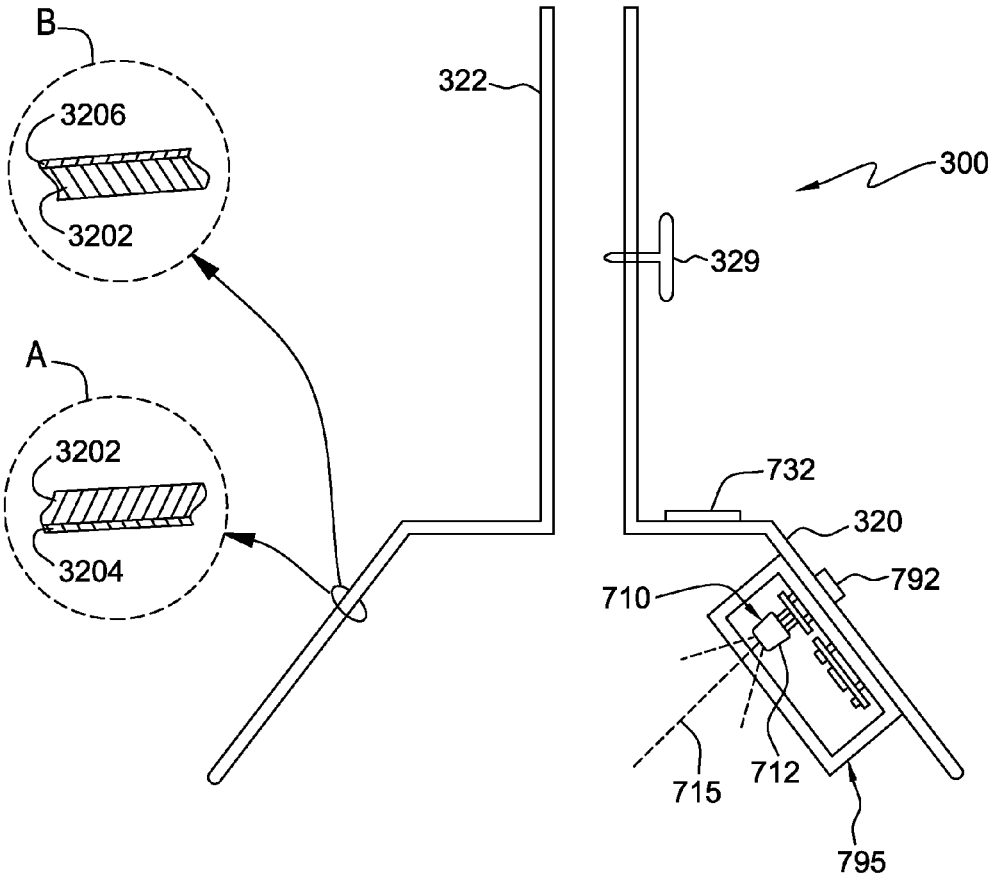
FIG. 13 is a side schematic view of a golf flag apparatus shield.

In one embodiment, several light sources forming light source bank 710 can be disposed rotationally about shield 320 at radially spaced positions. FIG. 12 shows a schematic top view of the shield 320 as shown in FIG. 11. As indicated by dashed in light sources 711-718, light source bank 710 can include a plurality of light sources disposed internally of shield 720. Also as seen by the embodiment of FIG. 13 a plurality of solar panels 732 can be disposed on an outer surface of shield 320 distributed rotationally about an outer surface of shield 320. A circuit housing 795, as shown in FIG. 11, can include a plurality of sections distributed rotationally about interior of shield 320 as shown in the top view of FIG. 12. Solar panel 732 similarly can have a plurality of instances disposed rotationally about an exterior of shield 320. Similarly light source bank 710 can comprise a plurality of light sources 711-718 distributed rotationally at spaced apart positions about an interior of shield 320, as shown in the top view of FIG. 12. The elements as shown in FIG. 13 can also be distributed rotationally about shield 732 in such an embodiment solar panels 732 can be distributed in the positions shown by dashed in solar panels 732 as shown in FIG. 12.

Referring to the embodiment of FIG. 13, shield 320 as shown in FIG. 12 is similar to the embodiment of FIG. 10 except that a configuration of shield 320 is changed so that shield 320 includes a flattened top section 323 as shown. Flattened top section 323 can extend horizontally. Solar panel 732 can be disposed on a flattened top section of shield 320. Referring to the top view of FIG. 12, solar panels can be distributed rotationally at spaced apart radial positions of flattened top section 323.

Referring to shield 320 as shown in the view of FIGS. 9, 11, 12 and 13 shield 320 can include an associated wing screw 329 for fixing and adjusting a vertical position of shield 320 on flag pole 312. Golf flag apparatus 300 having shield 320 can be adapted so that wing screw 329 can be manually actuated.

Figure 14:
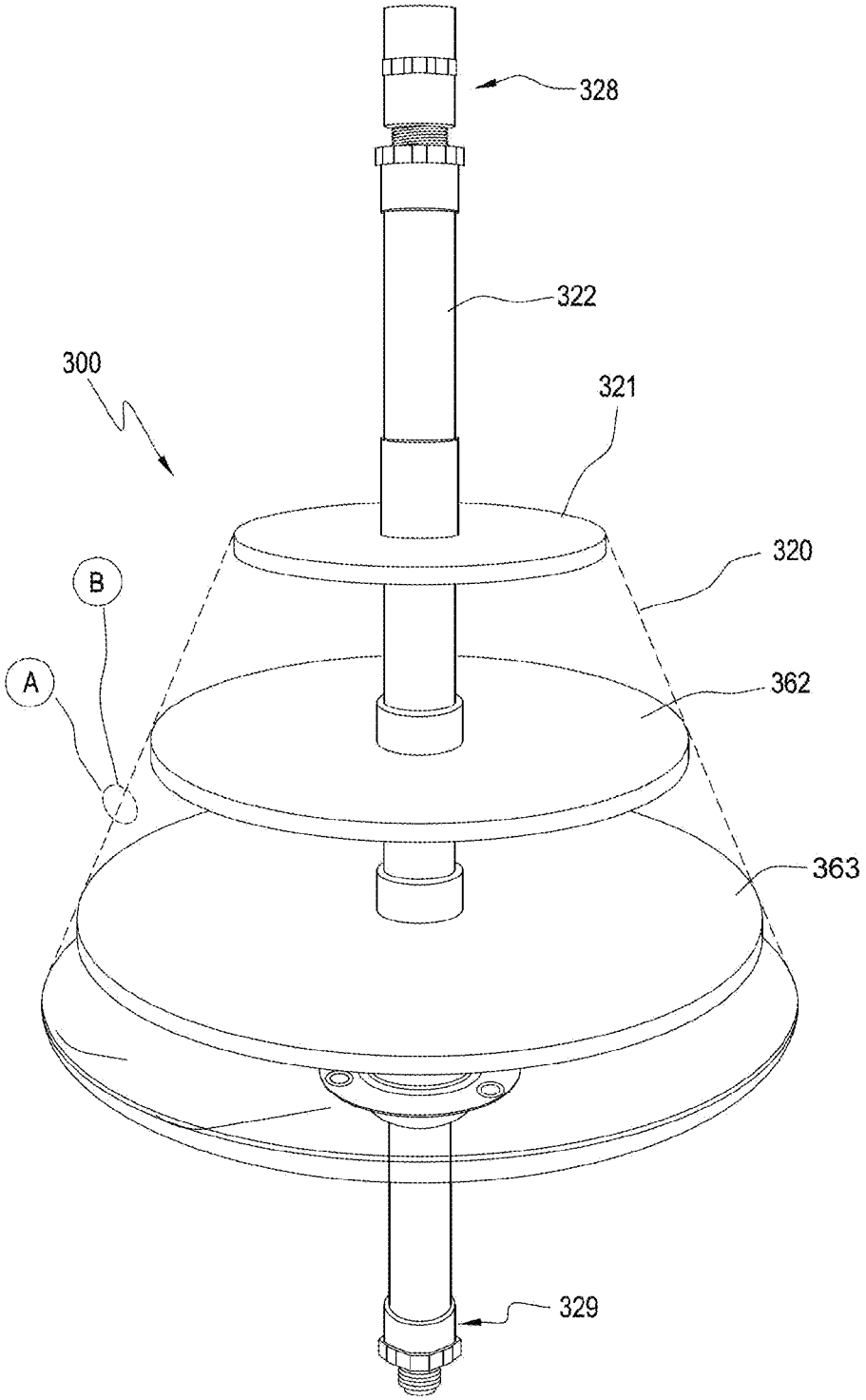
FIG. 14 is a perspective view of a golf flag apparatus provided by a shield.

A further embodiment of shield 320 is shown in FIG. 14. In the embodiment of FIG. 14, shield 320 can include first platform 361 defining flattened top 323 on which one or more solar panel 732 can be distributed, second platform 362 for supporting batteries and other circuit components and third platform 363 for supporting light sources of light source bank 710 and other circuit components as well as lens 370 for magnifying or otherwise shaping light emanating from light source bank 710. Shield 320 can have cross sectional characteristics as indicated by the cross sections A or B as shown by the embodiments of FIGS. 11 and 13. Shield 320 can include crimping locks 328 and 329 for fixing a vertical position of shield 320. In the various embodiments set forth herein, shield 320 can include sleeve 322 for use in fixing a vertical position of shield 320 on a flag pole 312. As shown by the embodiment of FIG. 14, sleeve 322 can extend downward to an elevation within an interior of shield 320. In the particular embodiment of FIG. 14, sleeve 322 extends downward to an elevation lower than an elevation of shield 320. By extending the downward extent of sleeve 320 stabilization of sleeve 322 on pole 312 can be improved. The embodiments of apparatus 300 as shown in FIGS. 11 and 13 can be modified to include an extended sleeve 322 as shown in FIG. 14. In the embodiment of FIG. 14, shield 320 can include first platform 361 defining flattened top 323 on which one or more solar panel 732 can be distributed, second platform 362 for supporting batteries and other circuit components and third platform 363 for supporting light sources of light source bank 710 and other circuit components as well as lens 370 for magnifying or otherwise shaping light emanating from light source bank 710. Shield 320 can have cross sectional characteristics as indicated by the cross sections A or B as shown by the embodiments of FIGS. 11 and 13. Shield 320 can include crimping locks 328 and 329 for fixing a vertical position of shield 320. In the various embodiments set forth herein, shield 320 can include sleeve 322 for use in fixing a vertical position of shield 320 on a flag pole 312. As shown by the embodiment of FIG. 14, sleeve 322 can extend downward to an elevation within an interior of shield 320. In the particular embodiment of FIG. 14, sleeve 322 extends downward to an elevation lower than an elevation of sleeve 320. By extending the downward extent of sleeve 320 stabilization of sleeve 320 on pole 312 can be improved. The embodiments of apparatus 300 as shown in FIGS. 11 and 13 can be modified to include an extended sleeve 322 as shown in FIG. 14.

Figure 15:
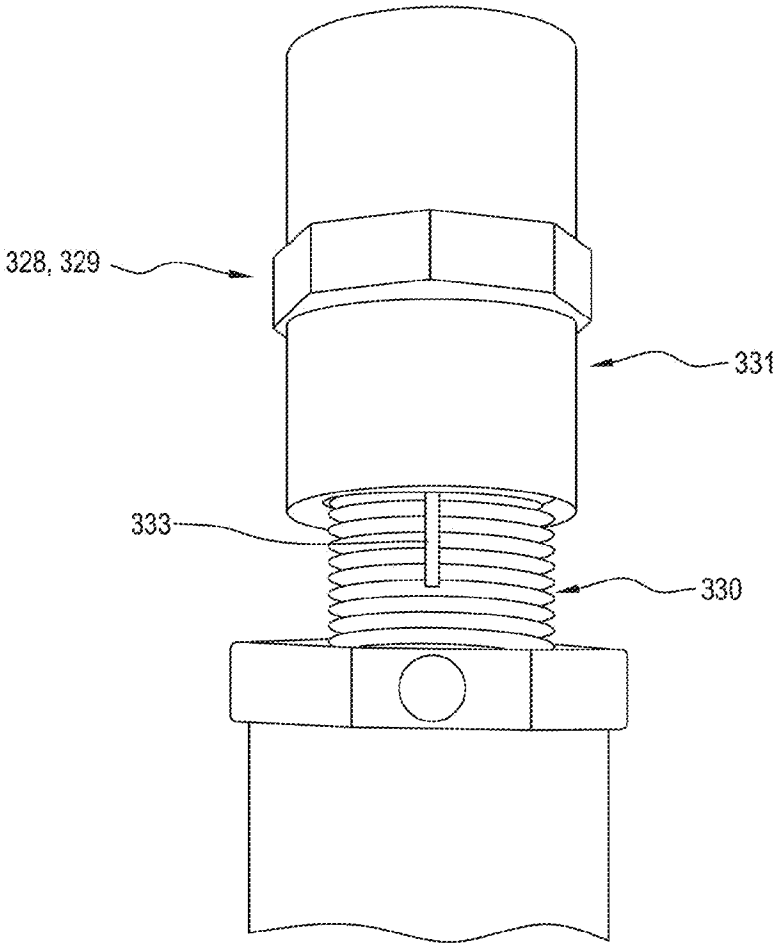
FIG. 15 is a perspective assembly view illustrating operation of a crimping lock.

Operation of a crimping lock 328, 329 is illustrated with reference to FIG. 15. A crimping lock can include a male threading section 330 and a nut 331. Section 330 can include one or more gap 333. Crimping lock 328, 329 can be operative so that when nut 331 is tightened a gap distance defined by one or more gap 333 decreases so that an interior wall of male section 330 impinges on flag pole 312 resulting in sleeve 322 being tightened onto flag pole 312. The crimping lock mechanism as set forth in FIG. 15 can be utilized with any sleeve received on any flag pole described herein, e.g., the sleeve of any shield 320 and the one or more sleeve of any stand defining apparatus 300 set forth herein.

There is set forth herein an apparatus comprising a shield 320 having one or more wall 330, the one or more wall 330 defining an interior 332 and an exterior 334; a light source bank 710 disposed to emit light downward from the shield 320; wherein the shield 320 is adapted to be mounted on a golf flag pole 312. There is also set forth herein an apparatus, wherein the shield 320 has a flattened top 323 on which there is disposed one of solar panel 732 providing a solar panel bank 730. There is also set forth herein an apparatus, wherein the shield 732 includes a display 793 that displays a range of a golfer from the shield 320. There is also set forth herein an apparatus wherein the shield 320 is configured to limit an amount of precipitation entering an interior volume development by the shield 320. There is also set forth herein an apparatus, wherein the shield 320 is adapted so that the shield can be manually adjusted to various positions on a golf flag pole 312. There is also set forth herein an apparatus wherein the shield 320 defines a narrowing perimeter from bottom to top. There is also set forth herein an apparatus, wherein the shield 320 is adapted so that an interior of the shield 320 is light reflective. There is also set forth herein an apparatus having a shield that includes a sleeve 322 for use in securing shield 320 at a fixed elevation on golf flag pole 312. In one embodiment, for improved stabilization, a sleeve 322 can extend downward to an elevation delimited by an interior of shield 322 as well as upward to an elevation above an interior of shield 322.

Figure 15A:
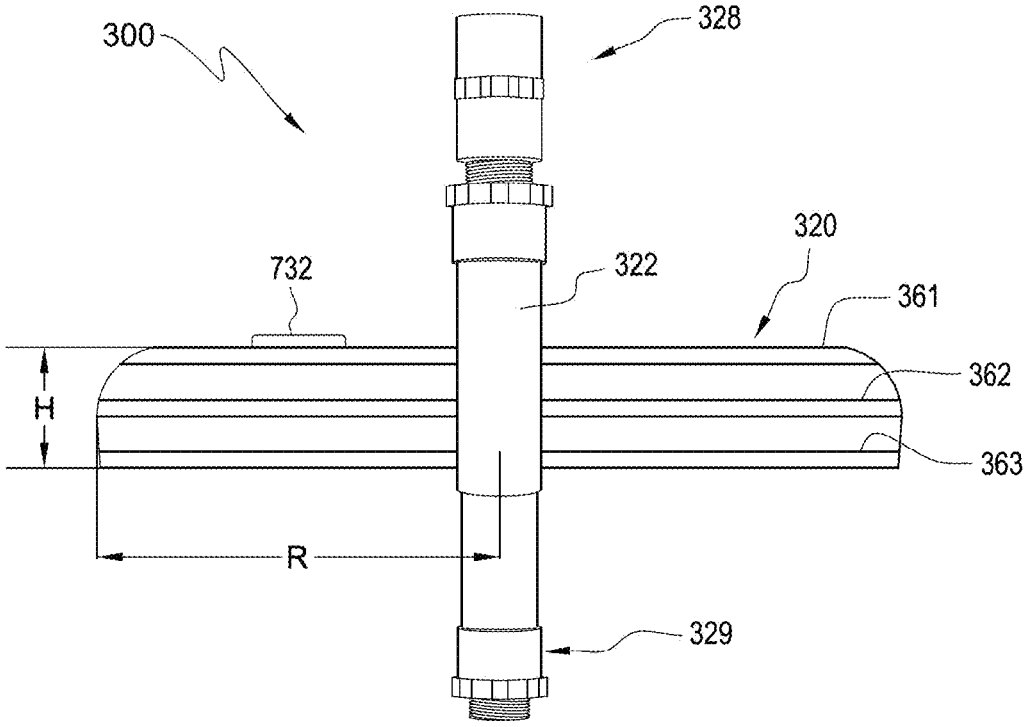
FIG. 15A is a schematic side view of a low profile shield.
Figure 15B:
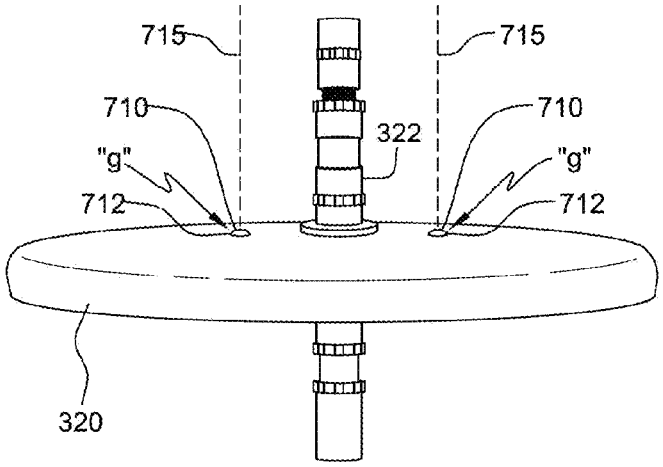
FIG. 15B is a perspective side view of a low profile shield.
Figure 15C:
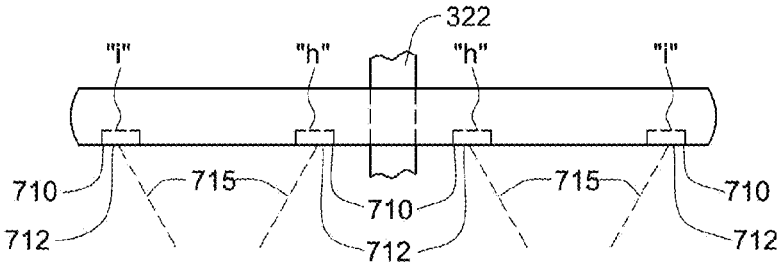
FIG. 15C is a cross sectional side view of a low profile shield in one embodiment.
Figure 15D:
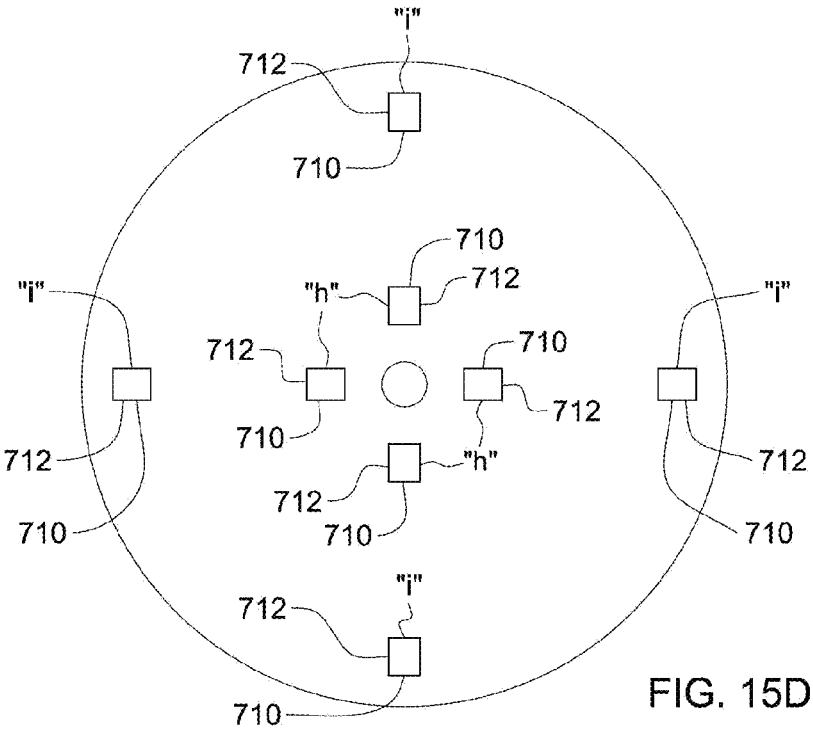
FIG. 15D is a bottom view of a shield in one embodiment.
Figure 15E:
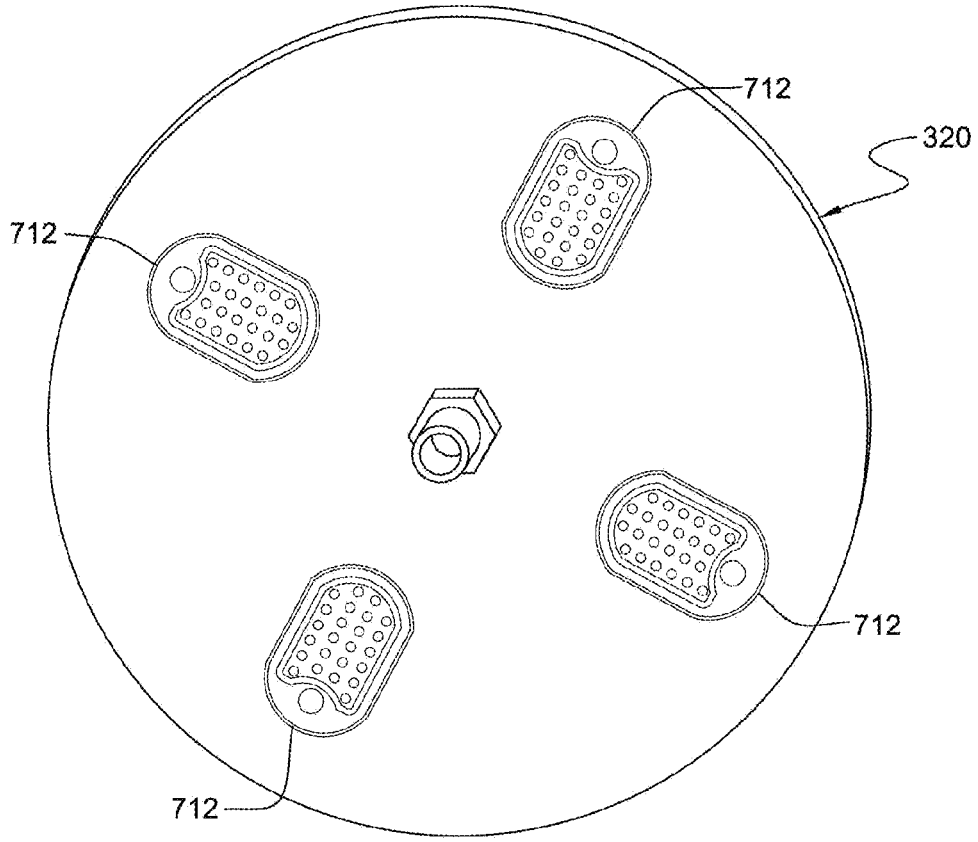
FIG. 15E is a perspective bottom view of a low profile shield.
Figure 15F:
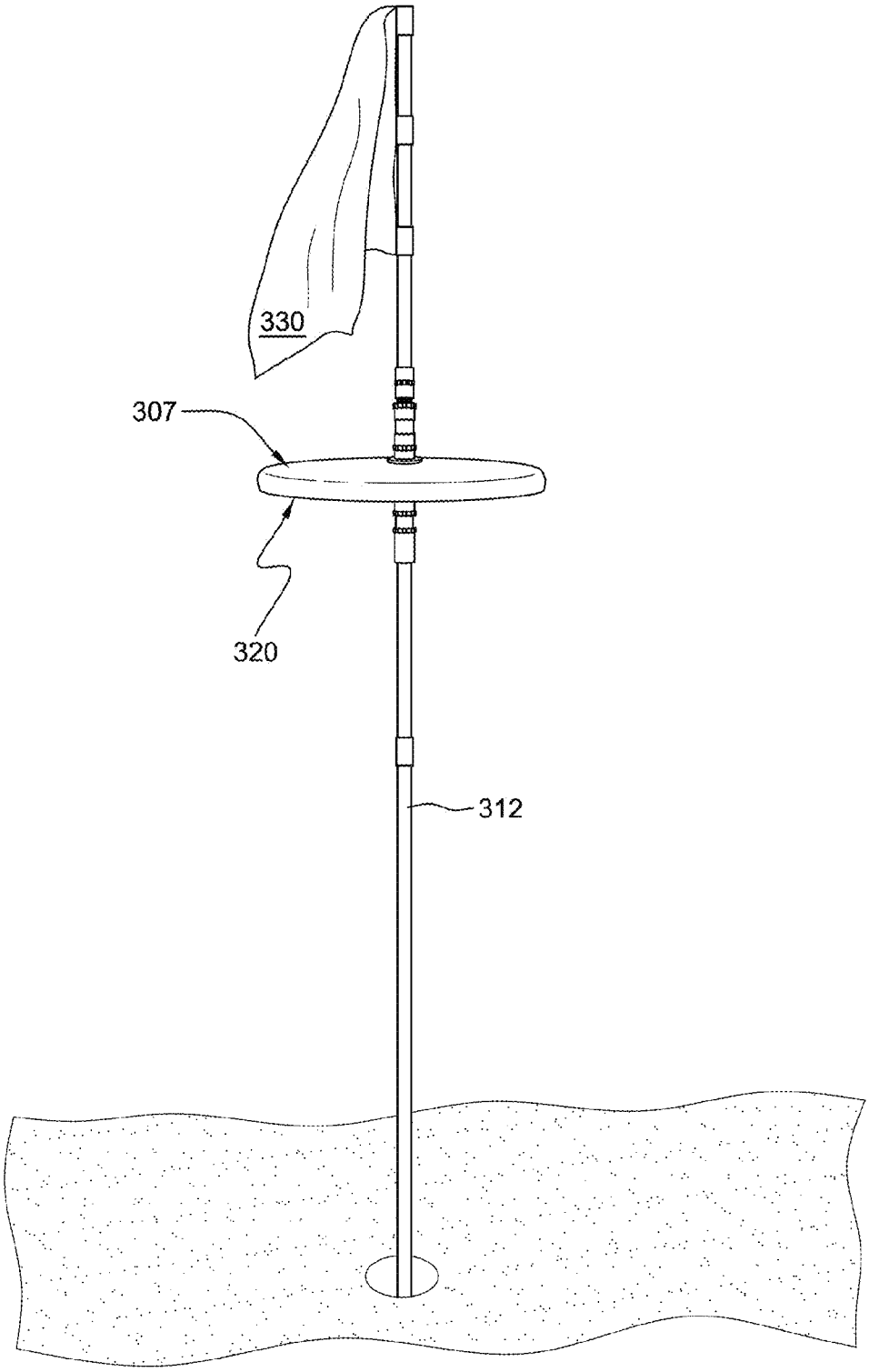
FIG. 15F is a perspective view of a golf flag apparatus having a low profile shield.

A specialized low profile shield 320 is shown in FIG. 15A. Shield 320 has the general configuration as shown in the embodiment of FIG. 14 except that shield 320 has a lower profile such that a height, H, of shield 320 is less than a radius, R, of shield 320 (H<R). In one embodiment, H<=R. In one embodiment, H<=0.5R. In one embodiment, H<=0.3R In one embodiment, H<=0.1R. Shield 320, as shown in FIG. 14 includes a first platform 361, second platform 362 and third platform 363. First platform 361 can support one or more solar panel, second platform 362 can support one or more battery 722, 724 and other circuit components and third platform 363 can include one or more light source 712 of light source bank 710. The one or more light source 712 can have downward directed central emission vectors 715. A side perspective view of low profile shield 320 in one embodiment is shown in FIG. 15B. A bottom perspective view of a low profile shield 320 is shown in FIG. 15E. A golf flag apparatus 2300 having a flag pole 312, a golf flag apparatus 300 having a low profile shield 320 and a flag 330 is shown in FIG. 15F. In one embodiment shield 320 can have a top view diameter of between about 10 inches and 36 inches (radius between about 5 inches and 18 inches), a height of between about 0.25 inches and less than 5.0 inches, e.g., less than 4.0 inches, less than 3.0 inches, less than 1.0 inch. Various additional features are set forth with reference to FIG. 15B through FIG. 15D. In one embodiment, shield 320 can have disposed on a top surface thereof at location "g" one or more light source 712 having upward directed central emission factors 715. The upward directed emission vectors can provide illumination to a golf flag 330 (FIG. 15F) enabling flag 330 to be viewed from longer distances. In another aspect, as set forth in FIGS. 15C and 15D, a shield 320 can include a first one or more light source 712 and a first radial distance at location "h" from sleeve 322 and a second one or more light source 712 at a second radial distance at location "I" from sleeve 322. The first radial distance can be less than the second radial distance as shown. In another embodiment central emission vectors 715 of light sources 712 at location "h" can be outwardly extending relative to sleeve 322 and central emission vectors 715 of light source 712 at second location "I" can be inadvertently extending relative to sleeve 322. In such manner inner wall 202 (FIG. 3) of golf cup apparatus 1200 can be softly illuminated with angularly directed light to avoid strong potentially distracting reflection which might result if central emissions vectors 715 of a light source sleeve 320 were directed straight vertically downward to impinge on bottom 204 of golf cup apparatus 200. Relative to the shield in the previous embodiments, low profile shield 320 as shown in FIG. 15A, 15B, 15C, 15D provides increased wind resistance, decreasing a likelihood that golf flag apparatus 2300 will be moved during periods of substantial winds. Shield 320 as in the previous embodiments can prevent precipitation from reaching a golf cup 20, thereby improving a reliability of electrical components that can be associated with a golf cup apparatus 200.

In another aspect returning again to FIG. 9, golf flag apparatus 1300 can include a golf flag apparatus 300 provided by a flag stand as shown in FIG. 9. In the embodiment of FIG. 9 the apparatus 300 defining a stand shown depicted as having leg 341 is provided by a plurality of retractable tripod legs 341, 342, 343 supported on sleeve 345 that is fitted over pole 312. Apparatus 300 can be provided so that a position of sleeve 345 on pole 312 can be adjusted e.g., with use of a manually actuated wing screw 346. In use a golfer may remove flag pole 312 from cup apparatus 1200 in reaching a green in order to properly putt out in compliance with the Rules of Golf which mandate that a flag be removed from a cup 20. So that golf flag apparatus 300 having shield 320 can supply improved illumination to a golf hole even when pole 312 is removed from aperture 207, golf flag pole 312 can be standed with use of apparatus 300 defining a stand at a location proximate a cup 1200. For standing of pole 312, sleeve 345 can be moved from an inactive position away from distal end to an active position closer to distal end 347 at which the stand is operative to stand the golf flag pole 312. A golf flag apparatus 300 provided by a stand heavy leg 341 can comprise electrical components as shown in FIG. 2 including a light source bank 710. In one embodiment a stand can be devoid of a light source bank 710 but can still be regarded as an illumination providing apparatus in that the standing of pole 312 can aid an illumination of a golf course environment, e.g., a golf hole 1000.

Referring further to the embodiment of FIG. 9, the stand provided by apparatus 300 at location II can include a plurality of legs 341, 342 and 343. The stand defined by apparatus 300 at location II can be adjustable between open and closed positions. In a closed position legs 341, 342, 343 are positioned relatively closer to pole 312. In an opened position legs 341, 342, 343 are positioned in positions relatively farther away from pole 312 and are in such a position that legs 341, 342, 343 can stand pole 312 on a golf green or near a golf green without externally provided forces. Apparatus 300 defining a stand can be movable upwardly and downwardly on pole 312 so that the stand defined by apparatus 300 can be moved to various vertical positions on pole 312. In use, the stand can be fixed at a relatively upward elevation on pole 312 with legs 341, 342, 343 in a generally closed position before a player arrives at a golf green 1110. When a player arrives at the golf green 1110, the player can remove pole 312 from cup 1200 and stand it on a golf green 1110 or near a golf green 1110 with use of the apparatus 300 defining a stand at location II, namely by shifting the stand defined by apparatus 300 downwardly along pole 312 and opening legs 341, 342, 343 so that the stand defined by apparatus 300 is in a position that legs 34, 342, 343 aid in the standing of pole 312. The apparatus 300 defining a stand at location II can include an upper sleeve 345 and a lower sleeve 347. Legs 341, 342, 343 can be pivotally connected to sleeve 345, whereas links 341A, 342A, 343A can be pivotally connected to both legs 341, 342, 343 and lower sleeve 347 as shown. As lower sleeve 347 is moved away from upper sleeve 345, links 341A, 342A, 343A operate to push respective legs 341, 342, 343 outwardly into an open position where legs 341, 342, 343 operate to stand pole 312. Sleeve 345 can include an associated manually actuated wing screw 346 for fixing an elevation of sleeve 345 on pole. Similarly, sleeve 347 can include an associated manually actuated wing screw 348 for fixing an elevation of sleeve 347 on pole 312.

Another embodiment of a stand defined by apparatus 300 is shown in FIG. 10. In the embodiment of FIG. 10, the defined stand includes upper sleeve 394 and lower sleeve 396 that are biased apart by spring 382. When sleeves 394 and 396 are spaced closely together, legs 341 and 342 are spaced generally closer to pole 312. When sleeves 394 and 396 are spaced farther apart, legs 341 and 342 tend to spread into a position in which they are able to stand pole 312 on a golf green 1110.

In the embodiment of FIG. 10, pole 312 includes stop 398 for stopping a lower position of sleeve 396 on pole 312. Pole 312 can include detent 392 operative with use of push bottom 390. The stand can be movable between a closed leg position and an open leg position.

In another embodiment, pole 312 can include detents 392, 393 which are separated and which are operative with use of push button 390. The stand defined by apparatus 300 as shown in FIG. 10 can be movable into a closed leg position in which legs 341, 342 are positioned closely to pole 312. For achieving such position sleeve 394 and 396 can be pushed upward on pole 312 so that upper sleeve 394 is locked by detent 392 and lower sleeve 396 is locked by lower detent 393. Detents 392 and 393 lock sleeve 394 and 396 into closely spaced positions so that legs 341 and 342 are spaced closely to pole 312 when sleeves 394 and 396 are locked by detents 392, 393. By pushing push bottom 390 inward, detents release sleeve 394 and 396 so that spring 382 pushes the sleeves apart to spread legs 341, 342 into a standed position. Sleeves 394 and 396 can be guided down pole 312 until stopped by stop 398 and then manually actuated wing screws 384, 386 of sleeve 394 and 396 can be turned to fix a position of sleeves 394 and 396 so that a standed position of a stand defined by apparatus 300 is achieved.

There is also set forth herein an apparatus comprising a plurality of legs, 341 and 342 wherein the apparatus is adapted to be mounted on a golf flag pole 312, wherein the apparatus has a first position in which the plurality of legs are adapted to stand a golf flag pole 312. There is also set forth herein an apparatus adapted so that an elevation of the apparatus on a golf flag pole 312 can be adjusted. There is also set forth herein an apparatus, wherein the apparatus has a second position in which distal ends of the plurality of legs 341, 342 are adapted to be located closer to a golf flag pole 312 than in the first position. There is also set forth herein an apparatus, wherein the plurality of legs 341 and 342 consist of two legs. There is also set forth herein a golf flag stand that can be used to stand a golf flag pole 312. A golf flag stand can be adjustable to be fixed at various elevations on a golf flag pole 312. The golf flag stand can be adjustable between a first position in which the stand is not operative to stand a golf flag pole 312 and a second position in which the stand defined by apparatus 300 is operative to stand a golf flag pole 312. In the first position one or more member of the stand can be located closer to a golf flag pole 312 than in the second position.

Referring to various wearable apparatus 400 for providing illuminated golf, various wearable apparatus for providing illuminated golf are shown and described in connection with FIGS. 16 through 24. Referring to a wearable apparatus 400 wearable apparatus 400 in one embodiment can include an ankle bracelet 402 supporting light source 712 of light source bank 710 providing illumination. Ankle bracelet 402 can also include a circuit housing 795 (shown in dashed view in FIG. 2) protecting and enclosing circuit components of the circuit diagram of FIG. 2. In the development of wearable apparatus 400 it was contemplated that providing a wearable illumination providing apparatus for golf is challenging for the reason that the golf swing comprises a multitude of moving parts and that virtually every area of a body moves during a golf swing. Thus, supporting a light source bank 710 comprising one or more light source 712 on various areas of a body would mean that light directed from the light source would change directions multiple times during a golf swing. In the development of wearable apparatus 400 it was determined that an exception to the general rule that body parts move during a golf swing is that a lead foot (the left foot for a right handed golfer) tends not to move substantially during performance of a golf swing.

In use, ankle bracelet 402 supporting light source 712 of light source bank 710 can be applied to foot area 410 of a lead foot of a golfer 420 closest to a target so that a central emission vector 715 of light source 712 is directed forwardly from a golfer 420 in a direction generally toward a golf ball 500 being addressed and transverse to a target. A foot area 410 can comprise one or more of a golfer's foot, ankle and lower shin. Since the light source of apparatus 400 is supported on a foot area 410 of a golfer's foot it can be expected that the direction of emitted light emitted by the light source 712 will not move substantially during performance of a golf swing to the extent that the golf swing is performed correctly according to the principle that the lead foot remaining substantially grounded for completion of a golf swing. In fact apparatus 400 can function as a golf training aid. The golfer using apparatus 400 can be expected to inherently desire light being directed from light source 712 to be stably directed from light source 712 so that the golfer 420 can maintain good concentration on the golf ball 500. In an effort to maintain light from light source 712 being directed in a stable direction, the golfer 420 can be expected to maintain the golfer's lead foot in a stable position thus promoting a good golf swing having the foundation of a stable and solid stance.

Figure 18:
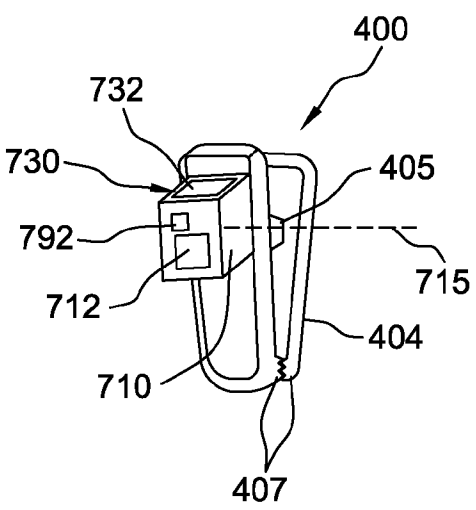
FIG. 18 is a perspective view of a wearable illumination providing apparatus in one embodiment.

While apparatus 400 can include an ankle bracelet 402 wearable on a foot area 410 of a golfer, wearable apparatus 400 shown in an exemplary embodiment of FIG. 18 can alternatively include a clip 404 wearable on a foot area 410 of a golfer 420 by it being adapted to be clipped to a shoe 802 of a golfer 420. Clip 404 can include a spring 405 for spring loading clip 404, and alligator teeth 407 at a distal end so that clip 404 in one embodiment can be regarded as a spring loaded alligator clip. Clip 404 can be manually actuated to open teeth 407 of clip 404 and then can be released so that clip 404 can be clipped to a shoe wall 804 (FIG. 20) of shoe 802 partially defining a foot hole 806 of shoe 802. There is set forth herein method for training a golfer, the method comprising: disposing a light source bank 710 on a lead foot of a golfer in a manner that the light source bank 710 emits a beam of light having a central emission vector 715 toward a golf ball 500, and executing a golf swing while maintaining the beam in a substantially stable position. The beam of light can have a central emission vector 715. In one embodiment the central emission vector 715 can be directed in a direction to intersect golf ball 500.

Figure 20:
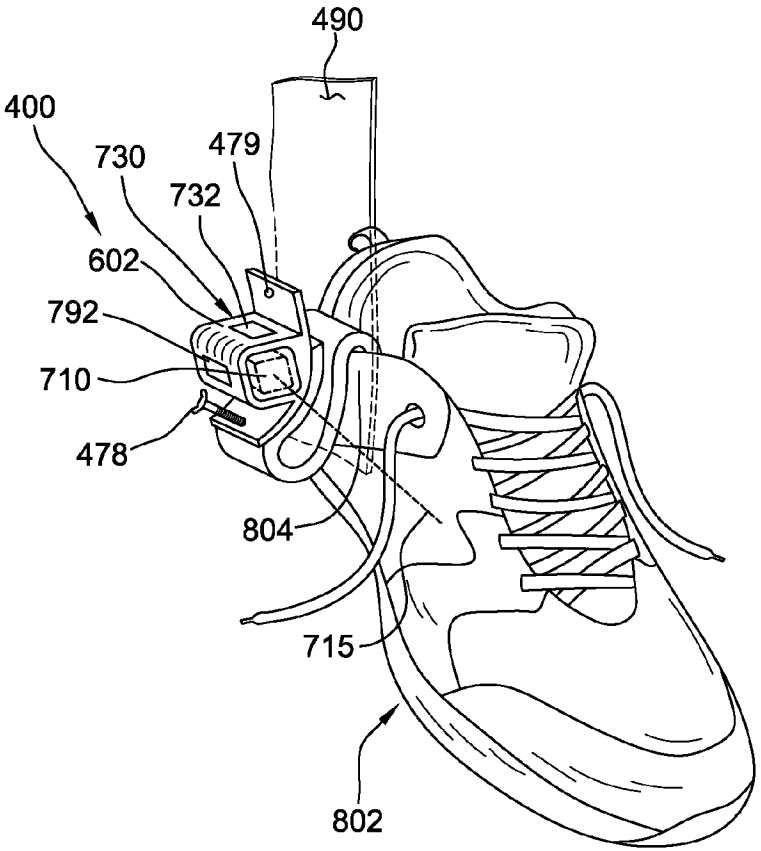
FIG. 20 is a perspective view of a golf shoe having the wearable apparatus as shown in FIG. 19 disposed therein.
Figure 19:
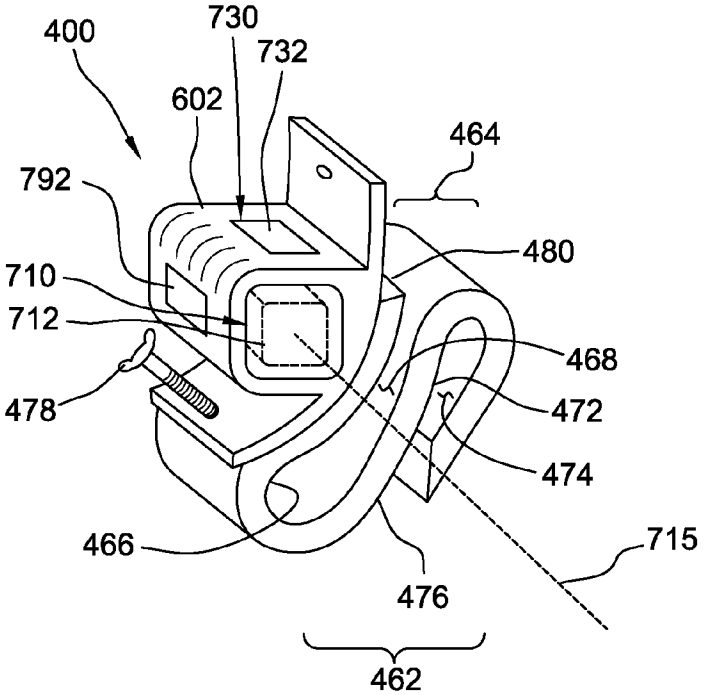
FIG. 19 is a perspective view of a wearable illumination providing apparatus in one embodiment.

One particular embodiment for wearable apparatus 400 is shown in FIGS. 19 and 20. Wearable apparatus 400 as shown in FIG. 19 can include a clip section 462, a pant leg retainer section 464 having opposing interior surfaces 466, 468 delimiting a gap 470 and a circuit housing 795 mounted to pant leg retainer 464. Clip section 462 and pant leg retainer section 464 can be of unitary construction (comprising a single piece of material) or can be of separate non-unitary construction and can be held together in adjacently disposed relation and in fixed relative positions. Regarding clip section 462, clip section 462 can be normally biased so that opposing interior surfaces 472, 474 are urged together in a manner that they are able to pinch against a shoe wall 804 partially defining an opening 806 of a shoe 802 (FIG. 20). Clip section 462 has an opening 476 delimited by walls 472, 474 facing downward while pant leg retainer section 464 has an opening 480 delimited by walls 466, 468 facing upward. In use, wearable apparatus 400 as shown in FIGS. 19 and 20 can be installed on a shoe 802 by installing clip section 462 on a shoe wall 804. With clip section 462 so installed, pant leg retainer section 464 with opening 480 facing upward is in position to receive a pant leg 490. Pant leg 490 is thereby maintained in a certain position and prevented from interfering with light emanating from light source bank 710. Light source bank 710 can be fixedly disposed on exterior wall 482 of pant leg retainer section 464. Light source bank 710 disposed within circuit housing 795 mounted to external wall 482 of pant leg retainer section 464 is separated from pant leg in a position where pant leg 490 does not interfere with light source bank 712. The combination of clip section 462 and pant leg retainer section 464 which can be of unitary construction can in one embodiment comprise metal and in another embodiment molded polymeric material.

In the embodiment of FIG. 20, wearable apparatus 400 is in position so as to be wearable on a shoe wall 804 of an interior left shoe 802 of a golfer. Such positioning may be a desired positioning for use on a golfer having a left foot as a lead foot. In order to facilitate use of apparatus 400 on either left foot or right foot of a golfer 420, wearable apparatus 400 can be configured so that circuit housing 795 can be adjustable in a manner that central emission vector 715 can direct light in a first direction as shown in FIG. 20 (generally out of the paper), or a second opposite direction (generally into the paper). In other words, while emission vector 715 is shown as emanating forwardly in the view of FIG. 20, apparatus 420 can be configured so that wearable apparatus 400 is manually reconfigurable so that central emission vector 715 extends rearward rather than forward.

In one aspect, wearable apparatus 400 can include wing screw 478 and wearable apparatus 400 can be adapted so that tightening of wing screw 478 locks circuit housing 795 housing light source bank 710 and other circuit components as shown in FIG. 2 into association with the remainder of wearable apparatus 400 and further so that loosening of manual wing screw 478 allows removal of circuit housing 795 housing circuit components as shown in FIG. 2 from a remainder of wearable apparatus 400. With circuit housing 795 housing circuitry removed from a remainder of wearable apparatus 400, a direction of circuit housing 795 can be reversed so that emission vector 715 points rearward rather than forward, as shown in FIG. 20. Circuit housing 795 housing circuit components as shown in FIG. 2 can be reconnected fixedly to remainder of wearable apparatus 400 by driving wing screw 478 through secondary hole 479 to accommodate a reverse positioning of circuit housing 795.

An alternative embodiment of wearable apparatus 400 having the general construction and operation as shown in the embodiment of FIGS. 19 and 20 is shown in FIGS. 21-24. The embodiment of FIGS. 21-24, like the embodiment of FIGS. 19 and 20 includes a clip section 462, a pant leg retainer section 464 having opposing interior surfaces 466, 468 delimiting a gap 470 and a circuit housing 795 mounted to pant leg retainer 464. Clip section 462 and pant leg retainer section 464 can be of unitary construction (comprising a single piece of material) or can be of separate non-unitary construction and can be held together in adjacently disposed relation and in fixed relative positions. Regarding clip section 462, clip section 462 can be normally biased so that opposing interior surfaces 472, 474 are urged together so that they are able to pinch against a shoe wall 804 partially defining an opening 806 of a shoe 802 (FIG. 20). Clip section 462 has an opening 476 delimited by walls 472, 474 facing downward while pant leg retainer section 464 has an opening 480 delimited by walls 466, 468 facing upward.

Figure 21:
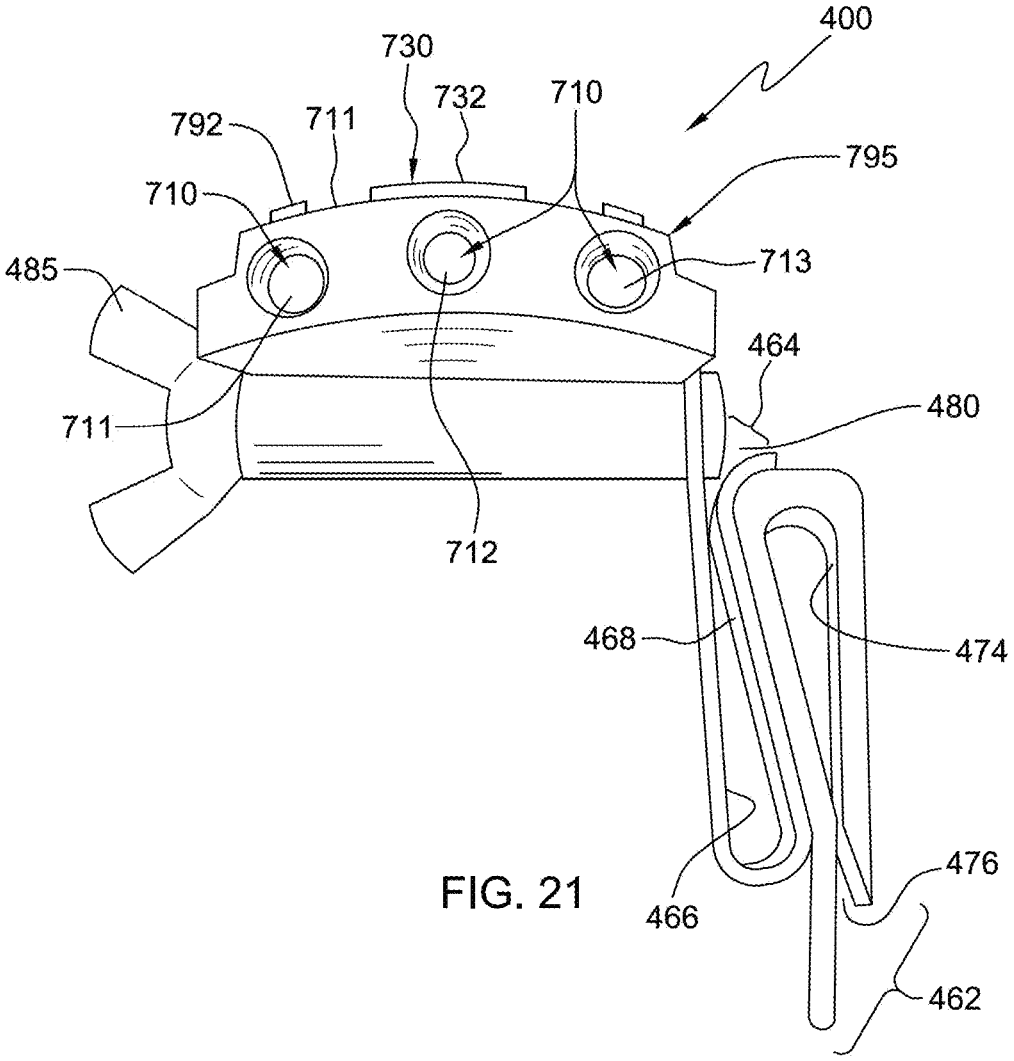
FIG. 21 is a front perspective view of a wearable illumination providing apparatus.

In the embodiment of FIGS. 21-24, light source bank 710 housing by circuit housing 795 includes three light sources 711, 712 and 713. The embodiment of FIGS. 21-24 is similar to the embodiment of FIGS. 19 and 20, expect for various details. In the embodiment of FIG. 21, circuit housing 795 includes an associated sleeve 482. Circuit housing 795 can be fixedly connected in a fixed position relative to sleeve 482. Sleeve 482 can be fixed in a fixed position on a remainder of apparatus 400 with use of screw 484 and manually actuated wing nut 485. Wing nut 485 can be manually tightened to clamp sleeve 482 against the remainder of apparatus 400, as shown in FIG. 21. For reversing an orientation of circuit housing 795, wing nut 485 can be loosened, sleeve 482 removed, its direction reversed and re-clamped against a remainder of apparatus 400 in a reverse direction by tightening manual wing nut 485.

Figure 22:
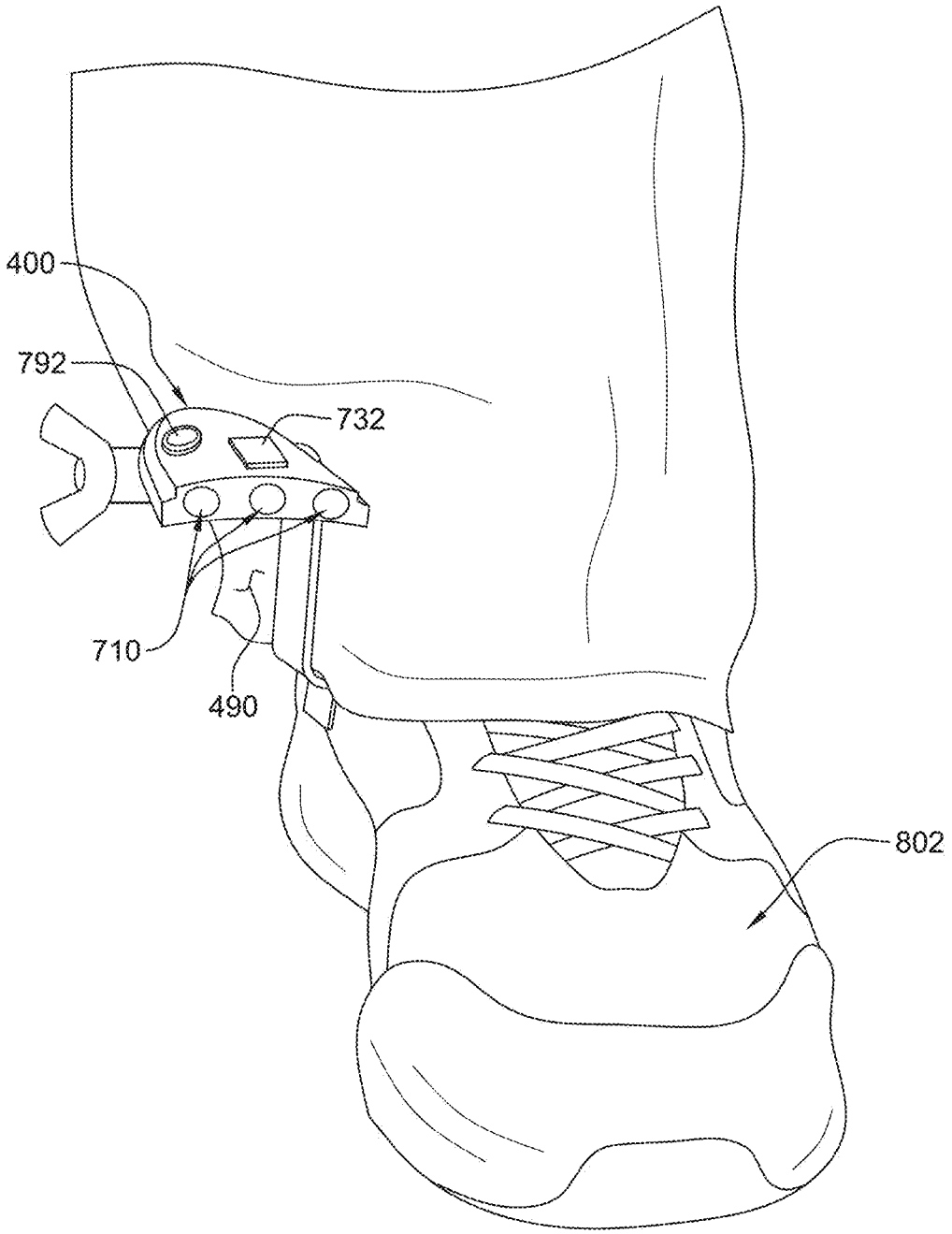
FIG. 22 is a front perspective view of a golfer wearing a wearable illumination providing apparatus on a left foot with a pant leg retainer retaining a pant leg.
Figure 23:
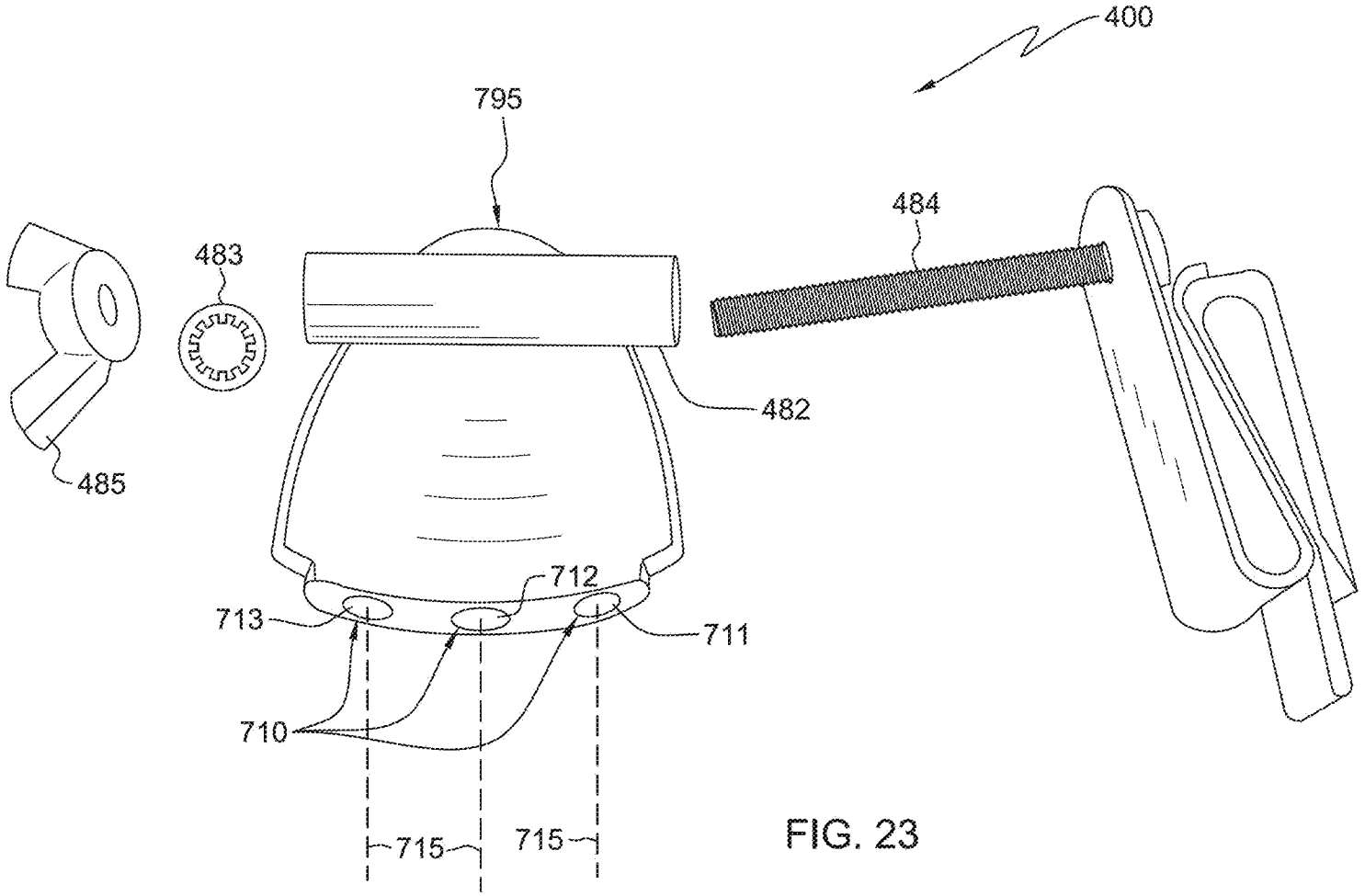
FIG. 23 is an assembly perspective view of a wearable illumination providing apparatus in one embodiment.
Figure 24:
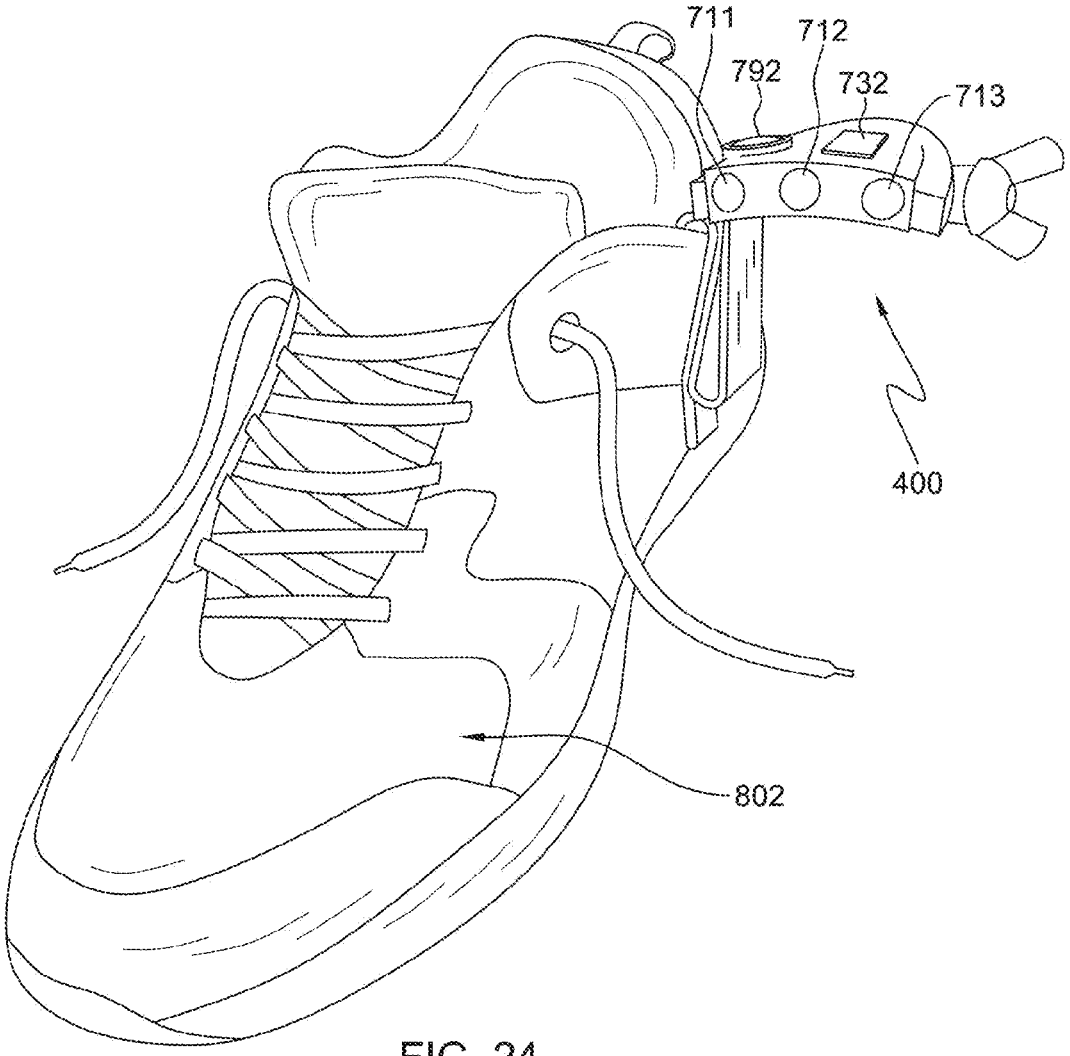
FIG. 24 is a perspective view of a left shoe having disposed there in a wearable illumination providing apparatus.

Alternatively, a direction of a central emission vector 715 of one or more light sources of light source bank 710, can be changed by simply loosening wing nut 485 a slight amount, rotating circuit housing 795 about an axis of cylindrical sleeve 482 until emission vectors of the light sources comprising light source bank 710 are reoriented in a reverse orientation e.g., into the paper instead of out of the paper, as shown in FIG. 21. Referring to FIG. 22, FIG. 22 illustrates use of wearable apparatus 400 in the embodiment of FIGS. 21-24 in use on a left lead foot area 410 of a golfer 420. It is seen that material of a lower pant leg 490 of a golfer is safely secured by apparatus 400 with apparatus being clipped to a shoe wall 804. FIG. 23 illustrates a perspective assembly view of the apparatus 400 and the embodiment of FIGS. 21-24. Apparatus 400 can include a screw 484, a cylindrical sleeve 482 fixedly secured to circuit housing 795, supporting light source bank 710 and wing nut 485. Tightening of wing nut 485 onto screw 484 imparts a compression force on sleeve 482 to fixedly mount circuit housing 795 to a remainder of apparatus 400. Wing nut 485 can be used in association with lock nut 483 so that unwanted twisting of sleeve 482 can be reduced. The reversibility of a primary admission vector 715 (primary emission vector which can be co-located with a central emission vector) of a light source 711, 712, 713 of a light source bank 710 is illustrated in the view of FIG. 24. In the view of FIG. 24, wearable apparatus 400 is illustrated as being worn on an interior wall of a left shoe of a golfer 420. Such positioning can be advantageous e.g., if a golfer 420 is left handed and a lead foot of that golfer 420 is the left foot. It should be noted that the reversibility of apparatus 400 allows wearable apparatus 400 to be worn in other positions on a shoe 802, e.g., an outside shoe wall of a right shoe or an outside shoe wall of a left shoe of a golfer 420.

There is also set forth herein an apparatus comprising a clip section 462 having opposing interior walls delimiting a downward facing opening 476 for receiving a golf shoe wall 804, and an adjacently disposed pant leg retainer section 464 having interior walls delimiting an upward facing opening 480, and a light source bank 710 for directing light generally forwardly when the apparatus is disposed on a golf shoe 802. There is also set forth herein an apparatus, wherein the pant leg retainer section 464 has an exterior wall and wherein the light source bank 710 is fixedly disposed on the exterior wall as shown, e.g., in the embodiments of FIGS. 19 and 21. There is also set forth herein an apparatus, wherein a light source of the light source bank 710 is removable from a major body of the apparatus.

There is also set forth herein a method for illuminating an area about a golfer, the method comprising providing an apparatus having a first set of opposing walls defining a first downward facing opening 476 and an adjacently formed second set of opposing walls that define an upward facing opening 480 and a light source bank 710 for illuminating an area external to the apparatus, and disposing the first downward facing opening 476 onto a golf shoe wall 804 of a shoe 802. There is also set forth herein a method, wherein the disposing further includes disposing the apparatus so that a pant leg 490 of a golfer is retained by the second set of opposing walls. In the views of FIGS. 16 through 24, key 792 can be key for energizing and de-energizing light source bank 710

In a further aspect, golf course illumination features set forth herein can include a light emitting golf ball 500 and a light emitting golf ball charger 600 for illuminating a golf ball 500 to thereby charge a golf ball 500. In one aspect golf ball 500 (FIG. 17) can be light emitting. To provide golf ball 500 to be light emitting golf ball 500 can comprise luminescent (glow in the dark) material. Luminescent material can comprise material capable of one or more of e.g., bioluminescence, chemiluminescence, phosphorescence, radioluminescence. In one embodiment, luminescent material can comprise e.g., ULTRA GREEN V10 glow in the dark paint available from Glow, Inc. In one embodiment, golf ball 500 can be made light emitting by providing one or more light sources disposed within golf ball 500.

Figure 25:
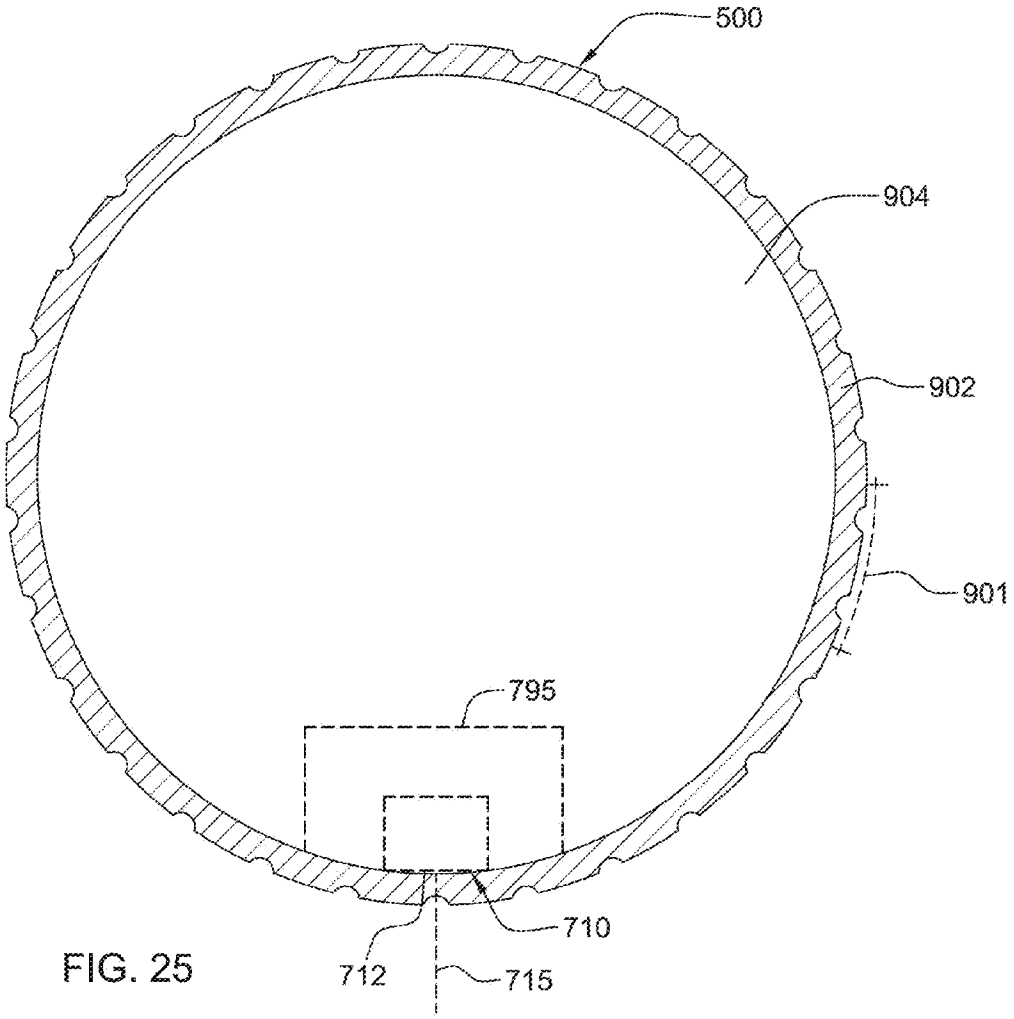
FIG. 25 is a cross sectional view of a luminescent golf ball in one embodiment.

A cross sectional side view of a golf ball 500 is shown in FIG. 25. Golf ball 500 can include outer layer 902 and one or more inner layer 904. As indicated, outer layer 902 can comprising painted on or dipped on luminescent material, e.g., ULTRAGREEN V10 paint from glow ink. Paint comprising outer layer 902 can be painted on or formed by spin coating, dipping or spraying. A remainder of ball 500 in such embodiment, e.g., the one or more inner layer 904 can be a golf ball provided by an off the shelf golf ball which is adapted for use in herein. In such an embodiment, inner one or more layer 904 can comprise itself, an outer layer and one or more inner layers. In one embodiment outer layer 902 can define dimples as shown in FIG. 25.

In another embodiment, photo luminescent outer layer 902 can be provided by curing luminescent material previously provided in liquid form so that it hardens into hardened form. In another embodiment, outer layer 902, which is luminescent can be provided via injection molding, wherein photo luminescent material is included in molten injection molding material so that the injection molding material, when it hardens, is photo luminescent in hardened form.

As has been mentioned, luminescent material of golf ball 500 can comprise phosphorescent luminescent material. Such material can comprise zinc sulfide and strontium illuminate. Strontium illuminate can be particularly well adapted to maintain its strength when mixed with injection molding material. In one embodiment, luminescent golf ball 500 can comprise outer layer 902 and further outer layer 901, as shown in FIG. 25 each of which can be luminescent. In one example outer layer 902 can comprise luminescent material formed by injection molding with luminescent material originally comprising molten injection molding material that is hardened into hardened luminescent material form. In one embodiment, further outer layer 901 can comprise luminescent paint disposed on outer layer 902, e.g., via painting, dip coating, spin coating or spraying. In such embodiment, golf ball 500 can remain luminescent throughout an external surface thereof notwithstanding chipping or cracking of layer 901.

In another aspect, golf ball 500 can include a light source bank 710 having one or more light source 712 disposed therein as indicated in FIG. 25. One or more inner layer 904 can define circuit housing 795 which can house the circuit elements indicated with a dashed border 795 of the circuit diagram shown as described with reference to FIG. 2. In one embodiment, golf ball 500 can be a USGA conforming golf ball. In one embodiment golf ball 500 can be a non-conforming practice golf ball. In one embodiment, golf ball 500 can have a weight greater than a USGA conforming weight. In one embodiment, golf ball 500 can have a weight less than a USGA conforming weight. In one embodiment, golf ball 500 can be scaled down or scaled up to define a ball other than a golf ball and accordingly is also generically referred to herein as a ball 500. In one embodiment, ball 500 can be sized and weighted to define a ping pong ball. In one embodiment, ball 500 can be sized and weighted to define a regulation baseball. In one embodiment, ball 500 can be sized and weighted to define a light weight play baseball. In one embodiment, ball 500 can be sized to define a basketball, e.g., in one embodiment, ball 500 can be sized and weighted according to a size and weight of a WIFFLE brand play baseball of the type available from the Wiffle Ball Inc. of Shelton, Conn. In one embodiment, ball 500 can be sized to define a soccer ball.

Figure 25B:
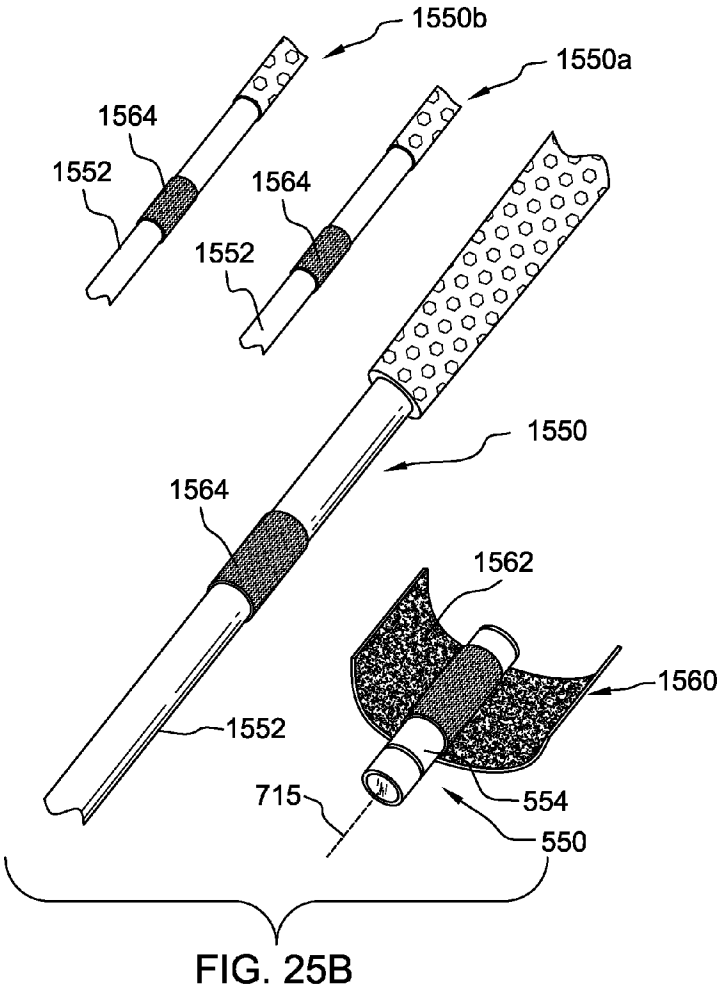
FIGS. 25A and 25B are perspective views of a golf club attachable illumination providing apparatus detachably attachable on a golf club.
Figure 25A:
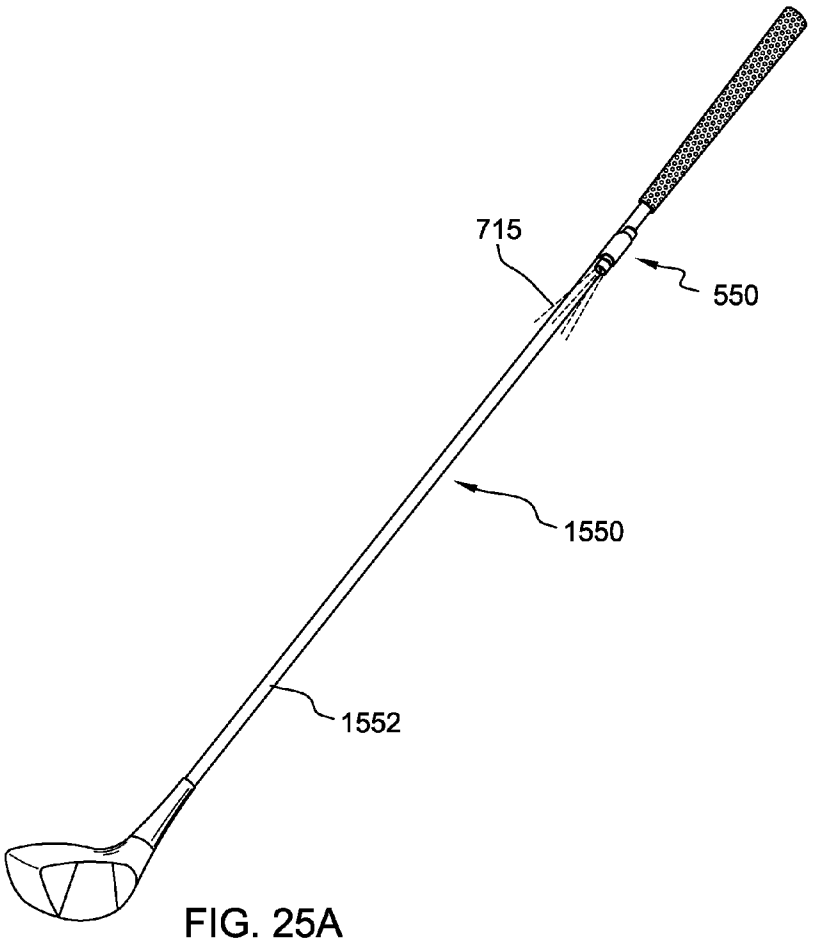

In another aspect, an illumination providing apparatus can comprise an illumination providing apparatus 550 adapted to be disposed on a golf club 1550. In FIG. 25B there is shown an illumination providing apparatus 1550 adapted to be disposed on a golf club shaft 1552. In one aspect, illumination providing apparatus 550 can comprise a light source bank 710 having a light source 712 (FIG. 2). Light source 712 can have a central emission vector 715. Apparatus 550 can be disposed on golf club shaft 1552 of golf club 1550 in a manner that central emission vector 715 extends in a direction in parallel with a shaft 1552 of golf club 1550. In the embodiment of FIG. 25A, illumination providing apparatus 1550 can include a fastener 1560 for fastening apparatus 550 to a golf club shaft 1552. In the embodiment of FIG. 25B the fastener 1560 can be provided by hook and loop type fastener material section. In one embodiment, apparatus 550 can include loop type microloop and hook material section 1562 and shaft 1552 can be adapted to have disposed therein a hook type microloop and hook material section 1564 so that illumination providing apparatus 550 is readily removably disposed on a shaft 1552. In the embodiment of FIG. 25A, central emission vector 715 can extend downwardly in a direction parallel to shaft 1552 (at a compass direction of shaft 1552). In the embodiment of FIG. 25A illumination providing apparatus 550 can have a structural body serving as a housing 554 which has a diameter less than a diameter of shaft 1552. In such manner, an impact of apparatus 555 on a wind resistance of club 1550 will be minimized. In one embodiment a system including golf clubs 1550, 1550A and 1550B can be provided, each having a section of hook type microloop and hook material 1564 so that a golfer can transfer fastener 1560 between clubs 1550, 1550A and 1550B during a round of golf.

Figure 26:
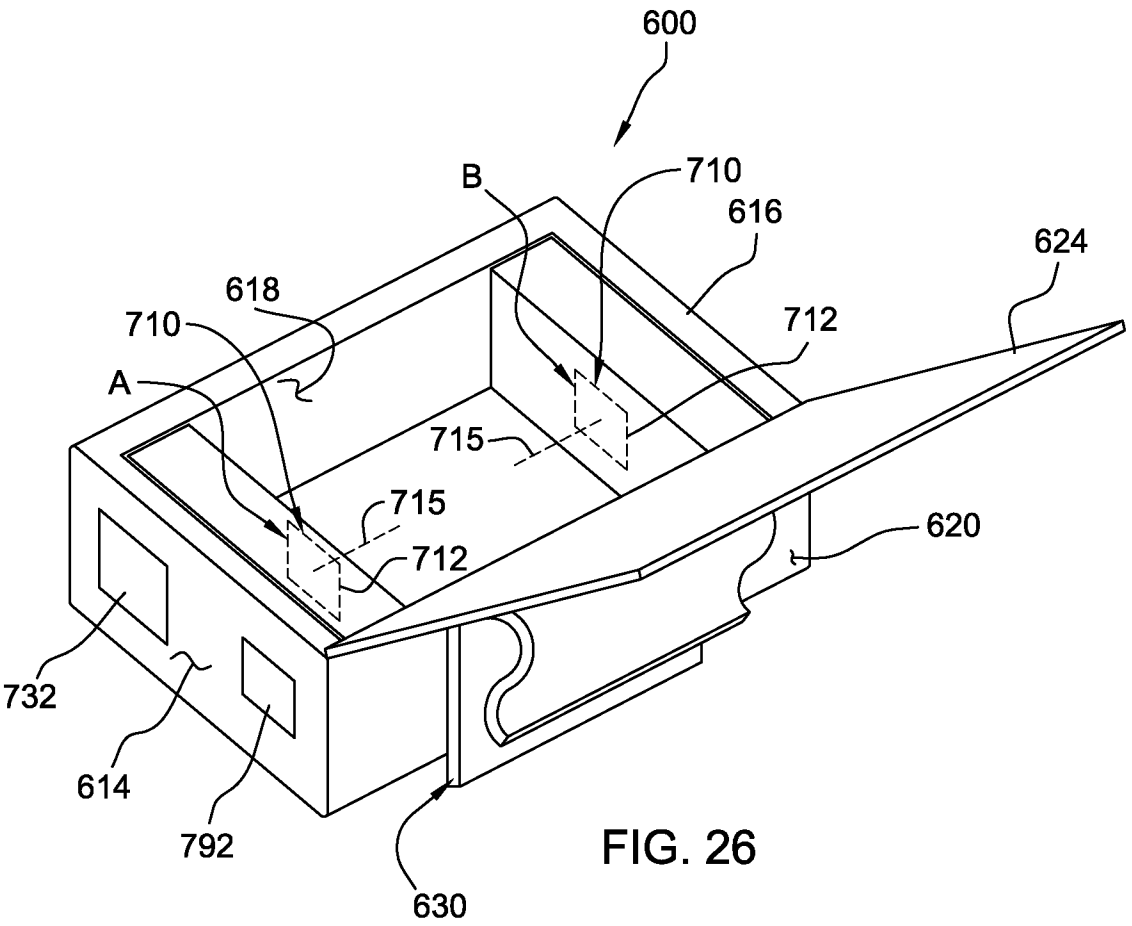
FIG. 26 is a perspective view of a golf ball charger in one embodiment.

In another aspect, illumination features for illuminating a golf course and a golf hole 1000 can include a golf ball charger 600 an example of which is shown in FIG. 26. In FIG. 26 golf ball charger 600 includes first light source bank 710 second light source bank 710. Light source bank 710 (location "A") and light source bank 710 (location "B") can oppose one another. Light source bank 710 and light source bank 710 can define a gap there between sized to accommodate one or more luminescent golf ball 500. Light source bank 710 and light source bank 710 can be supported by a container carrying light source bank 710 and light source bank 710. A container in one embodiment can comprise a base 612 end walls 614, 616 walls 618, 620 and top 624. The various members can define an interior 625. Interior 625 can be sized to accommodate one or more golf ball 500. Top 620 can be formed to be releasably closable e.g., with use of a zipper or snaps or microloop and hook fasteners to allow entry of and retrieval of a golf ball 500. Interior surfaces of walls 618 and 620 can be made light reflective to increase a distribution of light to a charged golf ball 500 to increase an amount of radiant energy delivered to a golf ball 500 being charged. A container as shown by charger 600 of FIG. 26 can be made portable. In one embodiment, charger 600 can be hand carried from hole to hole. Charger 600 in one embodiment can include a clip 630 with opposing walls 632, 634 normally biased a close spacing distance to one another so that charger 600 can be clipped to golfer, e.g., at a belt or pant top to allow charger 600 to be worn by a golfer 420. Charger 600 can alternatively be clipped to a golf bag. In the embodiment of FIG. 25, apparatus 600 can be provided by using flexible material, e.g., walls 614, 620, 616, 618 can be provided by flexible material, e.g., canvas, nylon, etc. charger 600 can include a solar panel 732 and a keyboard key 792, e.g., a key for energizing and de-energizing light source bank 710.

Figure 27:
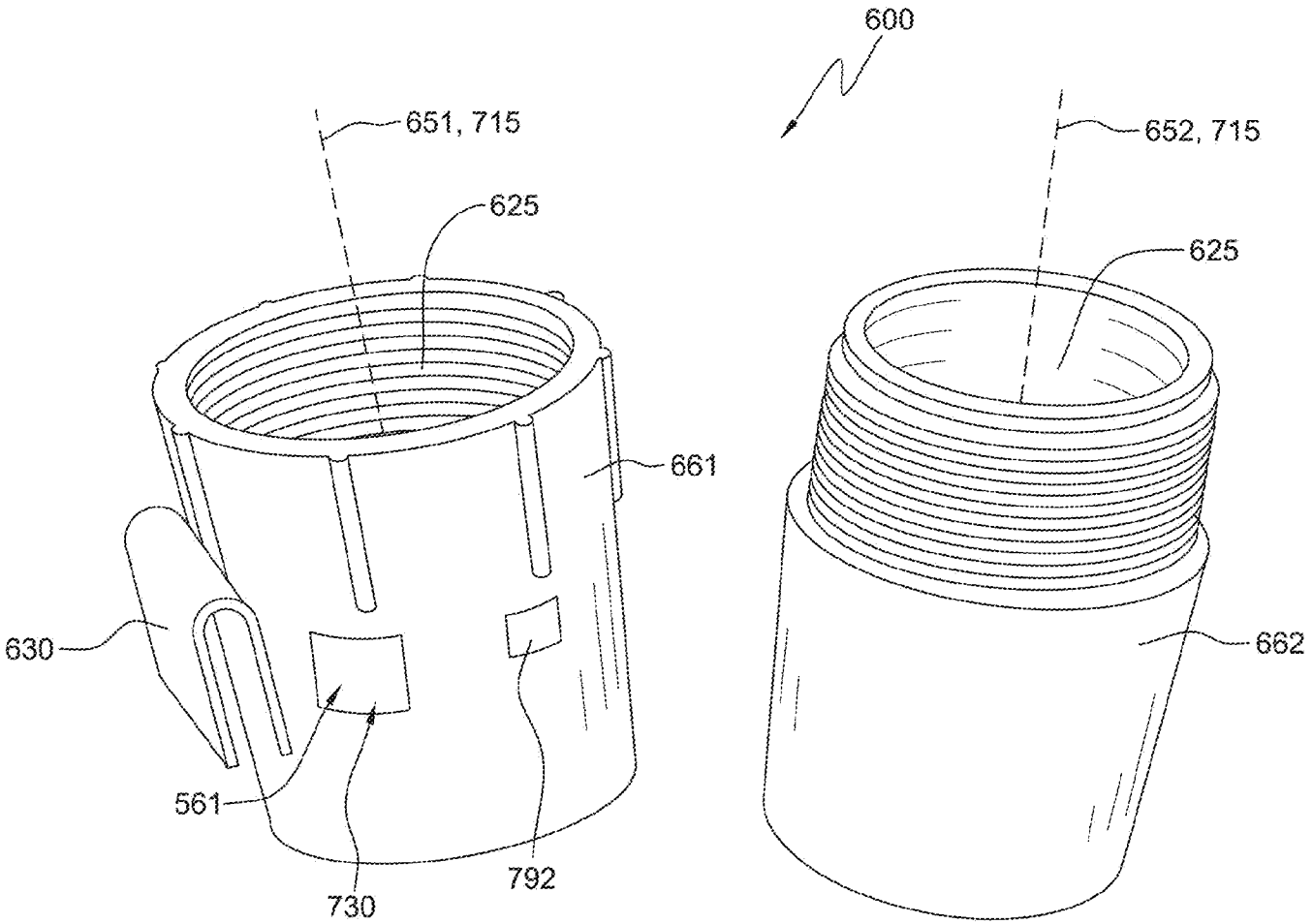
FIG. 27 is a side perspective assembly view of a golf ball charger in one embodiment.
Figure 28:
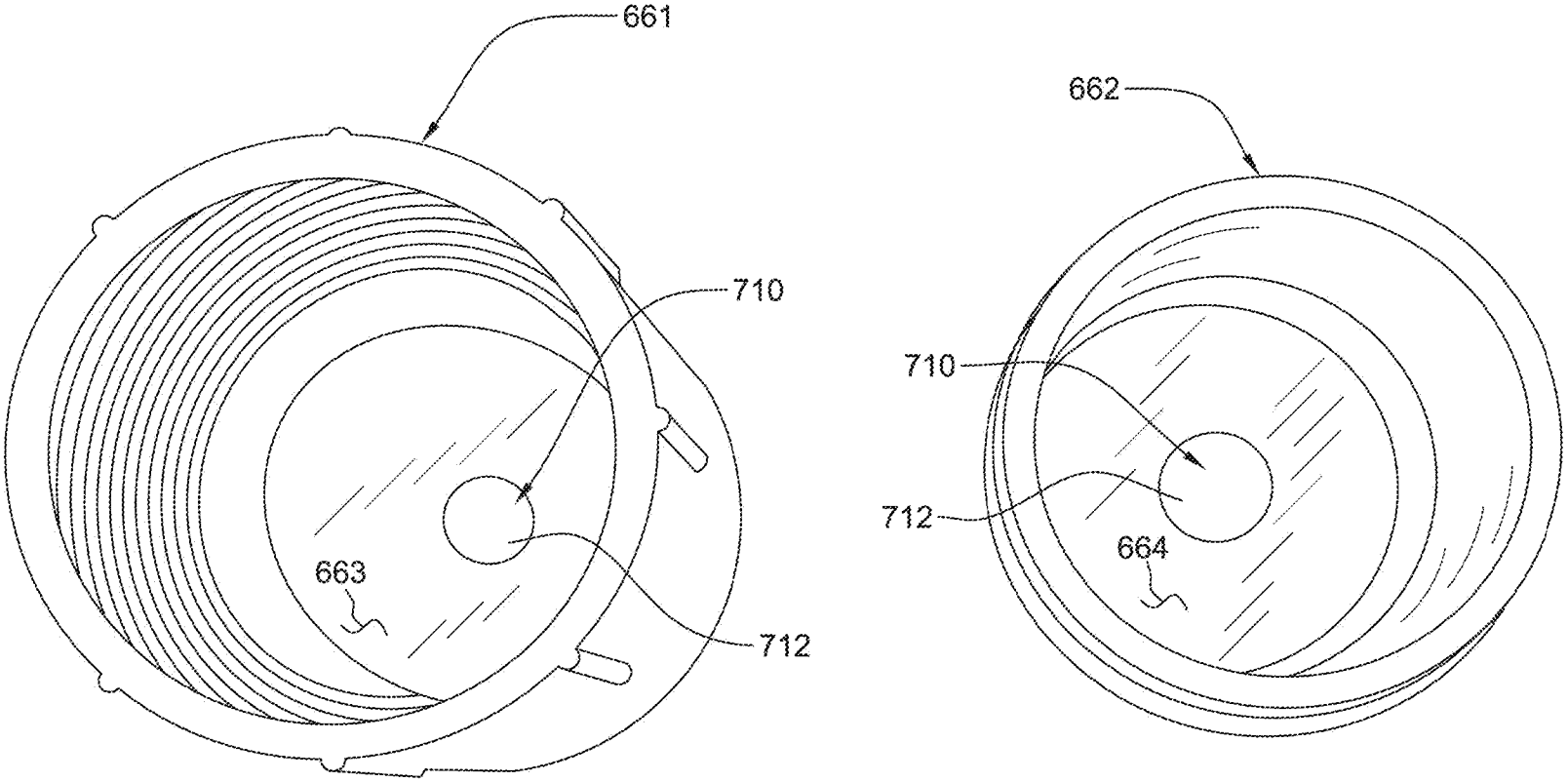
FIG. 28 is a top perspective assembly view of a golf ball charge.

Another configuration for charger 600 is shown in FIGS. 27 through 31. In the embodiment of FIGS. 27 through 31, golf ball illumination providing apparatus 600 can include two rigid clam shell sections 661 and 662 that can be connected together in a recharging mode. Alternatively, the clam shell sections can be flexible. The clam shell sections 661 and 662 can define an interior 625 as shown in FIG. 27, apparatus 600 can include first section 661 and a second section 662. The sections can be fittable together. In the embodiment shown, the sections are fittable together via a threadable nut and screw arrangement. However, the sections 661 and 662 can also be fittable via friction forces, e.g., a friction type connection which can be manually broken. Apparatus 600 can be portable and can also be used in association with a clip 630, e.g., of the form of the clip 630 as shown in the view of FIG. 26. As best seen in the view of FIG. 28, each of the first section 661 and the second section 662 can include a light source bank 710 including one or more light source. Each of the sections 661 and 662, furthermore can be generally cylindrical, as shown.

In another aspect, central emission vector 715 of light sources 712 defining banks 710 of each section 661, 662 can each extend in a compass direction in common with an axis of each section 661 and 662. In a particular embodiment, the central emission vectors 715 can extend in directions coextensive with axes 715 of the respective cylindrical sections 661, 662 in the particular embodiment shown. In one embodiment each section 661 and 662 can be defined by a rigid housing.

Figure 29:
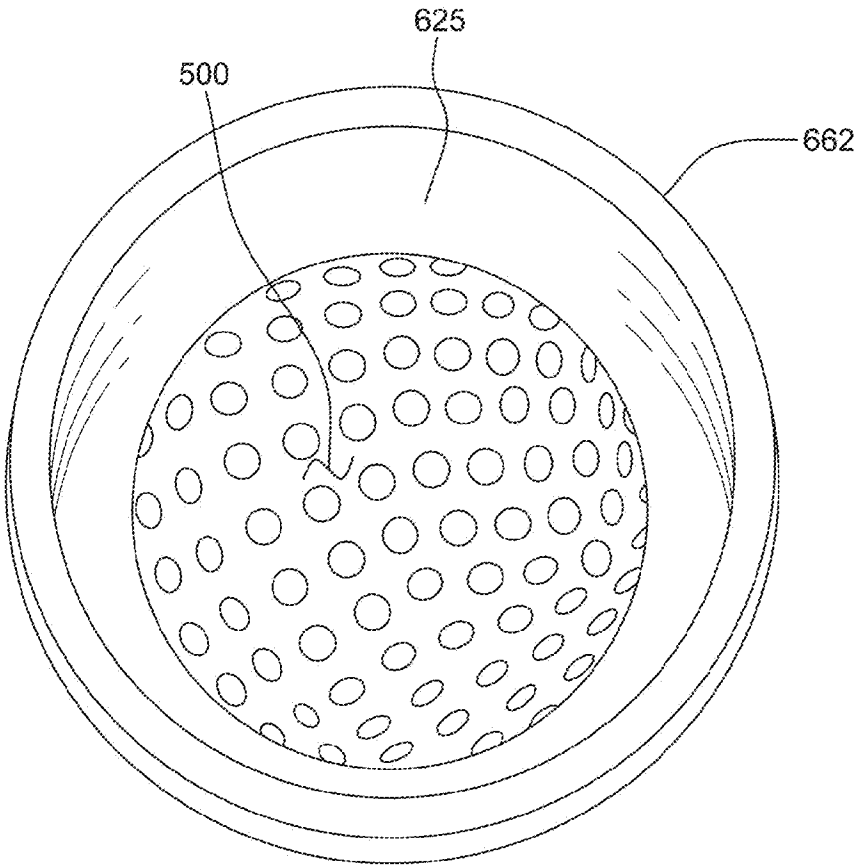
FIG. 29 is a top perspective view of a golf ball charger section having disposed therein a golf ball.
Figure 31:
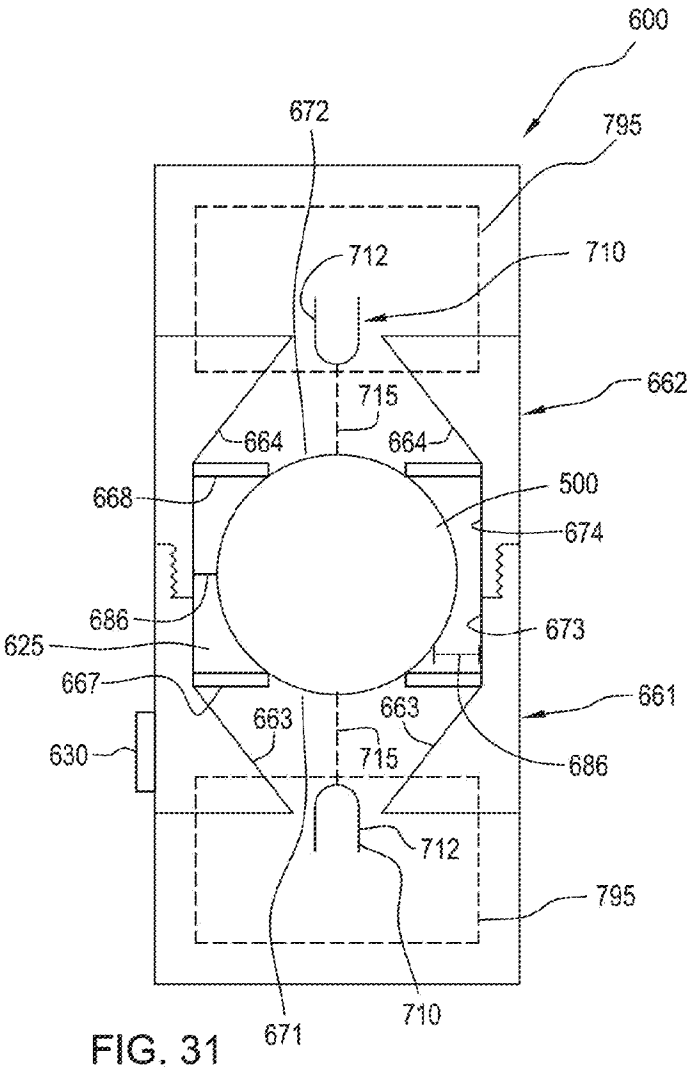
FIG. 31 is a schematic cross sectional view of golf ball charger according to the embodiment of FIG. 27-30.
Figure 30:
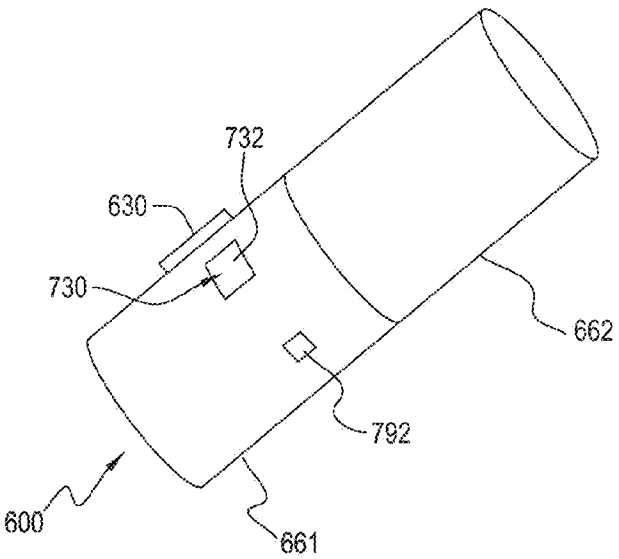
FIG. 30 is a perspective assembled view of a golf ball having first and second sections shown in a coupled state.

In a further aspect, each of the sections 661 and 662 can include a respective reflector 663 and 664 for reflecting light emanating from a light source 712 defining light source bank 710. Namely, section 661 can include reflector 663, whereas section 662 can include reflector 664 as best seen in FIGS. 28 and 31. Referring to FIG. 29, FIG. 29 shows golf ball 500 accommodated within male section 662. Sections 761 and 762 define a container for containing a golf ball 500. The apparatus as shown in FIG. 27 through 31 defines a container having an interior 625 for containing a golf ball 500. In FIG. 30 there is depicted section 761 and section 762 coupled together.

In FIG. 31 there is shown a schematic view of a charger 600 according to the embodiment of FIGS. 27 through 30. Referring to the schematic view of FIG. 31, charger 600 can include a first light transmissive shelf 667 defined on section 661 and a second light transmissive shelf 668 defined on shelf 662. The light transmissive shelves 667 and 668 can include respective center locating apertures 671 and 672, which operate to locate a golf ball 500 so that it is centered at a longitudinal center of charger 600 to thereby define a gap 686 between ball 500 and a wall 665 of charger 600. In another embodiment, one or more of light transmissive shelf 667 and shelf 668 can be non-rigid and resilient and charger 600 can be arranged so that a spring compression force is imparted by one or more of shelf 667 and 668 when section 661 and section 662 are coupled together. In one embodiment of FIG. 31, golf ball 500 can be suspended with use of light transmission shelves 667 and 668 so that a full outer surface area of golf ball 500 is exposed to light rays. It will be seen that charger 600 can be operative in the manner described if only one of shelf 667 and 668 is resilient and non rigid. Also, charger 600 can be operative in the manner described if only one of shelf 667 and 668 has locating aperture 671, 672. In another aspect walls 673 and 674 can be reflective. Arranged as described charger 600 can locate in a stable manner a ball 500 in a position that light rays emitted by a light source 712 defined by light source banks 710 can impinge on ball 500 over an entire surface area of ball 500. For example without gaps 686, surfaces of ball 500 in contact with wall 673 and wall 674 will not receive light. It will be seen that in an alternative arrangement section 661 and/or section 662 can be lengthened so that more than one ball 500 is accommodated. The various interior surfaces of section 661 and section 662 can define an interior 625. Interior 625 can be sized to accommodate one or more golf ball 500. Also, in another embodiment one of the sections 661 or 662 can be truncated so as to be devoid of a light source bank 710. In such embodiment, element 668 as shown in FIG. 31 can be replaced with a member having a reflective inner surface and being devoid of aperture 672. Such reflective member can be optionally resilient or rigid.

There is set forth herein an apparatus 600 for charging a luminescent golf ball, the apparatus defining a container having an interior 625 for containing a golf ball 500, the container having one or more interior wall, a light source bank 710 for illuminating an interior of the container, wherein the container is adapted to hold one or more golf ball 500 in a manner that the one or more golf ball 500 is illuminated by the light source bank 710 while being held by the container.

There is also set forth herein an apparatus 600, wherein the one or more interior wall includes a reflective surface. There is also set forth herein an apparatus 600 wherein a defined container includes first and second sections each having a rigid housing. There is also set forth herein an apparatus 600, wherein the apparatus includes a light transmissive shelf 667, 668 including a center locating aperture 671, 672 for locating a golf ball 500. There is also set forth herein an apparatus 600, wherein a defined container comprises first section 661 and a second section 662, the first section 661 comprising a first light transmissive resilient shelf 667 having a center locating aperture 671 that locates a golf ball 500 in a position so that a light gap 686 is defined between a golf ball 500 and a wall 673, 674 of a container section, the second section 662 comprising a second light transmissive resilient shelf 668 having a center locating aperture 672 that locates a golf ball 500 in a position so that a light gap is defined between a golf ball 500 and a wall of the container, the container 600 being configured so that when one or more golf ball 500 is disposed between the first shelf 667 and the second section 668, and the second section 662 is coupled to the first section 661, spring forces imparted by the first shelf 667 and the second shelf 668 hold one or more golf ball 500 in a stable position in the container 600. There is also set forth herein a container, wherein the container includes a clip 630 for facilitating wearing on clothing of a golfer 420. There is also set forth herein a container 600, wherein the container comprises flexible material. Apparatus 600 can be configured for changing a luminescent ball 500 sized to be other than a golf ball.

In another aspect, illumination features set forth herein can be enhanced so that sequencing of illumination providing apparatus such as one or more of apparatus 100, 200, 300, 400, 500, 550, 600 is responsive to movement of a golfer. It have been noted that in many embodiments illumination providing apparatus 100, 200, 300, 400, 500, 550, 600 can be battery operated. Accordingly, providing functionality so that light source bank 710 can be de-energized when not in use can advantageously increase a battery life of illumination providing apparatus 100, 200, 300, 400, 500, 550, 600. In one example, cup apparatus 200 and/or golf flag apparatus 300 can be provided with electronically readable identifiers identifying a golf hole to which they are associated, e.g., hole 1, hole 2, hole 3. These electronically readable identifiers can be provided before or after installation of a cup apparatus 200 and or golf flag apparatus 300 with respect to a particular hole. Apparatus 200 and/or apparatus 300 can also be provided so that they can be addressed for communication in a manner corresponding to their hole identifier and in one embodiment communication addresses for apparatus 200 and/or apparatus 300 can provide the hole identifiers for the cup apparatus 200 and/or golf flag apparatus 300.

Figure 17:
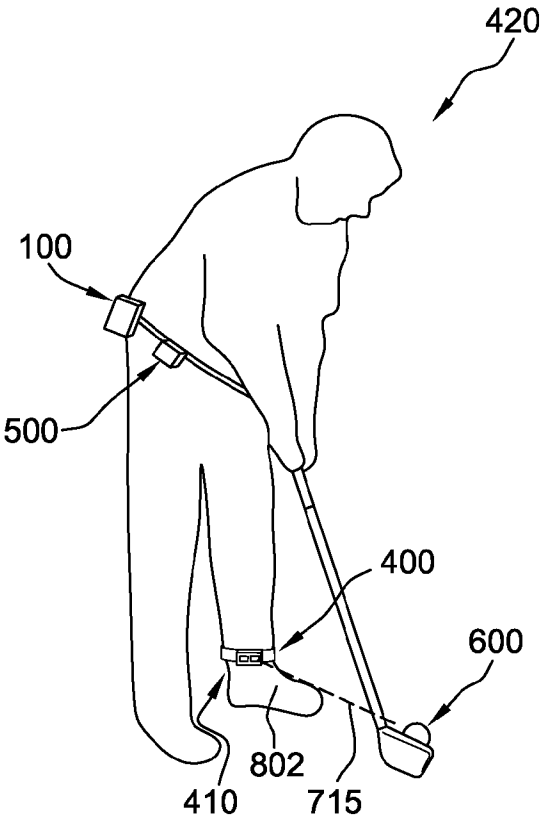
FIG. 17 is a perspective view of a golfer wearing a wearable illumination providing apparatus.
Figure 16:
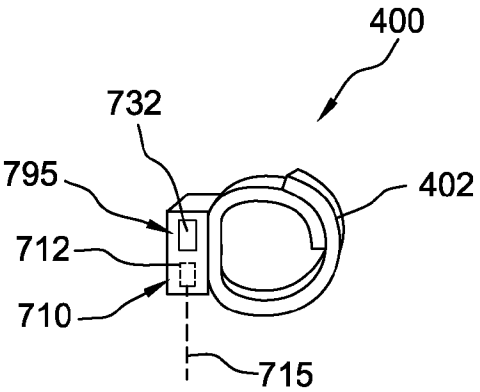
FIG. 16 is a top perspective view of a wearable illumination providing apparatus in one embodiment.
Figure 32:
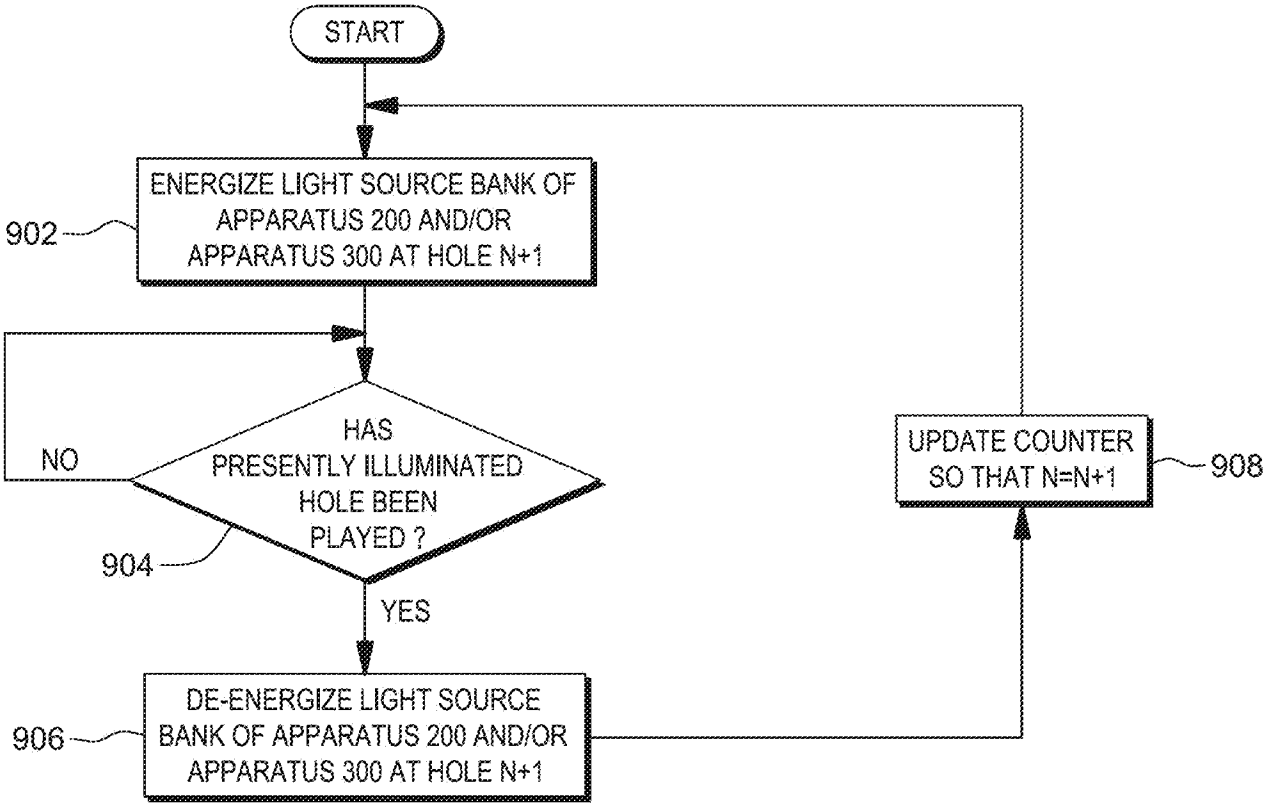
FIG. 32 is a flow diagram of a software program that can be executed by a CPU of a CPU equipped apparatus for sequencing energizations of a golf course illumination providing apparatus responding to movement of a golfer.

An executable computer program for controlling sequencing of energizations of apparatus 200 and/or apparatus 300 having separate deployments at a sequence of golf holes is set forth in the flow diagram of FIG. 32. The program can be executed by a control apparatus 100 provided in one embodiment by smart phone carried by the golfer playing a round of golf (FIG. 17). In addition or alternatively, the program of FIG. 29 can be performed by a control apparatus provided by wearable apparatus 400 worn by a golfer. Control apparatus 100, 400 can be a portable apparatus having the features depicted in the block diagram of FIG. 2 and in one embodiment can be provided by a smart phone carried by a golfer. Accordingly, FIG. 2 is further labeled with the reference numeral "100".

At block 902 control apparatus 100, 400 can energize light source bank 710 of apparatus 200 and/or apparatus 300 of hole N+1 of a golf course. The first time block 902 is executed, a counter maintaining a count of the value N can be zero and so a first time block 902 is executed apparatus 200 and/or apparatus 300 at hole 1 can be energized. For execution of block 902 control apparatus 100, 400 can transmit an SMS message to the apparatus 200 and/or apparatus 300 resulting in energizations of light source banks 710 at respective apparatus 200 and/or apparatus 300.

At block 904 control apparatus 100, 400 can determine whether the presentably illuminated hole has been played. For execution of block 904 apparatus 100, 400 can monitor a signal strength from short range wireless interfaces 580 of apparatus 200 and/or apparatus 300 (apparatus 300 having shield 320) at a current hole. If apparatus 100, 400 determines that a period has transpired wherein apparatus 100, 400 was in range of one or more of short range interfaces 580 of apparatus 200 and/or apparatus 300 a current hole but is no longer in range of one or more of short range interfaces 580 of a current hole, apparatus 100, 400 can determine that a golfer carrying apparatus 100, 400 has proceeded to location proximate cup apparatus 200 and golf flag apparatus 300 of a current hole but has subsequently moved from the proximate location and hence has completed playing of a hole. If apparatus 100, 400 determines a hole has been played, apparatus 100, 400 can execute block 906 to de-energize light source bank 710 of apparatus 200 and/or apparatus 300 at the just played hole and can increment the counter by one at block 908 before executing block 902 with the value of the counter updated. Apparatus 100, 400 can continue to execute block 900 to maintain illumination of a current hole until it successfully determine that the hole has been played. In the flow diagram of FIG. 32 there is described a sequencing method that can be performed entirely without location coordinated information, e.g., as can be determined by a GPS. Other light sequencing methods can be employed which use location coordinate information, e.g., which can utilize GPS 790 for location determination. In such embodiment apparatus 100, 400 can include a map which includes mapped coordinates for the sections as the various golf holes and which determines whether a hole has been played based on the mapped coordinates.

The program depicted in FIG. 29 can be performed with use of executable instructions that are stored on a tangible computer readable medium 800 (FIG. 33) such as a portable compact disc or a fixed location hard disc associated with a remote server.

Figure 34:
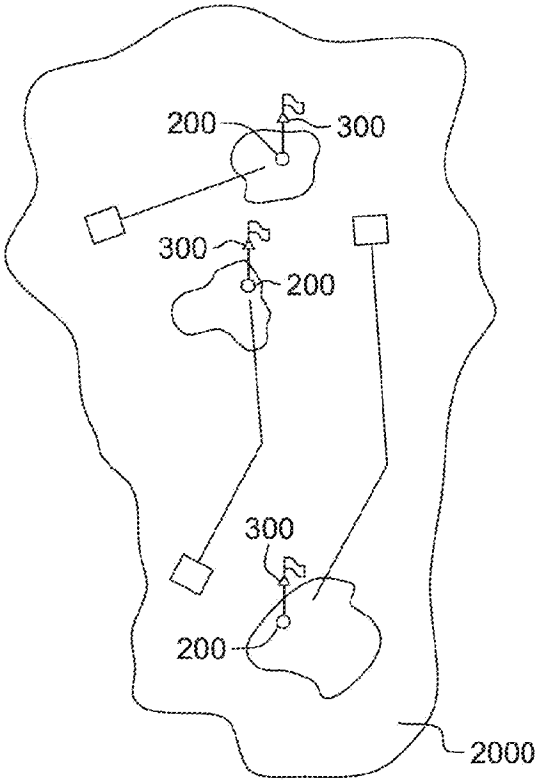
FIG. 34 is a depiction of a golf course having a plurality of holes.
Figure 33:
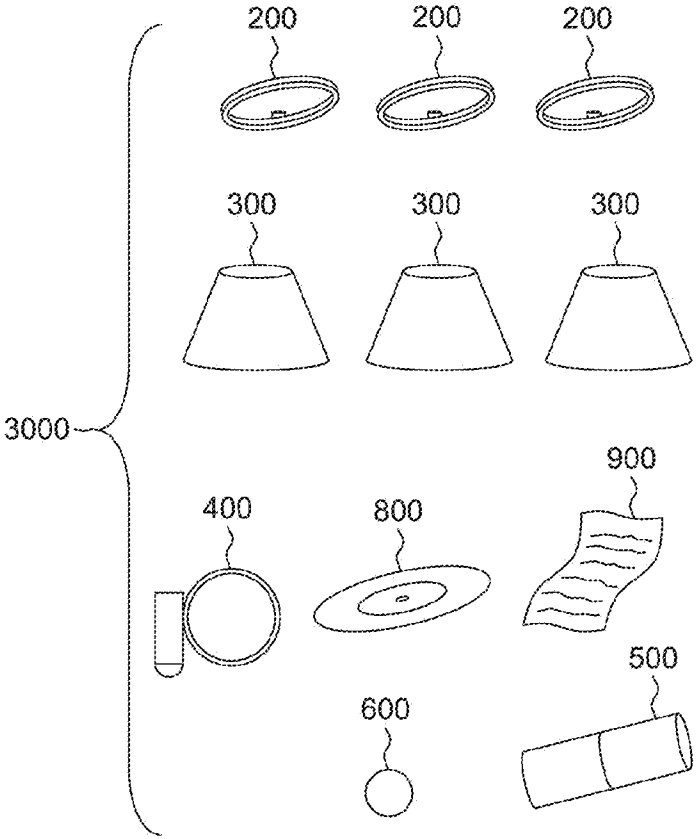
FIG. 33 is a depiction of a golf course illumination kit.

As indicated in FIG. 33 various illumination providing apparatus set forth herein can be provided in the form of a kit 3000 for facilitating installation of the features relative to one or more hole of a golf course. The kit 3000 depicted in FIG. 33 is adapted for implementation of a lighted three hole golf course 2000 (FIG. 34) and hence includes three apparatus 200 and three apparatus 300. Kit 3000 can also include a single wearable apparatus 400 as well as a tangible computer readable medium 800 usable by the recipient of kit 3000 having CPU executable instructions for performance of the program depicted in FIG. 32 as well as an instruction manual 900. Instruction manual 900 can include a paper instruction manual or else can be stored on a web page of a retailer, distributor or retailer of kit 3000. The instruction manual 900 can include one or more instruction relating to use of one or more of apparatus 200 apparatus 300 or apparatus 400.

Examples of instructions that can be provided by instruction manual 900 can include one or more of the following instructions related to use of one of the apparatus and set forth in Table A.

TABLE A

SAMPLE INSTRUCTIONS OF INSTRUCTION MANUAL 700

| EXAMPLE | SAMPLE INSTRUCTION | APPARATUS |
|---|---|---|
| A | FORM HOLE IN SOIL AND INSTALL CUP APPARATUS | 200 |
| B | ADJUST SHIELD TO DESIRED HEIGHT | 300 |
| C | OPEN TRIPOD LEGS AND STAND FLAG NEAR CUP | 300 |
| D | MAKE SURE SHIELD IS ALIGNED OVER CUP APPARATUS | 200 and 300 |

TABLE A-continued

| SAMPLE INSTRUCTIONS OF INSTRUCTION MANUAL 700 | | |
|---|---|---|
| EXAMPLE | SAMPLE INSTRUCTION | APPARATUS |
| E | MAKE SURE LIGHT POINTS TO CUP APPARATUS WALL | 200 |
| F | AFFIX APPARATUS TO SHOE SO LIGHT POINTS TO GOLF BALL WHEN TAKING STANCE | 400 |
| G | PLACE APPARATUS HAVING RING SHAPED ASSEMBLY IN GOLF CUP APPARATUS | 200 |
| H | PLACE BALL IN INTERIOR OF CHARGER AND CLOSE SECTIONS TOGETHER | 500, 600 |

There is set forth herein a kit for use in providing illuminated golf, the kit comprising one or more illumination providing apparatus for illuminating at least part of a golf course, the one or more illumination providing apparatus being selected from the group consisting of (a) a golf cup apparatus supporting a light source bank; (b) a golf flag apparatus supporting a light source bank; (c) a player wearable apparatus having a light source bank; and an instruction manual including at least one instruction relating to use of the one or more illumination providing apparatus. There is also set forth herein a kit, wherein the kit includes a golf cup apparatus supporting a light source having central emission vector directed toward an interior side of the cup apparatus. There is also set forth herein a kit, wherein the kit includes a golf flag apparatus having a shield. There is also set forth herein a kit, wherein the kit includes a golf flag apparatus comprising a golf stand having tripod legs. There is also set forth herein a kit, wherein the kit includes a golfer wearable apparatus wearable about a foot area of the golfer. There is also set forth herein a kit, wherein the kit includes a computer readable medium including computer executable instructions for sequencing energization of illumination providing apparatus responsively to movement of a golfer.

In any method set forth herein wherein there is described a providing of an apparatus, the providing can comprise merely presenting for use of the apparatus; that is, while a providing in one embodiment can further comprise a supplying, e.g., a manufacturing and/or distributing the providing need not comprise a supplying or any element other than a presenting for use.

A small sample of systems methods and apparatus that are described herein is as follows:

A1. A golf cup apparatus comprising:

an inner peripheral wall;

a light source bank that illuminates the inner peripheral wall;

a central aperture for accommodating a golf flag so that the golf flag can be removeably held within the central aperture A2. The golf cup apparatus of A1, wherein the light source bank has a central emission vector that is directed to the inner peripheral wall.

A3. The golf cup apparatus of A1, wherein the golf cup apparatus includes an associated solar panel.

B1. An apparatus comprising:

an assembly having an outer peripheral wall, the outer peripheral wall including a shape corresponding to an inner peripheral wall of a golf cup;

a light source bank supported by the assembly for illuminating the inner peripheral wall.

B2. The apparatus of B1, wherein the light source bank is supported by the assembly.

B3. The apparatus of B1, wherein the assembly defines a void to allow entry and removal of a golf flag pole.

B4. The apparatus of B1, wherein the assembly is adapted to be replaceably removable from a golf cup.

B5. The apparatus of B1, wherein the light source bank has a central emission vector arranged in a manner so that when the apparatus is disposed in a golf cup the central emission vector is directed to the wall of the golf cup.

B6. The apparatus of B1, wherein the assembly is shaped to facilitate installation and removal of the apparatus from a golf cup apparatus without removal of a golf flag pole from the golf cup.

C1. A method for illuminating an area about a golf cup, the method comprising:

providing an apparatus having an assembly that supports a light source bank; and disposing the assembly in the golf cup in a manner that light emitted from the light source bank is directed toward an interior wall of the golf cup.

C2. The method of C1, wherein the providing includes providing the assembly to include an outer peripheral wall that corresponds to a shape of the golf cup, and wherein the disposing includes locating the outer peripheral wall on the interior wall of the golf cup.

C3. The method of C1, wherein the disposing includes disposing the assembly in the golf cup in a manner that a central emission vector of light emitted from the light source bank is directed toward an interior wall of the golf cup.

D1. An apparatus comprising:

a shield having a center and one or more wall, the one or more wall having an interior and an exterior;

a light source bank disposed to emit light downward from the shield;

wherein the shield is adapted to be mounted on a golf flag shaft.

D2. The apparatus of D1, wherein the shield has a flattened top on which there is disposed a solar panel.

D3. The apparatus of D1, wherein the shield includes a display that displays a range of a golfer from the shield.

D4. The apparatus of D2, wherein the shield is configured to limit an amount of precipitation entering an interior of the shield.

D5. The apparatus of D1, wherein the shield is adapted so that the shield can be manually adjusted to various positions on a golf flag.

D6. The apparatus of D1, wherein the shield defines a narrowing perimeter from bottom to top.

D7. The apparatus of D1, wherein the shield is adapted so that an interior of the shield is light reflective.

D8. The apparatus of D1, wherein the shield includes a height less than a radius of the shield.

E1. An apparatus comprising:

a clip section having opposing interior walls delimiting a downward facing opening for receiving a golf shoe wall;

an adjacently disposed pant leg retainer section having interior walls delimiting an upward facing opening;

a light source bank for directing light generally forwardly when the apparatus is disposed on a golf shoe.

E2. The apparatus of E1, wherein the pant leg retainer section has an exterior wall and wherein the light source bank is fixedly disposed on the exterior wall.

E3. The apparatus of E1, wherein the apparatus is adapted so that a light source of the light source bank can be repositioned in order to direct light in a first direction and alternatively a second direction.

E4. The apparatus of E1, wherein the apparatus includes a solar panel for use in energizing the light source bank.

E5. The apparatus of E1, wherein the clip section and the pant leg retainer section are of unitary construction.

F1. A method for illuminating an area about a golfer, the method comprising:

providing an apparatus having a first set of opposing walls defining a first downward facing opening and an adjacently formed second set of opposing walls that define an upward facing opening and a light source bank for illuminating an area external to the apparatus;

disposing the first downward facing opening onto a golf shoe wall of a golfer.

F2. The method of F1, wherein the disposing further included disposing the apparatus so that a pant leg of the golfer is retained by the second set of opposing walls.

G1. A method for training a golfer, the method comprising:

disposing a light source bank on a lead foot of a golfer in a manner that the light source bank emits a beam of light toward a golf ball;

executing a golf swing while maintaining the beam in a substantially stable position.

H1. A method for illuminating a golf hole, the method comprising:

providing an apparatus capable of being supported on a shoe area of a golfer and having a light source bank; and positioning the apparatus on a shoe area of a golfer.

I1. An apparatus comprising:

a plurality of legs, wherein the apparatus is adapted to be mounted on a golf flag;

wherein the apparatus has a first position in which the plurality of legs are adapted to stand a golf flag on a golf green.

I2. The apparatus of I1, adapted so that an elevation of the apparatus on a golf flag can be adjusted.

I3. The apparatus of I1, wherein the apparatus has a second position in which distal ends of the plurality of legs are adapted to be located closer to a golf flag than in the first position.

I4. The apparatus of B1, wherein the plurality of legs consist of two legs.

J1. A method for illuminating a golf hole, the method comprising:

disposing a stand for standing a golf flag pole on a golf flag pole;

disposing a light source bank on the golf flag pole;

removing the golf flag pole from a golf cup; and with the golf flag pole removed from the golf cup standing the golf flag pole using the stand.

K1. An apparatus for charging one or more luminescent golf ball;

a container for containing a golf ball, the container having one or more interior wall delimiting an interior.

a light source bank for illuminating the interior of the container;

wherein the container is adapted to hold one or more golf ball in the interior a manner that the one or more golf ball is illuminated by the light source bank while being held by the container.

K2. The apparatus of K1, wherein the one or more interior wall includes a reflective surface.

K3. The apparatus of K1, wherein the container includes first and second sections each having a rigid housing.

K4. The apparatus of K1, wherein the apparatus includes a light transmissive shelf including a center locating ring for locating a golf ball.

K5. The apparatus of K1, wherein the container comprises a first section and a second section, the first section comprising a first light transmissive resilient shelf having a center locating aperture that locates a golf ball in a position so that a light gap is defined between a golf ball and an interior wall of the container, the second section comprising a second light transmissive resilient shelf having a center locating aperture that locates a golf ball in a position so that a light gap is defined between a golf ball and an interior of the container, the container being configured so that when the one or more luminescent golf ball is disposed between the first shelf and the second shelf, and the second section is coupled to the first section, spring forces imparted by the first shelf and the second shelf hold the one or more golf ball in a stable position in the container.

K6. The apparatus of K1, wherein the container is adapted so that when a golf ball of the one or more golf ball is disposed in the container the golf ball receives illumination over an entire surface area of the golf ball.

K7. The apparatus of K1, wherein the container is adapted so that when a golf ball of the one or more golf ball is disposed in the container a gap is defined between the golf ball and an interior wall of the container that extends at least a height of the golf ball.

K8. The container of K1, wherein the container includes a clip for facilitating wearing on clothing of a golfer.

K9. The container of K1, wherein the container comprises flexible material.

L1. A method for making a golf ball comprising:

providing one or more inner layer; and providing an outer layer, wherein the providing the outer layer includes injection molding the outer layer using injection molding material that includes photo luminescent material.

L2. The method of L1, wherein the photo luminescent material includes strontium illuminate.

L3. The method of L1, wherein the method includes disposing the golf ball a light source.

M1. A kit for use in providing illuminated golf, the kit comprising:

one or more illumination providing apparatus for use in illuminating a golf hole, the one or more illumination providing apparatus being selected from the group consisting of (a) a golf cup apparatus supporting a light source bank; (b) a golf flag apparatus supporting a light source bank; (c) a player wearable apparatus having a light source bank; and (d) a container having an interior sized to receive one or more luminescent golf ball and having a light source bank for illuminating the one or more luminescent golf ball; and an instruction manual including at least one instruction relating to use of the one or more illumination providing apparatus.

M2. The kit of M1, wherein the kit includes a golf cup apparatus supporting a light source having a central emission vector directed toward an interior wall of the cup apparatus.

M3. The kit of M1, wherein the kit includes a golf flag apparatus having a shield.

M4. The kit of M1, wherein the kit includes a golf flag apparatus comprising a golf stand.

M5. The kit of M1, wherein the kit includes a golfer wearable apparatus wearable about a foot area of the golfer.

M6. The kit of M1, wherein the kit includes a computer readable medium including computer executable instructions for sequencing energization of illumination providing apparatus responsively to movement of a golfer.

M7. The kit of M1, wherein the kit includes an illumination providing apparatus detachably attachable to a golf club.

N1. A kit for use in providing illuminated golf, the kit comprising:

one or more illumination providing apparatus for use in illuminating a golf hole, the one or more illumination providing apparatus being selected from the group consisting of (a) a golf cup apparatus supporting a light source bank in a manner that light from a light source of the light source bank is directed to an interior wall of a golf cup;

(b) a golf flag apparatus attachable to a golf flag pole supporting a light source bank having a shield defining an interior wherein the golf flag apparatus is adapted so that light from the light source bank is directed below the shield;

(c) a golf flag apparatus defining a golf flag pole stand adapted for standing a golf flag pole;

(d) a golfer wearable apparatus having a light source bank and being adapted to be wearable on a foot area of a golfer; and (e) a golf ball charger having an interior sized to receive one or more luminescent golf ball and having a light source bank for illuminating the one or more luminescent golf ball; N2. The kit of N1, wherein the kit comprises (a) and (b).

N3. The kit of N1, wherein the kit comprises (b) and (c).

N4. The kit of N1, wherein the kit comprises (a) and wherein the golf cup apparatus is adapted to be removeably installable in a golf cup.

N5. The kit of N1, wherein the kit comprises (b) and wherein the shield is adapted to be manually moveable between various elevations of a golf flag pole with use of a crimping lock.

N6. The kit of N1, wherein the kit comprises (c), and wherein the stand includes a detent disposed internal to a golf flag pole.

N7. The kit of N1, wherein the kit comprises (d) and wherein the golfer wearable apparatus is adapted to be attached to a shoe wall.

N8. The kit of N1, wherein the kit comprises (e) and wherein the charger includes a light transmissive member supporting the one or more luminescent golf ball in an interior of the charger.

O1. An apparatus comprising:

a shield;

a light source bank disposed to emit light downward from the shield;

wherein the shield is adapted to be mounted on a golf flag shaft.

O2. The apparatus of O1, wherein the shield has a flattened top on which there is disposed a solar panel.

O3. The apparatus of O1, wherein the shield includes a display that displays a range of a golfer from the shield.

O4. The apparatus of O2, wherein the shield is configured to limit an amount of precipitation entering an interior of the shield.

O5. The apparatus of O1, wherein the shield is adapted so that the shield can be manually adjusted to various positions on a golf flag.

O6. The apparatus of O1, wherein the shield defines a narrowing perimeter from bottom to top.

O7. The apparatus of O1, wherein the shield is adapted so that an interior of the shield is light reflective.

O8. The apparatus of O1, wherein the shield includes a height less than a radius of the shield.

P1. A kit for use in providing illuminated golf, the kit comprising:

one or more illumination providing apparatus for use in illuminating a golf hole, the one or more illumination providing apparatus being selected from the group consisting of (a) a golf cup apparatus supporting a light source bank in a manner that light from a light source of the light source bank is directed to an interior wall of a golf cup;

(b) a golf flag apparatus attachable to a golf flag pole supporting a light source bank having a shield defining an interior wherein the golf flag apparatus is adapted so that light from the light source bank is directed below the shield;

(c) a golf flag apparatus defining a golf flag pole stand adapted for standing a golf flag pole;

(d) a golfer wearable apparatus having a light source bank and being adapted to be wearable on a foot area of a golfer; and (e) a golf ball charger having an interior sized to receive one or more luminescent golf ball and having a light source bank for illuminating the one or more luminescent golf ball;

(f) a golf club attachable apparatus attachable to a golf club and having a light source bank.

P2. The kit of P1, wherein the kit comprises (a) and (b).

P3. The kit of P1, wherein the kit comprises (b) and (c).

P4. The kit of P1, wherein the kit comprises (a) and wherein the golf cup apparatus is adapted to be removeably installable in a golf cup.

P5. The kit of P1, wherein the kit comprises (b) and wherein the shield is adapted to be manually moveable between various elevations of a golf flag pole with use of a crimping lock.

P6. The kit of P1, wherein the kit comprises (c), and wherein the stand includes a detent disposed internal to a golf flag pole.

P7. The kit of P1, wherein the kit comprises (d) and wherein the golfer wearable apparatus is adapted to be attached to a shoe wall.

P8. The kit of P1, wherein the kit comprises (e) and wherein the charger includes a light transmissive member supporting the one or more luminescent golf ball in an interior of the charger.

P9. The kit of P1, wherein the kit comprises (f), and wherein the golf club attachable apparatus is adapted so that a central emission vector of a light source of the golf club attachable apparatus is parallel to a shaft of a golf club when the golf club attachable apparatus is attached to the golf club.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than or greater than the mentioned certain number of elements. Also, while a number of particular embodiments have been described with reference to each particular embodiment can be used with each remaining particularly described embodiment.

The invention claimed is:

1. An apparatus comprising;

a shield; and a light source bank disposed to emit light from the shield;

wherein the shield is adapted to be mounted on a golf flag pole;

wherein the apparatus is characterized by one or more of the following selected from the group consisting of: (a) the shield is adapted so that the shield can be manually adjusted to various positions on a golf flag pole; (b) the shield includes a height less than a radius of the shield, and (c) the light source bank is disposed to emit light upward from the shield.

2. The apparatus of claim 1, wherein the shield has a flattened top on which there is disposed a solar panel.

3. The apparatus of claim 2, wherein the shield is configured to limit an amount of precipitation entering an interior of the shield.

4. The apparatus of claim 1, wherein the shield includes a display that displays a range of a golfer from the shield.

5. The apparatus of claim 1, wherein the shield is adapted so that the shield can be manually adjusted to various positions on a golf flag pole.

6. The apparatus of claim 1, wherein the shield is adapted so that an interior of the shield is light reflective.

7. The apparatus of claim 1, wherein the shield includes a height less than a radius of the shield.

8. The apparatus of claim 1, wherein the light source bank is supported on the shield, and wherein the light source bank is disposed to emit light upward from the shield for illumination of a golf flag.

9. The apparatus of claim 1, wherein the light source bank is supported on the shield and is disposed to emit light upward and downward from the shield.

10. The apparatus of claim 1, wherein the apparatus includes the golf flag pole, and wherein the shield is positioned on the golf flag pole at an elevation on the golf flag pole closer to an elevation of a golf flag than a bottom of the golf flag pole.

11. A method for illuminating an area about a golf cup, the method comprising;

providing an apparatus having an assembly that supports a light source bank; and disposing the assembly in the golf cup in a manner that a central emission vector of light emitted from the light source bank is directed toward a vertically extending cylindrical interior wall of the golf cup.

12. The method of claim 11, wherein the providing includes providing the assembly to include an outer peripheral wall that corresponds to a shape of the golf cup, and wherein the disposing includes locating the outer peripheral wall on the interior wall of the golf cup.

13. A method for illuminating an area about a golfer, the method comprising;

providing an apparatus having a first set of opposing walls defining a first downward facing opening and an adjacently formed second set of opposing walls that define an upward facing opening and a light source bank for illuminating an area external to the apparatus; and disposing the first downward facing opening onto a golf shoe wall of a golfer, wherein the disposing further includes disposing the apparatus so that a pant leg of the golfer is retained by the second set of opposing walls.

14. A kit for use in providing illuminated golf, the kit comprising:

(a) a golf cup apparatus supporting a light source bank in a manner that light from a light source of the light source bank is directed to an interior wall of a golf cup;

(b) a golf flag apparatus attachable to a golf flag pole supporting a light source bank having a shield defining an interior wherein the golf flag apparatus is adapted so that light from the light source bank is directed from the shield; and (c) a golfer wearable apparatus having a light source bank and being adapted to be wearable on a foot area of a golfer.

15. The kit of claim 14, wherein the golf cup apparatus is adapted to be removeably installable in a golf cup.

16. The kit of claim 14, wherein the shield is adapted to be manually moveable between various elevations of a golf flag pole with use of a crimping lock.

17. The kit of claim 14, wherein the golfer wearable apparatus is adapted to be attached to a shoe wall.

18. The kit of claim 14, wherein the kit comprises a golf ball charger having an interior sized to receive one or more luminescent golf ball and having a light source bank for illuminating the one or more luminescent golf ball, and wherein the charger includes a light transmissive member supporting the one or more luminescent golf ball in an interior of the charger.

19. The kit of claim 14, wherein the shield is adapted to be manually moveable between various elevations of a golf flag pole:

wherein the shield has a solar panel; and wherein the shield includes a height less than a radius of the shield.

20. The kit of claim 14, wherein the kit comprises a golf ball charger and wherein the golf ball charger includes:

a container for containing a golf ball, the container having one or more interior wall delimiting an interior; a light source bank for illuminating the interior of the container;

wherein the container is adapted to hold one or more golf ball in the interior a manner that the one or more golf ball is illuminated by the light source bank while being held by the container;

wherein the one or more interior wall includes a reflective surface; and wherein the golf ball charger is adapted to be wearable.

21. The kit of claim 14, wherein the kit comprises a golf flag pole stand adapted for standing a golf flag pole.

22. The kit of claim 21, wherein the stand includes a detent disposed internal to a golf flag pole.

23. A golf club attachable apparatus adapted so that a central emission vector of a light source of the golf club attachable apparatus is parallel to a shaft of a golf club when the golf club attachable apparatus is attached to the golf club, the golf club attachable apparatus being attachable to a golf club shaft and having a structural body supporting the light source that is configured so that when the golf club attachable apparatus is attached to the golf club shaft the structural body extends a distance from the golf club shaft that is substantially equal to a diameter of the golf club shaft or less.

24. An apparatus comprising:

a ring shaped assembly defining an outer peripheral wall, the outer peripheral wall including a shape corresponding to a vertically extending cylindrical inner peripheral wall of a golf cup, wherein the ring shaped assembly defines a center void adapted to accommodate movement of a golf flag pole within the center void; and a light source bank supported on the ring shaped assembly for illuminating the inner peripheral wall.

25. The apparatus of claim 24, wherein the apparatus is shaped to facilitate installation and removal of the apparatus without removal of a golf flag pole from the golf cup.

26. The apparatus of claim 24, wherein the ring shaped assembly is an open perimeter ring shaped assembly.

27. The apparatus of claim 24, wherein the light source bank is supported so that a central emission vector of light emitted by the light source bank is directed toward the vertically extending cylindrical inner peripheral wall.

28. A golf flag apparatus comprising:

a plurality of legs, wherein the golf flag apparatus is adapted to be mounted on a golf flag pole;

wherein the golf flag apparatus has a first position in which the plurality of legs are adapted to stand a golf flag pole on a golf green; and wherein the golf flag apparatus has a second position in which distal ends of the plurality of legs are adapted to be located closer to a golf flag pole than in the first position.

29. A golfer wearable apparatus comprising:

a clip section having opposing interior walls delimiting a downward facing opening for receiving a golf shoe wall;

an adjacently disposed pant leg retainer section having interior walls delimiting an upward facing opening; and a light source bank for directing light generally forwardly when the apparatus is disposed on a golf shoe.

* * * * *